US011046479B2

(12) United States Patent
Frishman

(10) Patent No.: US 11,046,479 B2
(45) Date of Patent: Jun. 29, 2021

(54) NON-METAL AND HYBRID BOTTLE CROWNS WITH OPENER ASSEMBLY

(71) Applicant: World Bottling Cap LLC, Carrollton, TX (US)

(72) Inventor: Abe Frishman, Carrollton, TX (US)

(73) Assignee: World Bottling Cap LLC, Carrollton, TX (US)

( * ) Notice: Subject to any disclaimer, the term of this patent is extended or adjusted under 35 U.S.C. 154(b) by 0 days.

(21) Appl. No.: 15/627,621

(22) Filed: Jun. 20, 2017

(65) Prior Publication Data

US 2017/0361998 A1 Dec. 21, 2017

Related U.S. Application Data

(63) Continuation of application No. 14/956,885, filed on Dec. 2, 2015, now abandoned, which is a (Continued)

(30) Foreign Application Priority Data

Mar. 28, 2014 (TW) ..... 103111634

(51) Int. Cl.
*B65D 17/28* (2006.01)
*B65D 41/42* (2006.01)
(Continued)

(52) U.S. Cl.
CPC ..... *B65D 17/4012* (2018.01); *B65D 41/04* (2013.01); *B65D 41/42* (2013.01); *B65D 51/245* (2013.01)

(58) Field of Classification Search
CPC ..... B65D 17/165; B65D 41/34; B65D 41/12; B65D 17/24
See application file for complete search history.

(56) References Cited

U.S. PATENT DOCUMENTS 771,712 A 10/1904 Coale et al.
786,521 A 4/1905 Schroeder
(Continued)

FOREIGN PATENT DOCUMENTS

CN 201321197 Y 10/2009
CN 201729365 U 2/2011
(Continued)

OTHER PUBLICATIONS

International Search Report and Written Opinion for PCT/US2015/028541, dated Jul. 22, 2015.
(Continued)

*Primary Examiner* — Jeffrey R Allen
(74) *Attorney, Agent, or Firm* — Michael Best & Friedrich LLP

(57) ABSTRACT

A crown for a bottle or other container has a top portion and an annular skirt that descends contiguously from the top portion. An opener assembly and an arrangement of frangible scoring lines on the crown allow for ease of opening the bottle or container. Corrugated embodiments provide material strengthening for a reduced gauge crown. Embodiments include entire crowns formed of non-metal materials, metal crowns having non-metal opener assemblies, and metal crowns having opener assemblies that are partially metal and partially non-metal. Unique techniques for attachment of such various opener assemblies are also disclosed.

15 Claims, 31 Drawing Sheets

Related U.S. Application Data continuation-in-part of application No. 14/605,704, filed on Jan. 26, 2015, now abandoned, which is a continuation-in-part of application No. 14/244,571, filed on Apr. 3, 2014, now Pat. No. 9,533,800.

(51) Int. Cl.
*B65D 41/04* (2006.01)
*B65D 51/24* (2006.01)

(56) References Cited

U.S. PATENT DOCUMENTS 800,867 A 10/1905 Mulvaney
814,531 A 3/1906 Gillette
876,149 A 1/1908 Cook
1,168,386 A 1/1916 Gaston
1,233,896 A 7/1917 McDonnell
1,294,171 A 2/1919 Rockwell
1,413,256 A 4/1922 Carvalho et al.
1,516,207 A 11/1924 Rockwell
1,639,857 A 8/1927 Planski
1,693,117 A 11/1928 McDonnell
1,899,210 A 2/1933 Ramsay
2,046,173 A 6/1936 Lenhoff
2,099,056 A 11/1937 Ferngren
2,104,344 A 1/1938 Heymann
2,187,454 A 1/1940 Hutaff, Jr.
2,191,447 A 2/1940 Beardsley
2,233,904 A 3/1941 Wagner
2,327,454 A 8/1943 Punte
2,327,455 A 8/1943 Punte
2,387,955 A 10/1945 Tilson
2,696,318 A 12/1954 Kihm
2,829,790 A 4/1958 Isele-Aregger
3,057,501 A 10/1962 Kroenert
3,122,253 A 2/1964 Hagmann et al.
3,195,755 A 7/1965 Scharf
3,199,705 A 8/1965 Brockett
3,206,055 A 9/1965 Helbling
3,207,350 A 9/1965 Hagmann et al.
3,266,659 A 8/1966 Frankenberg
3,268,368 A 8/1966 Mackiw et al.
3,281,007 A 10/1966 Dorosz
3,380,609 A 4/1968 Potts
3,450,291 A 6/1969 Lovell
3,451,367 A 6/1969 Henrickson
3,462,036 A 8/1969 Siemonsen et al.
3,479,790 A 11/1969 LaBarge
3,480,173 A 11/1969 Wheaton
3,522,899 A 8/1970 Siemonsen et al.
3,540,611 A 11/1970 Nishikawa
3,545,638 A 12/1970 Brown
3,556,336 A 1/1971 Coop
3,561,631 A 2/1971 Hatfield et al.
3,598,272 A 8/1971 Bustamante et al.
3,618,816 A * 11/1971 Brown ..... B65D 17/4012 220/273
3,630,405 A 12/1971 Podesta
3,674,172 A 7/1972 Wells et al.
3,701,454 A 10/1972 Thorp et al.
3,724,700 A 4/1973 Heffran
3,734,333 A 5/1973 Foss
3,743,129 A * 7/1973 Willis ..... B65D 41/40 215/255
3,823,841 A 7/1974 Lovejoy
3,834,573 A 9/1974 Amos
3,851,793 A 12/1974 Brown
3,870,184 A 3/1975 Fuchs et al.
3,905,503 A 9/1975 Fraze
3,908,856 A 9/1975 Perry
3,920,142 A 11/1975 Vandrebeck et al.
3,931,904 A 1/1976 Coop
3,940,254 A 2/1976 McMullen et al.
3,957,172 A * 5/1976 Hasegawa ..... B65D 17/4012 220/269
3,958,710 A 5/1976 Harding et al.
RE28,862 E 6/1976 Siemonsen et al.
3,963,140 A 6/1976 Harding
3,963,141 A 6/1976 Liu
3,979,002 A 9/1976 Faulstich
4,003,488 A 1/1977 Moller
4,004,705 A 1/1977 Fujio
4,060,172 A 11/1977 Amabili
4,066,180 A 1/1978 Sanchez
4,087,018 A 5/1978 Tebbutt
4,089,753 A 5/1978 McMullen et al.
4,106,422 A 8/1978 Buhrke
4,176,014 A 11/1979 Ruscoe et al.
4,184,605 A 1/1980 Hanson
4,227,619 A 10/1980 Magnusson
4,247,374 A 1/1981 Ruscoe et al.
4,279,968 A 7/1981 Ruscoe et al.
4,318,493 A 3/1982 Jacobsen et al.
4,434,908 A 3/1984 French
4,453,644 A 6/1984 Berglund
4,465,204 A 8/1984 Kaminski et al.
RE31,869 E 4/1985 Harding
4,534,481 A 8/1985 Summers et al.
4,569,621 A 2/1986 Sjogren et al.
4,579,761 A 4/1986 Ruscoe et al.
4,610,072 A * 9/1986 Muller ..... B23P 19/062 227/120
4,733,793 A * 3/1988 Moen ..... B65D 17/4012 220/269
4,768,667 A 9/1988 Magnusson
4,930,656 A 6/1990 Bianchette
5,020,686 A 6/1991 Dutt
5,069,345 A 12/1991 Irwin
5,080,245 A 1/1992 Conard
5,143,241 A 9/1992 Szymanski
5,145,084 A 9/1992 Murayama et al.
5,458,253 A 10/1995 Shapcott
5,741,105 A 4/1998 Schubert et al.
5,799,816 A 9/1998 Schubert
5,924,739 A 7/1999 Garbutt
6,006,933 A 12/1999 Henning et al.
6,105,806 A 8/2000 Stasiuk
6,138,856 A 10/2000 Ghim et al.
6,283,318 B1 9/2001 Lee
6,336,307 B1 1/2002 O'Connor
6,533,518 B1 3/2003 Turner et al.
6,808,351 B1 10/2004 Brown et al.
8,061,544 B2 * 11/2011 Frishman ..... B65D 41/42 215/255
8,276,773 B2 10/2012 Frishman
8,365,940 B2 2/2013 Frishman
8,608,006 B2 12/2013 Frishman
8,944,264 B2 2/2015 Frishman
9,321,562 B2 4/2016 Frishman
2002/0104852 A1 8/2002 Staniszewski et al.
2002/0195414 A1 12/2002 Kim et al.
2003/0053890 A1 3/2003 Turner et al.
2003/0092364 A1 5/2003 Erickson et al.
2003/0150834 A1 8/2003 Verderber
2003/0201266 A1 10/2003 Steffan
2005/0092751 A1 5/2005 Alvarez et al.
2005/0279432 A1 12/2005 Takeuchi et al.
2007/0181526 A1 8/2007 Frishman
2010/0096355 A1 4/2010 Chaolu
2010/0183406 A1 7/2010 Gysi et al.
2010/0200534 A1 8/2010 Frishman
2010/0326949 A1 12/2010 Merino Caballero
2011/0024381 A1 2/2011 Frishman
2012/0261380 A1 10/2012 Frishman
2012/0308337 A1 12/2012 Gysi et al.
2015/0034586 A1 2/2015 Frishman
2015/0157535 A1 6/2015 Frishman
2015/0284136 A1 10/2015 Frishman

(56) References Cited

U.S. PATENT DOCUMENTS

| | | | |
|---|---|---|---|
| 2015/0298868 | A1 | 10/2015 | Frishman |
| 2015/0314362 | A1 | 11/2015 | Frishman |
| 2016/0083136 | A1 | 3/2016 | Frishman |

FOREIGN PATENT DOCUMENTS

| | | | |
|---|---|---|---|
| DE | 1038934 | B | 9/1958 |
| DE | 2015629 | A1 | 10/1971 |
| DE | 8527425 | U1 | 1/1986 |
| DE | 3906112 | A1 | 8/1990 |
| DE | 29600761 | U1 | 1/1997 |
| EP | 0262767 | A1 | 4/1988 |
| FR | 322592 | A | 2/1903 |
| FR | 2118176 | A1 | 7/1972 |
| GB | 599704 | A | 3/1948 |
| GB | 759417 | A | 10/1956 |
| GB | 1377767 | A | 12/1974 |
| GB | 1279068 | A | 6/1976 |
| GB | 1540229 | A | 2/1979 |
| JP | S474776 | Y1 | 2/1972 |
| JP | S5865244 | U | 5/1983 |
| JP | S602448 | A | 1/1985 |
| JP | S61112350 | U | 1/1986 |
| JP | S62108250 | U | 7/1987 |
| JP | H02087756 | A | 3/1990 |
| JP | 3533626 | B2 | 3/2004 |
| JP | 2005047621 | A | 2/2005 |
| WO | WO2000051906 | A1 | 9/2000 |
| WO | WO2000071430 | A1 | 11/2000 |
| WO | WO2006048903 | A1 | 5/2006 |
| WO | WO2009009429 | A1 | 1/2009 |
| WO | WO2009035472 | A1 | 3/2009 |
| WO | WO2013052219 | A1 | 4/2013 |

OTHER PUBLICATIONS

International Search Report for PCT/US2006/002421 dated Oct. 17, 2006.
International Preliminary Report on Patentability for PCT/US2006/002421, dated Jul. 15, 2008.
International Search Report for PCT/US2008/000891, dated Jul. 16, 2008.
International Preliminary Report on Patentability for PCT/US2008/000891, dated Jul. 28, 2009.
International Search Report for PCT/US2011/067134, dated Apr. 24, 2012.
International Preliminary Report on Patentability for PCT/US2011/067134, dated Apr. 8, 2014.
International Search Report for PCT/US2012/047949, dated Nov. 5, 2012.
International Preliminary Report on Patentability for PCT/US2012/047949, dated Jun. 3, 2013.
Supplementary European Search Report for EP 12838359 dated Jan. 23, 2015.
International Search Report for PCT/US2014/014555, dated May 22, 2014.
International Preliminary Report on Patentability for PCT/US2014/014555, dated Mar. 23, 2015.
International Search Report for PCT/US2014/032870, dated Aug. 18, 2014.
International Preliminary Report on Patentability for PCT/US2012/053131 dated Jun. 11, 2013.
International Search Report for PCT/US2012/053131 dated Dec. 18, 2012.
International Search Report and Written Opinion for PCT/US2015/013464, dated May 15, 2015.
Supplemental European Search Report for EP14745376.5 dated Sep. 8, 2016.
International Search Report and Written Opinion for PCT/US2015/063384, dated Sep. 22, 2016.

* cited by examiner

NON-METAL AND HYBRID BOTTLE CROWNS WITH OPENER ASSEMBLY

CROSS-REFERENCE TO RELATED APPLICATIONS

This application is a continuation of U.S. application Ser. No. 14/956,885, filed Dec. 2, 2015, which is a continuation-in-part application of U.S. application Ser. No. 14/605,704, filed Jan. 26, 2015, which is a continuation-in-part application of U.S. application Ser. No. 14/244,571, filed Apr. 3, 2014, which claims the benefit of and priority from, Taiwan patent application Serial No. 103111634, filed Mar. 28, 2014, all by the same inventor and the disclosures of which are all incorporated herein by reference for all purposes. In addition, the disclosures of U.S. Pat. Nos. 8,061,544, 8,276,773, 8,365,940, and 8,608,006, and U.S. application Ser. No. 14/098,208, by the same inventor, are all incorporated herein by reference for all purposes.

TECHNICAL FIELD

The present disclosure relates to caps and crowns for beverage bottles and other containers, and in particular, to a manual pull-to-open bottle cap having one or more of the cap body and opener assembly made of non-metal material.

BACKGROUND

A beverage bottle that opens manually with relative ease, without the use of a bottle opener, has been a long-felt need for beverage providers. Bottle caps must be tightly secured to the bottle opening to prevent spillage of the contents, loss of pressure (in the case of pressurized or carbonated beverages), keep oxygen out that can destroy the product inside, and to maintain the hygienic conditions of the contents. The tight seal may make it difficult to open a bottle by hand.

Caps, also referred to interchangeably as crowns, are secured to the bottle opening by crimping the skirt of the crown down over the open of the container in a series of concave arcs around the circumference of the opening. The arcs create sharp convex points between each concave arc. These arcs and points are often referred to by those skilled in art and knowledgeable in the business or industry as "angles" or "flutes."

The advent of the familiar twist-off bottle cap was a significant advance for manual bottle opening, but all too frequently one has to grip the cap so hard to twist the cap free that the points of the cap angles inflict pain on, or even cut, the hands or fingers. To protect the hands from injury, it is a common practice to wrap the bottle cap in the tail of a shirt or in a cloth before twisting the cap. Also common is the use of a bottle opener, but these can also be dangerous in that their use to pry off such a crown from a glass container can create glass chips or shards that may fall into the glass bottle or container and be consumed by a consumer, or result in the threads or other parts of the mouth of the container being chipped, which can cut the lip or tongue of the consumer.

Bottle caps adapted with pull rings and tabs, similar to those used for beverage cans, have been known in China and other territories of Asia. Such pull tab bottle caps, however, are notoriously difficult to open because they require the exertion of an uncomfortable amount of force to break the seal and then pull the tab back (tearing the metal) to remove the cap. Another pull-tab solution for bottle caps is known as the Maxi Cap® or the Maxi-P® such as is described U.S.

Pat. No. 4,768,667, issued Sep. 6, 1988, to Magnusson. These crowns provide a ring pull disposed along the side of the neck of the bottle as an extension of the crown and thus is problematic for use with standard skirt-crimping bottle capping machines. Indeed, a special capping machine is actually required to cap bottles with the Maxi Cap®, Maxi-P® or other side-ring pull crowns.

There is a need, therefore, for a bottle crown that is easy to open manually yet which may be tightly sealed around the bottle opening using industry standard bottle capping machines common in the industry.

SUMMARY

To overcome the deficiencies of the prior art, the disclosed principles provide for various embodiments of a crown for a bottle or other container opening which includes a top portion and an annular skirt that descends contiguously from the top portion. Many advantageous embodiments further comprise an opener assembly and an arrangement of frangible scoring lines on the crown allow for ease of opening the bottle or container. Specifically, the opener assembly, when operated by a user, frangibly engages the frangible scoring lines on the crown to cause the crown to break or tear along the score lines. Some embodiments further include one or more corrugated features in the top portion of the crown that provide material strengthening for a reduced gauge crown. Numerous embodiments and advantages associated with each such embodiment are discussed in further detail below.

BRIEF DESCRIPTION OF THE DRAWINGS

The detailed description that follows, by way of non-limiting examples of embodiments, makes reference to the noted drawings in which reference numerals represent the same parts throughout the several views of the drawings, and in which.

DETAILED DESCRIPTION

In view of the foregoing, through one or more various aspects, embodiments and/or specific features or sub-components, the present disclosure is thus intended to bring out one or more of the advantages that will be evident from the description. The present disclosure makes reference to one or more specific embodiments by way of illustration and example. It is understood, therefore, that the terminology, examples, drawings and embodiments are illustrative and are not intended to limit the scope of the disclosure. The terms "crown" and "cap" may be used interchangeably in the description that follows.

Figure 1:
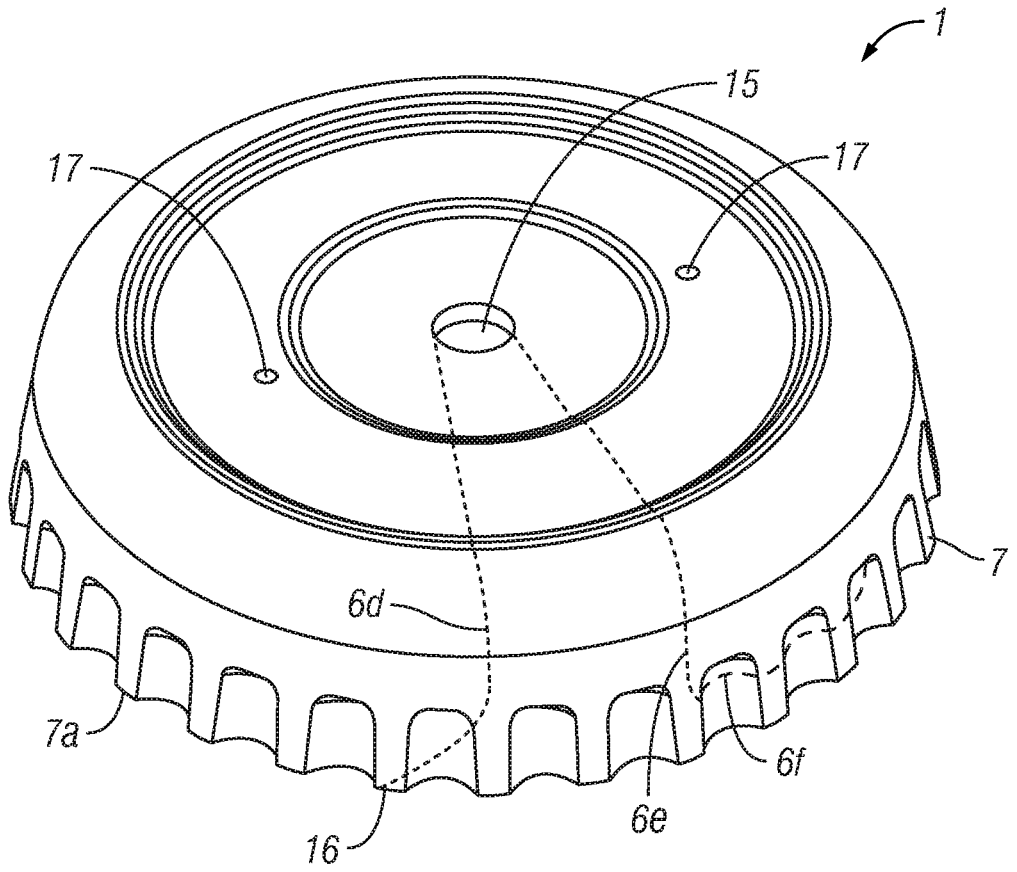
FIG. 1 illustrates an isometric top view of one embodiment of crown according to the disclosed principles shown without an opener assembly.

FIG. 1 illustrates an isometric top view of a crown 1 according to one embodiment of the present disclosure. However, for clarity of illustration, crown 1 is shown without a pull tab, ring pull, or rivet typically used to open a crown 1 according to the disclosed principles. Crown 1 may be formed with a plurality of angles (or "flutes") around the circumference of the crown, which are crimped to form a seal around a circular bottle opening, and which thereby results in a skirt for the crown 1. To facilitate removal of crown 1 from a sealed bottle, the surface of crown 1 may feature score lines 6 (sometimes referred to herein as "cut lines"), which typically diverge toward the bottom edge or rim 7*a* of the skirt from an attachment portion 15 for the opener assembly (not illustrated). FIG. 1 illustrates an angle of divergence of about 20 degrees; however, the present disclosure contemplates alternative degrees of divergence may be substituted, for example, or that the score lines may converge toward rim 7*a*. The score lines may even be substantially parallel. Convergence or divergence, and the selected degrees or angle separating the score lines, is a matter of design choice, as is the number of score lines, which may be as few as one. Accordingly, the present invention contemplates all and every permutation of score lines which may be selected for the engineering design of a particular crown.

In a preferred embodiment, one of the score lines 6*e* provides an S-curve or tail segment 6*f* that extends along the skirt 7, which descends contiguously from the top of crown 1. Skirt 7 is described in more detail further below in the disclosure. S-curve 6*f* may facilitate the removal of crown 1 from a container opening. In operation, a person tears from attachment portion 15 along score lines 6*d* and 6*e* using an opener assembly, described below. When the tear reaches S-curve 6*f*, the tearing force follows the S-curve away from score line 6*d* and impels the tear along score line 6*d* to terminus 16 which breaks open crown 1.

Continued tearing force along S-curve 6*f* pulls skirt 7 away from a container opening (not shown) and releases crown 1 from the container (not shown). S-curve 6*f* consists of a score line having an upper radial segment extending from the opener assembly to the skirt 7 along a radial axis, and a lower annular segment extending circumferentially along the skirt 7 in an annular direction and extending from a terminus of the upper radial segment, the lower annular segment defined in a second horizontal plane equidistant to the first horizontal plane associated with the lower edge of the skirt 7.

Alternative embodiments may feature a straight left score line 6*d* extending from the center of the top of the crown to the annular edge 7*a* of the crown. To reduce the risk of generating sharp corners (based on the angle of the score line across the annular edge) from opening a crown of the present disclosure, such cut or score lines create a gentle curve terminating along the edge 16 of the crown after the pull tab and ring pull have been torn away. Different degrees of curvature may be selected to obtain the desired performance characteristics according to engineering or design choice. A relatively flat score line, for example, yields a smooth edge but might require more force to tear, whereas a relatively more curved score line, for example, may require less force to tear but yields a differently shaped edge from that of straight score line. Moreover, any desirable angle between the two score lines along the top portion of the crown may be employed, and in advantageous embodiments the angle between the two score lines is about 12 degrees. As illustrated in FIG. 1, the right-hand score line arcs to the right and terminates before the edge of the crown so that the crown is preserved as a unitary piece after the crown has been removed from the bottle or whatever container it was sealing. Also, although score lines 6*d* and 6*e* are illustrated as formed on the exterior of the crown 1, these score lines 6*d* and 6*e* may be formed from the underside of the crown 1, or on both the top and inside of the crown 1, as desired.

Another feature illustrated in FIG. 1 is one or more spoilage indicators 17 such as dimples depressed in crown 1 and positioned so as not to be obscured by the opener ring pull apparatus of the present disclosure. For containers that are vacuum sealed, spoilage indicators 17 pop up in the event that the pressure seal is lost.

Figure 2A:
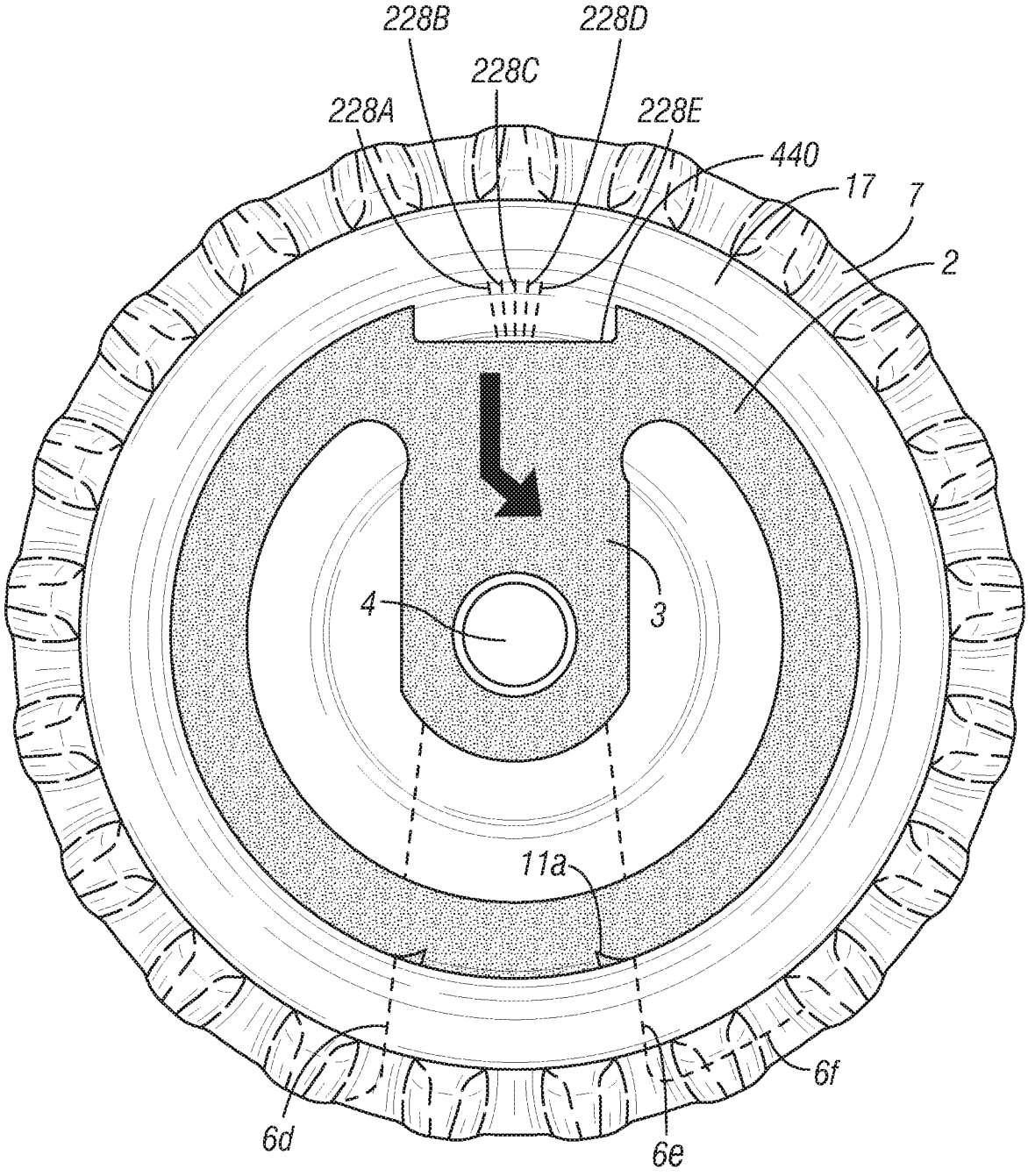
FIG. 2A-2C illustrate alternative views of a crown according to one embodiment of the present disclosure having a non-metal opener assembly.

FIG. 2A illustrates a top view of the crown 1 of FIG. 1, but now having an opener assembly according to one embodiment of the present disclosure. The opener assembly in this embodiment comprises a ring pull (or, alternatively, pull ring) 2 and pull tab 3 connected to the ring pull 2. In addition, the pull tab 3 is shown attached to the attachment portion of the crown 1 using a rivet. In this embodiment, the ring pull 2 and pull tab 3 of the opener assembly are constructed from non-metal material, in accordance with the principles disclosed herein. Moreover, such non-metal opener assembly is attached to the crown body at an attachment portion using a metal rivet 4. Specifically, such a non-metal opener assembly in this embodiment may be attached to the crown body at the attachment portion using one of the exemplary rivets or other techniques discussed in detail below. In other embodiments, the crown, ring pull, pull tab, and rivet may each, all, or any combination thereof be manufactured using metals, non-metals, or composites as described below.

In FIG. 2A, the score lines collectively designated 228, which are positioned in a location designated as the "rear" of the crown 1, that is, located more or less on the opposite side on the top portion of crown 1 from primary score lines 6*d* and 6*e*, which are located at the "front" of crown 1. FIG. 2A illustrates alternative embodiments of a crown body, such as the crown body illustrated in FIG. 1, wherein each alternative embodiment provides one or more of rear score lines 228A, 228B, 228C, 228D, or 228E, depending on engineering or design choice. Each of the rear score lines 228A, 228B, 228C, 228D, or 228E traverses the top portion of crown 1 at a different angle one from the other and from the opener assembly location. In alternative embodiments, the one or more rear score lines 228A, 228B, 228C, 228D, or 228E may traverse the underside (or inside) of crown 1. In yet other embodiments, the one or more rear score lines 228A, 228B, 228C, 228D, or 228E may be formed into both the top and underside of crown 1.

In one embodiment, the alignment of the one or more rear score lines 228A, 228B, 228C, 228D, or 228E may be formed radially with respect to the center of the crown 1, as illustrated. In other embodiments, the alignment of the one or more rear score lines 228A, 228B, 228C, 228D, or 228E may be in another shape or alignment without regard to the center of the crown 1. The inclusion of one or more of the rear score lines 228A, 228B, 228C, 228D, or 228E provides structural advantages to a crown constructed in accordance with the disclosed principles. For example, the one or more rear score lines 228A, 228B, 228C, 228D, or 228E are configured to crack or otherwise break when a force is applied on them. More specifically, the one or more rear score lines 228A, 228B, 228C, 228D, or 228E are advantageously located and arranged to be contacted by a rear portion of the ring pull 2 when the opener assembly is employed to open and remove the crown 1 from a container. Engaging portions (illustrated as points or corners at the rear of the ring pull 2 proximate to the one or more rear score lines 228A, 228B, 228C, 228D, or 228E) may be configured to push down on the one or more rear score lines 228A, 228B, 228C, 228D, or 228E as the front of the ring pull (there are comprising divot 11*a*) is raised by a user. In such embodiments, the engaging portions apply a force in the area of the one or more rear score lines 228A, 228B, 228C, 228D, or 228E causing them to break. Not only does this force applied to the one or more rear score lines 228A, 228B, 228C, 228D, or 228E facilitate opening and removal of the crown 1, but also provides the initial escape of the pressurized gas held in the container by the crown 1 through those one or more rear score lines.

Another feature of the embodiment of FIG. 2A relates to ring pull 2. Specifically, a finger nail divot 11*a* is depicted in which the divot 11*a* is formed in the underside 2*a* of ring pull 2 while the top 2*b* of ring pull 2 at the location of divot 11*a* remains co-planar with the entire top surface 2*b* of ring pull 2. Divot 11*a* may provide a thinner portion of the ring pull 2 that facilitates lifting ring pull 2 with a finger nail to initiate the opening process. The gap provided by this thinner portion of ring pull 2 may be seen in the front view of the crown 1 provided in FIG. 45. Advantageously, the finger nail divot 11*a* not only facilitates engaging of the ring pull 2 by a user, but also can provide a visual indicator of the portion of the ring pull 2 to be used in operating the opener assembly of the crown 1. The opener assembly may also include a visual indicator for how to operate the opener assembly, which in the illustrated embodiments comprises a bold arrow imprinted or embossed on the top of the ring pull 2 and/or pull tab 3 of the opener assembly. In the illustrated embodiments, the arrow would indicate to the user to pull back on the ring pull 2, once raised upward to "crack" the crown along the appropriate score lines, and then slightly to the right. The crown 1 would then tear along score lines 6*d* and 6*e* in the manner described above.

In this illustrated embodiment, the divot 11*a* is provided by a recessed portion of the ring pull 2 (with respect to the diameter of the ring pull 2), where the recessed portion comprises a curvature substantially similar to the curvature of the overall ring pull 2. However, in other embodiments, the recessed portion of the divot 11*a* may comprise a curvature opposite (i.e., inward) to the curvature of the remained of the ring pull 2. And in some embodiments, the recess comprising the divot 11*a* may be a smooth, inward curvature with respect to the remainder of the ring pull 2, rather than the "stepped" recess illustrated in FIG. 44. Also, in other embodiments, the divot 11 is not a recess of the ring pull 2, and may instead comprise a protrusion extending beyond the diameter of the ring pull 2. In such embodiment, the protruding portion of the ring pull 2 comprising the finger nail divot 11*a* may again comprise a thinner portion of the ring pull. Still further, in other embodiments, the divot 11*a* may not protrude beyond or recess within the remainder of the ring pull 2, and instead maintains the same diameter as the remainder of the ring pull 2. In such embodiment, the divot 11*a* would be provided again as a thinner portion of the ring pull 2 to receive the finger nail of the user operating the opener assembly.

Figure 2B:
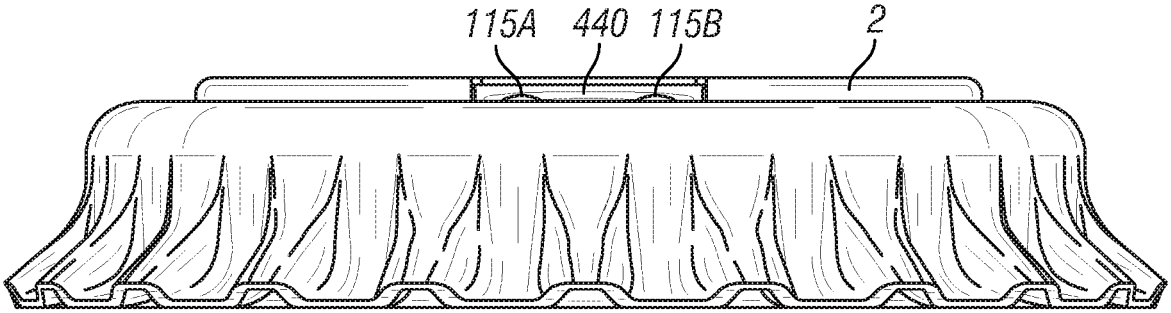

FIG. 2B illustrates a rear view of crown 1 of FIG. 2A showing the "back" or "rear" of crown 1. Dimples 115A/115B are formed on the top 17 of crown 1 and are located under ring pull 2 proximate recess 440. Recess 440 of ring pull 2 is formed in the horizontal plane of ring pull 2 and facilitates the vertical rotational motion of ring pull 2 over dimples 115A/115B during the opening process. More specifically, while the ring pull 2 does not contact the dimples 115A/115B because of recess 440 while the opener assembly is not operated, this changes as a user operates the opener assembly.

As a user pulls the front of the ring pull 2 upwards from the top 17 of the crown 1 (e.g., by engage his finger nail in divot 11*a*), the top of the recess 440 eventually engages dimples 115A/115B. As the user continues to raise the front of the ring pull 2 upwards from the crown 1, the contact of the top of the recess on the dimples 115A/115B creates a fulcrum for the ring pull 2. In particular, this fulcrum provided by the dimples 115A/115B allows the engaging portions at the rear of the ring pull 2 (discussed above) to forcefully press downward into the top 17 of the crown 1 as the user continues to raise the front of the ring pull 2 upwards. Thus, the precise location of the dimples 115A/115B provides this fulcrum for the ring pull 2, and thereby advantageously reduces the opening force required by the user operating the opener assembly. Because of the reduced opening force required by the fulcrum, the spacing of the recess 440 from the dimples 115A/115B while the opener assembly remains in the unused position can reduce the chance of unintentional cracking of the crown 1. However, such recess 440 spacing of the ring pull 2 from the dimples 115A/115B is not required.

Figure 2C:
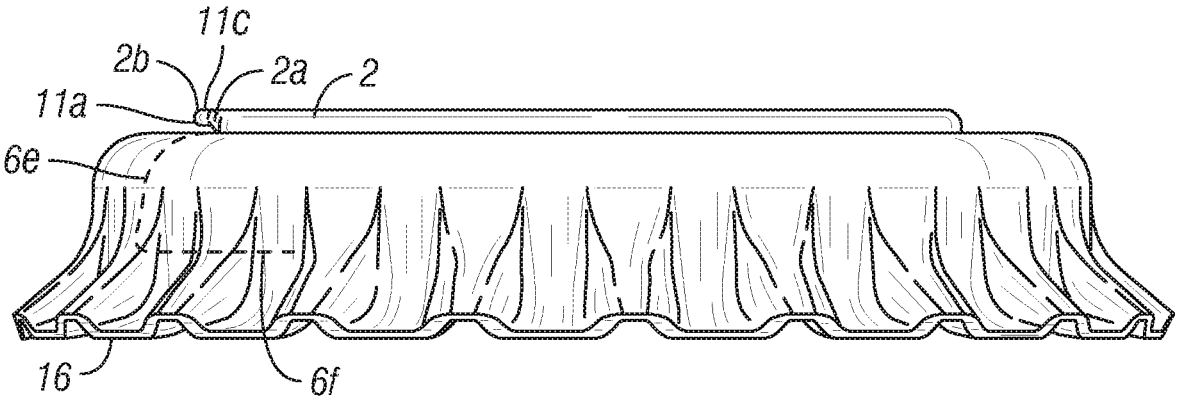
Figure 3A:
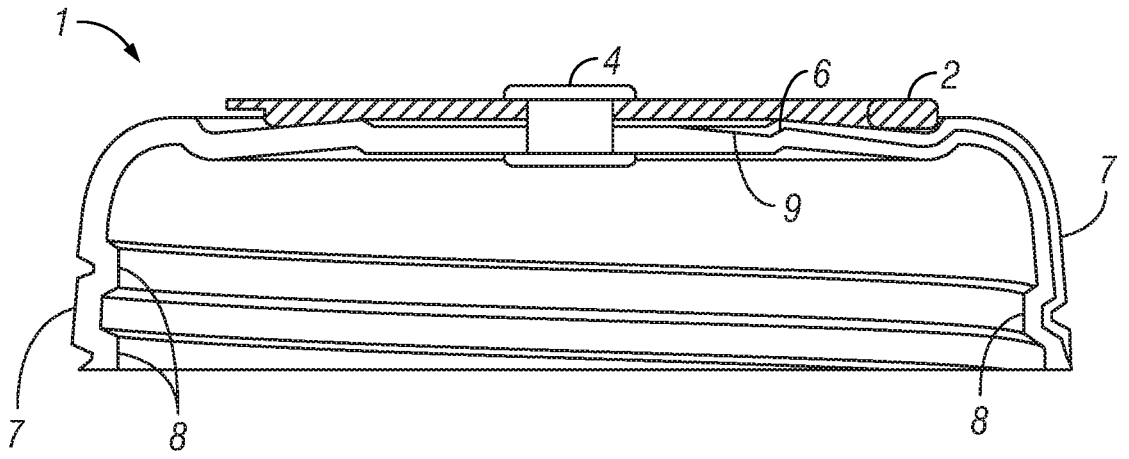
FIG. 3A illustrates a side cross-section view of an exemplary embodiment of a crown according to the present disclosure having a threaded skirt.
Figure 46:
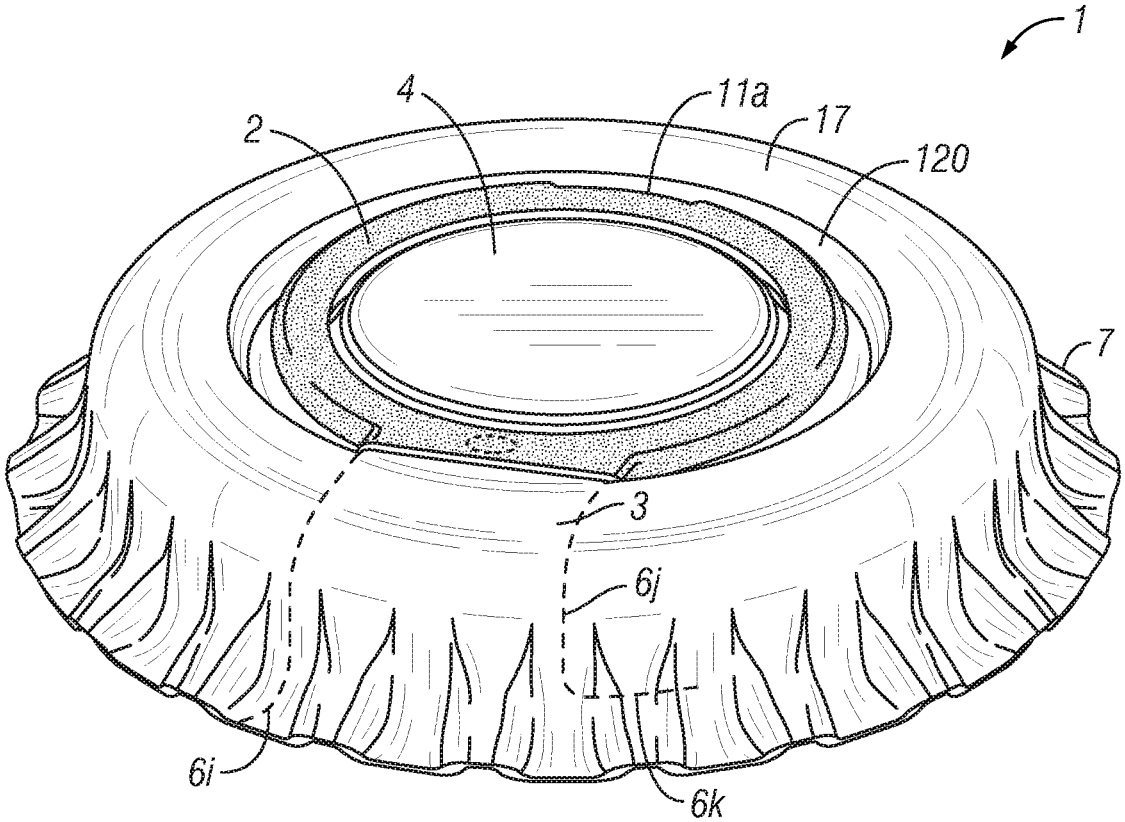
FIG. 46 illustrates an isometric top view of one embodiment of a container crown with an integrated non-metal opener assembly.

FIG. 2C illustrates a side view of the crown of FIG. 46 rotated horizontally 90°. In this view, it is more readily apparent that in some embodiments, as discussed in detail above, divot 11*a* may create an overhang or upper lip 11*c* in ring pull 2 by excavating a portion of underside 2*a* of ring pull 2 to accommodate a finger nail while the top portion 2*b* of ring pull 2 remains co-planar with the entire top surface of ring pull 2.

Figure 3:
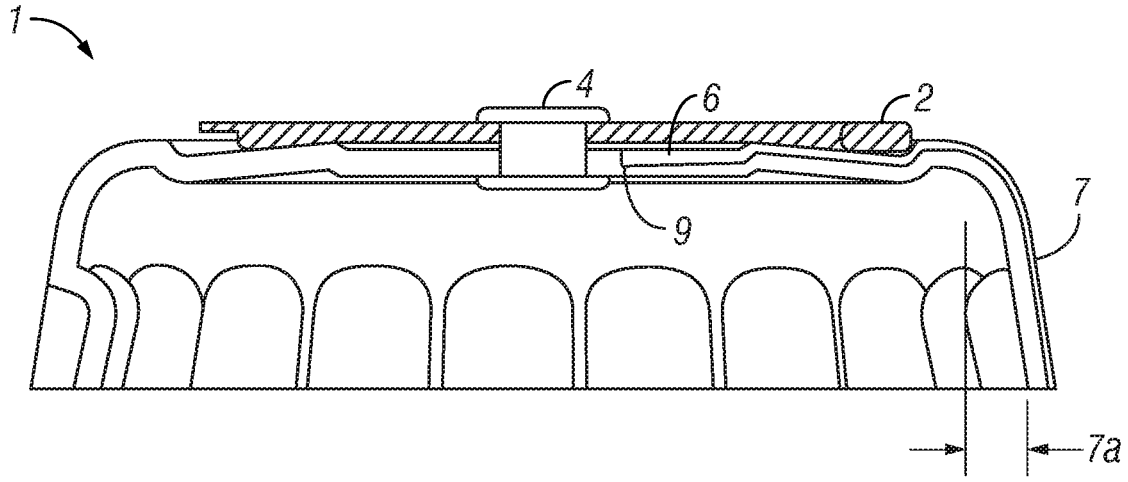
FIG. 3 illustrates a side cross-section view of an exemplary embodiment of a crown according to the present disclosure.

FIG. 3 illustrates a side view vertical cross-section of a specific exemplary embodiment of a bottle crown 1 of the present disclosure. Ring pull 2, pull tab 3 and rivet 4 in combination may be referred to herein from time to time as an opener assembly. Interior threads 8 may be provided for selectively removing crown 1 from a bottle by manually twisting instead of using the opener assembly mechanism. Score line 6 tapers downward from angle 7 at the rim of crown 1 toward the approximate center of crown 1 to provide a tapered tearing groove. For example, the depth of the tapered groove may graduate from a depth in the range of about 0.03 to 0.02 mm near the rim of crown 1 to a depth in the range of about 0.10 to 0.08 mm by rivet 4 near the center of crown 1.

Figure 4:
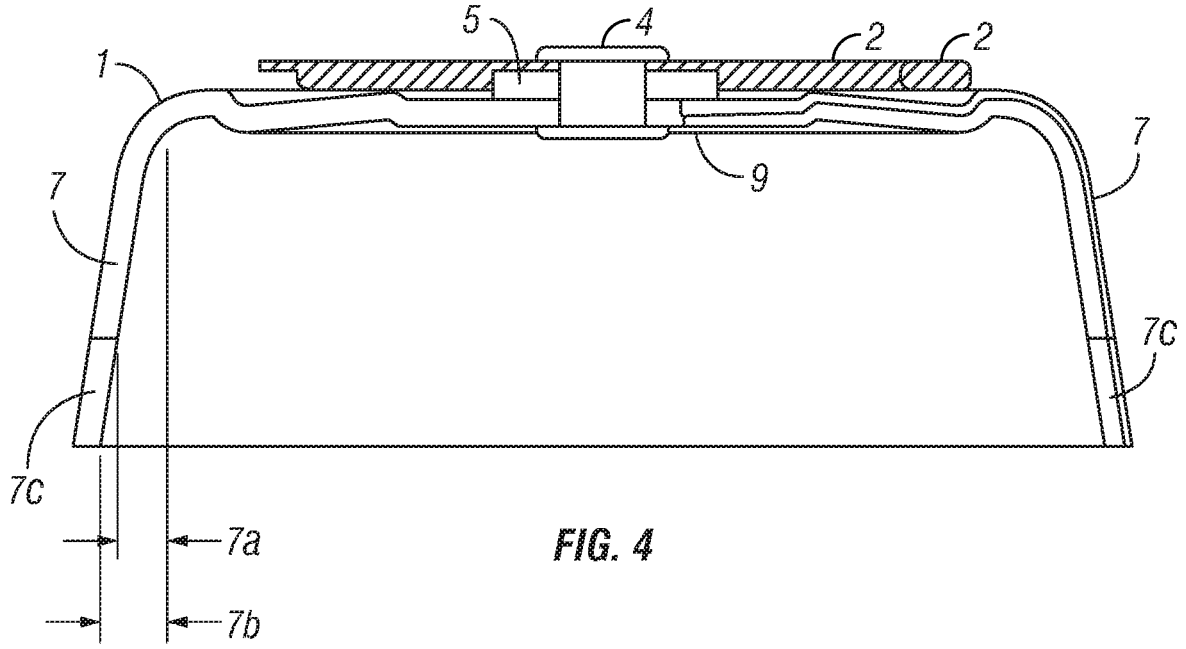
FIG. 4 illustrates a side view cross-section of an alternative exemplary embodiment of a crown according to the present disclosure having an elongated skirt.

FIG. 4 illustrates a side view vertical cross-section of an alternative specific exemplary embodiment of a bottle cap of the present disclosure. Alternatively, or additionally, to threads 8, crown 1 may be formed, as shown in FIG. 4, having an elongated rim 7*b* relative to rim 7*a* of FIG. 2. Securing a standard crown over a threaded bottle opening may be problematic because the threads add surface area to the exterior of the bottle opening. A standard crown may not be big enough to extend over the extra surface area of a threaded bottle. Elongated rim 7*b* may be an advantageous alternative embodiment that allows crown 1 to be crimped over a threaded bottle opening to provide elongated angle 7*c*. A further advantage is that a crown 1 of FIG. 4 may be twisted off of a threaded bottle without the crown 1 itself being interiorly threaded such as depicted in FIG. 3. Lever 5 is provided for leverage and additional shearing force to rend open the tinplate material of crown 1, whether it be metal, such as tinplate or similar material, or resin or other plastic material.

Crown 1 may be composed of metals, non-metals, or hybrid/combinations thereof, such as a plastic resin infused with metallic or otherwise magnetic particles. Metals may include aluminum alloys and alloy steels, such as steel tinplate. For all-metal embodiments, a tinplate or even tin-free steel (TFS) material which demonstrates an approximate hardness of T4 on the Rockwell 30T Hardness Scale is preferred (see Item 3 in Table 1 below), although embodiments of T3 and T5 are advantageous for particular products. The preferred soft tinplate material requires less force to open and tear with the opener assembly of the present crown while still providing sufficient sealing of the container contents. For the purposes of this disclosure, tinplate refers the any material, including tin or tin alloys, from which a crown may be fabricated and does not necessarily mean that the crown is made from tin or a tin alloy.

As an alternative to crowns according to the disclosed principles being constructed entirely of metal, such as the exemplary tinplate material discussed above, crowns designed in accordance with the disclosed principles may also be constructed entirely of non-metal materials, or may be constructed as "hybrid" crowns where a portion of such crowns is metal and another portion of the crown is made from non-metal materials. Such hybrid crowns may be manufactured with the ring pulls of the opener assemblies made of non-metal materials. For example, an attachment portion of a non-metal ring pull may be riveted onto a metal pull tab of an opener assembly. Alternatively, the attachment portion of the ring pull may be integrally formed around a portion of the metal pull tab, perhaps with the pull tab having barbs or other means for maintaining attachment to the integrally formed attachment portion of the ring pull, as discussed in detail below. Of course, other embodiments for hybrid crowns may also be manufactured in accordance with the disclosed principles, as discussed in further detail below.

For non-metal and hybrid crowns, advantageous plastics may be selected for portions of the crowns. For example, thermoformed plastics or fluoropolymer composites may be employed. Exemplary plastics or composites may include urethanes, nylons, rayon, acrylics, polystyrene, polyether imide, acetal, polyolefins such as polyethylene and polypropylene, modified polyolefin, modified ethylene copolymer resins, ionomers of ethylene acid copolymer resins, polyesters, acrylonitrile-butadiene-styrene (ABS), polycarbonate, and other plastics, either now existing or later developed, as well as compounds of any two of more of plastics or other non-metals, may be employed to form part or all of a crown manufactured in accordance with the disclosed principles. Moreover, such plastics or plastic compounds may be reinforced with other materials, such as carbon fiber, fiberglass, Kevlar® or other strengthening material.

Working with plastic materials is typically different than metal materials when manipulating components with bottling automation equipment, which often relies on the magnetic properties of steel caps in order to position caps over bottles before sealing. However, the disclosed principles can overcome this challenge by manufacturing a crown using magnetic resins, which are thermoplastic resins that have been mixed or infused with metallic particles, such as iron filings or other materials that have magnetic properties. While the resin base replaces one or more of the typically metal-based crown components, the added metals provide magnetic properties to the otherwise resin or plastic crown component(s). It should be noted that any one or all of the components of an openable crown in accordance with the disclosed principles may be made from such non-metal materials, whether infused with magnetic properties or not. As such, one or more of the crown body, the ring pull of the opener assembly, the pull tab of the opener assembly, or the rivet or other attachment device used to attach the opener assembly to the top of the crown body, may be made of such exemplary non-metal materials as described in further detail below. In crowns of the disclosed principles employing non-metal components that are not infused or otherwise mixed with magnetic materials such as metallic particles, vacuum-based manufacturing equipment can be employed in place of the typical equipment that employs magnetics to manipulate the crowns or crown components. Accordingly, the disclosed principles provide bottling and manufacturing solutions for both fully non-metal or hybrid crowns constructed in accordance with the present disclosure.

Manufacturing fully non-metal or hybrid crowns as disclosed herein can provide several advantages over all-metal crowns of the same or similar design. For example, non-metal materials, such as resin plastics, are typically less expensive that metals, which reduces manufacturing costs. Also, such non-metal materials typically weigh less than metals, and thus weight of the crowns is reduced, which saves costs where weight is a factor such as in shipping packages of crowns to a bottling facility. Furthermore, a non-metal ring pull may provide more comfort to a user pulling on the ring pull to tear and remove such a crown. Accordingly, any crown disclosed herein may be manufactured from either all non-metal materials or from a combination of some metal components and non-metal components.

Figure 5:
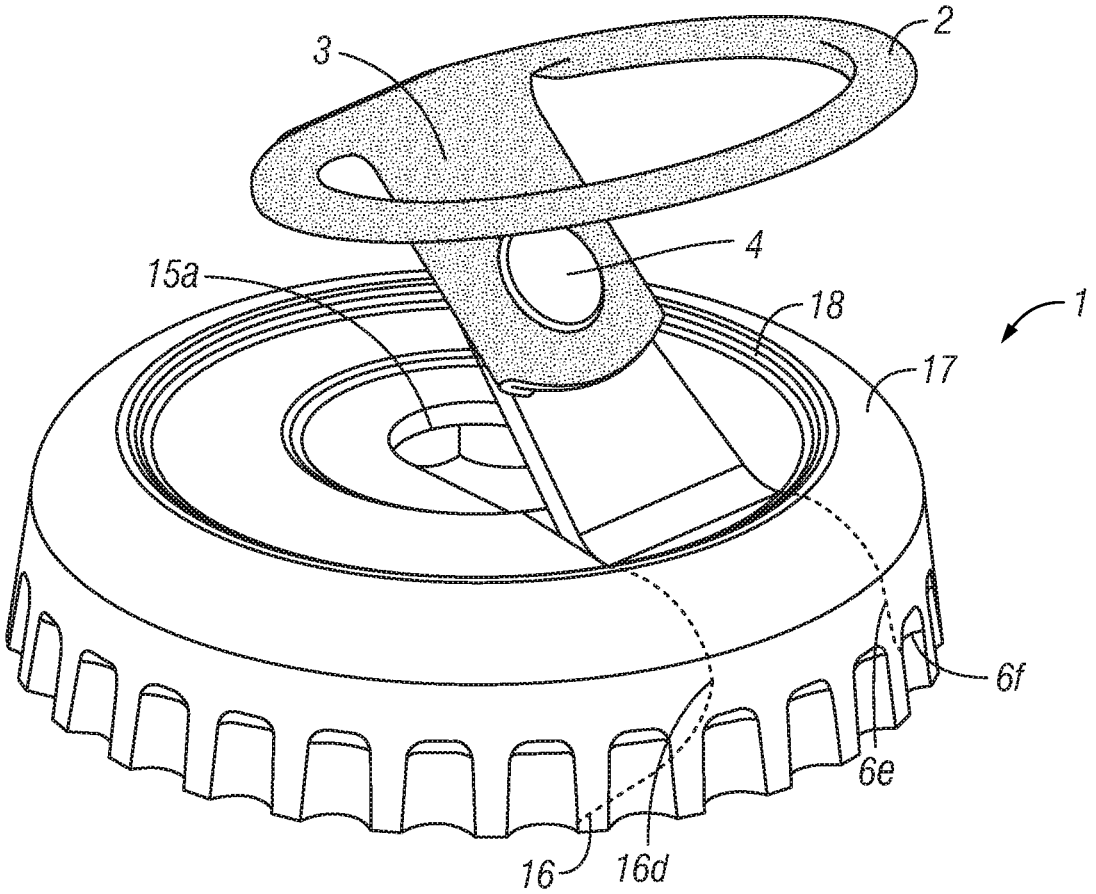
FIG. 5 shows an isometric top view of an alternative embodiment of the crown of FIG. 2.

FIG. 5 illustrates an isometric top view of an alternative embodiment of a crown 1 in accordance with the disclosed principles, and again including a non-metal opener assembly comprised of a non-metal ring pull 2 and non-metal pull tab 3. The crown 1 of FIG. 5 is shown popped or cracked open in the center 15*a* with the non-metal opener assembly. Non-metal pull tab 3 is connected to crown 1 with rivet 4 and is in position to tear along score lines 6*d* and 6*e* with application of manual force. One or more circular depressions 18 create space in the top 17 of crown 1 to seat ring pull 2 and the rest of the opener apparatus.

As described for other embodiments, crown 1 may be manufactured using metals, non-metals, or composites. Likewise, ring pull 2 may be composed of metal, non-metal, or composite materials. Using metal materials for both the crown body 1 and the ring pull 2 may simplify manufacturing processes. However, manufacturing the ring pull 2 out of plastic may reduce the overall weight of the ring pull tab crown while also allowing for more ergonomic forms that increase comfort and grip during opening. In certain embodiments, crown 1 may be formed with metallic materials, such as steel tinplate, and fastened to a plastic ring pull 2 using a rivet 4. Various means for joining the ring pull 2 to crown 1 are described in further detail below. However, in this illustrated embodiment of a crown in accordance with the disclosed principles, the non-metal opener assembly (comprised of the non-metal ring pull 2 and non-metal pull tab 3) is attached to a metal crown body using a metal rivet 4. Such a non-metal opener assembly may be attached to the crown body at the attachment portion using one of the exemplary rivets or other techniques discussed in detail below.

Figure 6:
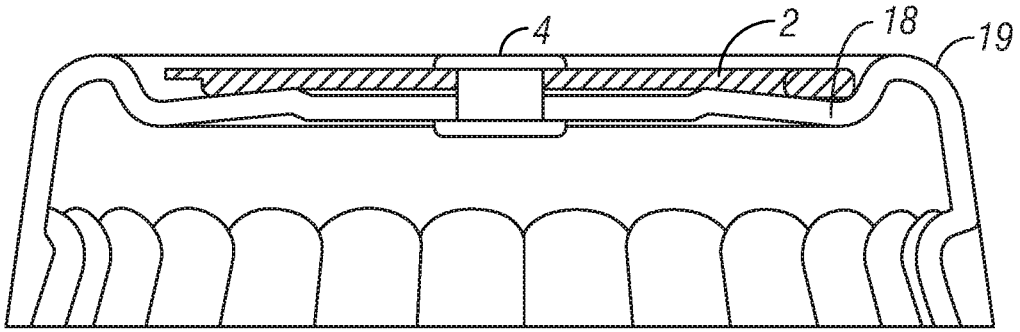
FIG. 6 illustrates a side cross-section of one embodiment of the crown of FIG. 5 having an opener assembly received completely within a recess in the top of the crown.

FIG. 6 illustrates a side cross-sectional view of an alternative embodiment of a crown 1 of FIG. 5. Skirt 7 descends from shoulder 19 which is contiguous with top 17. Seat 18 is of sufficient depth that non-metal ring pull 2 and non-metal pull tab 3 are substantially flush with the top 17 of crown 1. Such an embodiment advantageously is suitable for use in conventional bottle capping machines without having to re-tool or refit the machine. A further advantage of seat 18 is that seat 18 forms a corrugated perimeter around the seat and corrugation is well known to strengthen flat sheets against bending in directions substantially perpendicular to the direction of corrugation. Seat 18, therefore, provides the additional advantage of strengthening crown 1. A further advantage of a strengthened crown 1 as provided by seat 18 is that its thickness may be reduced to a lower gauge (thinner) crown material than would be utilized in a standard crown, thus lowering the costs of manufacturing materials. Although FIG. 6 illustrates an embodiment of the present crown 1 formed to have 27 angles in the skirt around the crown, it is understood by those skilled in art that the advantages of seat 18 do not depend on the presence or number of angles.

Figure 7:
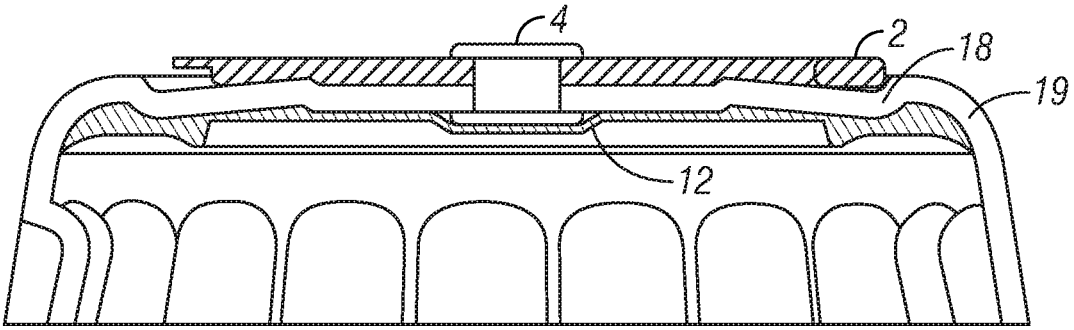
FIG. 7 illustrates a side cross-section view of an alternative embodiment of the crown of FIG. 5 having an opener assembly received only partially within a recess in the top of the crown.

FIG. 7 illustrates a side cross-sectional view of an alternative embodiment of a crown 1 of FIG. 6. Seat 18 is shallower than as shown in FIG. 6, so that ring pull 2 is seated slightly or partially above the shoulder 19 of crown 1. Such an embodiment may provide the advantage of having ring pull 2 easily accessible for manual opening. Depending on the acceptable tolerances, such an embodiment may also be suitable for use with a standard bottle capping machine. FIG. 7 also is an alternative embodiment in which liner 12 is mounted on the under surface of crown 1 with a suitable adhesive and is disposed so as to cover the bottom of rivet 4.

The crown, ring pull 2, pull tab 3, and rivet 4 shown in FIG. 15 may each be manufactured using metals, non-metals, or composites as previously described.

Figure 8:
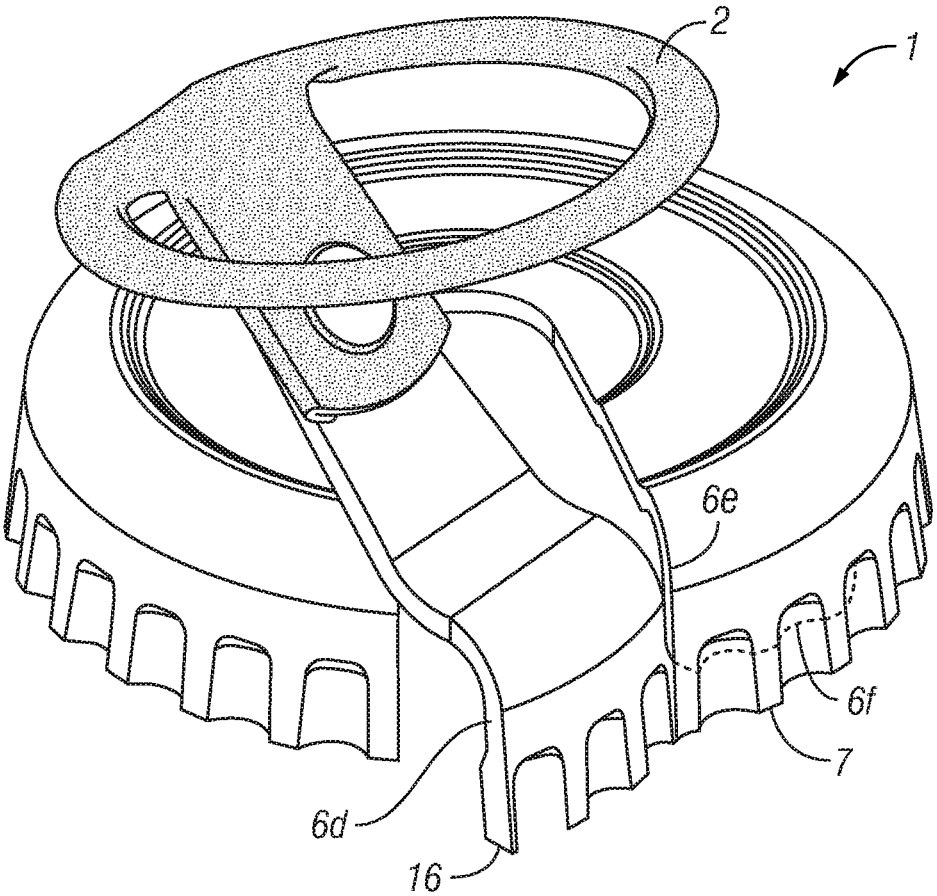
FIG. 8 illustrates an isometric top view of an alternative embodiment of the crown of FIG. 5 where the crown has been cracked open.

FIG. 8 is an isometric top view of an alternative embodiment of a crown 1 of FIG. 5. Here, crown 1 is broken open at terminus 16 of score line 6*d*, which leaves a straight or pointed terminus rather that the curved edge of the opened crown shown in FIG. 5. Further tearing with ring pull 2 along S-curve 6*f* will liberate a container (not shown) from angles 7 and detach crown 1 from the container. As with the embodiment of the crown in FIG. 5, this embodiment of a crown in accordance with the disclosed principles includes a non-metal opener assembly comprised of a non-metal ring pull 2 and non-metal pull tab 3 attached to a metal crown body using a metal rivet 4. Such a non-metal opener assembly may be attached to the crown body at the attachment portion using one of the exemplary rivets or other techniques discussed in detail below. However, also as with the crown of FIG. 5, this embodiment of a crown may have the crown 1, ring pull 2, pull tab, and/or rivet each or all manufactured using any one or a combination of metals, non-metals, or composites as previously described.

Figure 9:
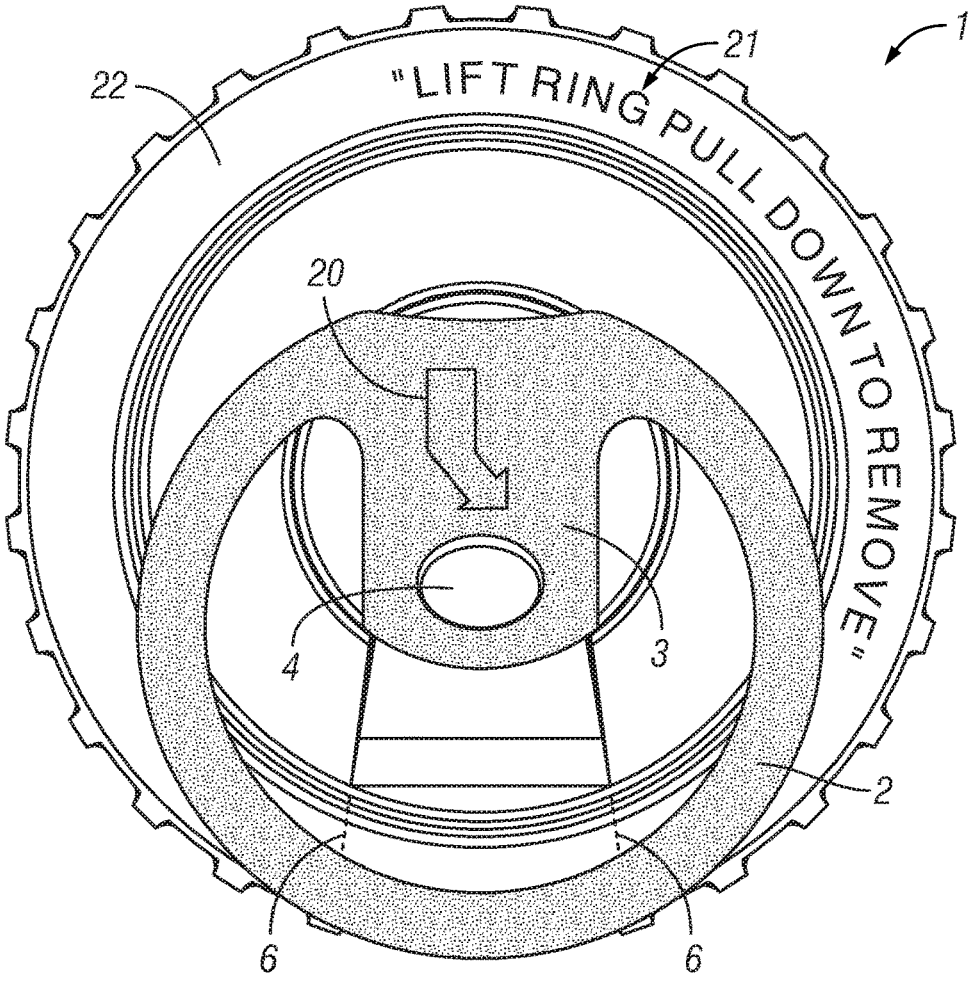
FIG. 9 illustrates a top view of the embodiment of the crown of FIG. 8 with the crown only partially cracked open.

FIG. 9 is a top view of an alternative embodiment of the crown 1 of FIG. 8 where the opening of the crown 1 using the non-metal opener assembly is only partial completed. This embodiment differs from the embodiment of FIG. 8 in that it additionally provides printed matter such as a bent arrow 20 printed or embossed on non-metal pull tab 3 to indicate generally how a person should pull on ring pull 2 in order to employ the score lines 6 for easy opening of the crown 1. Further instructions may be provided with printed instructions 21, which may read, as in this illustrated example: "LIFT RING PULL DOWN TO REMOVE". Additionally a caution warning, advertisement, or any other desired information may be printed in the remaining clear area 22 on crown 1. The crown, ring pull 2, pull tab 3, and rivet shown in FIG. 9 may each or all be manufactured using metals, non-metals, or composites as previously described. In addition, in embodiments where the ring pull 2 is non-metal and the pull tab is metal, the non-metal ring pull 2 may be connected to the metal pull tab 3 using one of the exemplary techniques discussed in detail below. In embodiment where both the ring pull 2 and pull tab 3 both non-metal, this non-metal opener assembly may be attached to the crown body at the attachment portion using one of the exemplary techniques discussed in detail below.

Figure 10A:
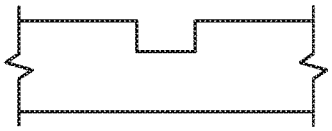
FIGS. 10A-10C illustrate side cross-section views of alternative embodiments of a score line of a frangible scoring arrangement in accordance with the present disclosure.
Figure 10B:
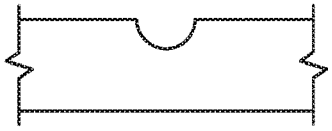
Figure 10C:
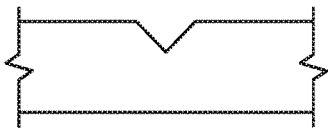

FIG. 10A illustrates a side cross-section view of an embodiment of a score line of the present disclosure. Such score lines may formed all-metal crown embodiments, non-metal crown embodiments, or hybrid crown embodiments. To form a tearing groove, score line 6 may be machined to have any one or more of a variety of cross-sectional profiles, depending on the engineering choice of each manufacturer. For instance, FIG. 10A illustrates a square or rectangular cross-section profile. When reference is made herein to a tearing groove, score line or scoring arrangement, these terms are various ways to describe the frangible portion of the crown of the present disclosure that is opened by the opener assembly and torn to release the crown from a container. FIG. 10B illustrates a side cross-section view of an alternative embodiment of a score line of FIG. 10A. Here, a curved cross-section profile for score line 16 is illustrated. FIG. 10C illustrates a side cross-section view of an alternative embodiment of a score line of FIG. 10A. A V-shaped cross-section profile for score line 6 is illustrated.

Figure 10D:
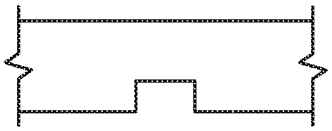
FIGS. 10D-10F illustrate alternative embodiments of the score lines in FIGS. 10A-10C, respectively, wherein the respective score lines are located on the underside of a crown of the present disclosure.
Figure 10E:
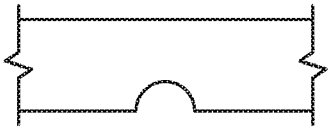
Figure 10F:
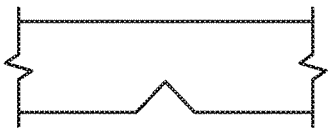

FIGS. 10D-10F, described here together, correspond to the side view cross-sections of the score lines of FIGS. 10A-10C, respectively, with the difference being that, while the score line in FIGS. 180-10C is inscribed along the top surface of crown 1, in FIGS. 10D-10F the score lines are inscribed along the surface of the underside of crown 1. An advantage of the embodiments of FIGS. 10D-10F having a score line inscribed on the undersurface is that the score line is invisible to a user, which enhances the aesthetic appearance of the crown. Additional alternative embodiments provide score lines inscribe on both the top surface 17, as shown in FIGS. 10A-10C, and the underside as shown in FIGS. 10D-10F. The crown and rivet shown in FIG. 21 may each be manufactured using metals, non-metals, or composites as previously described.

Figure 11:
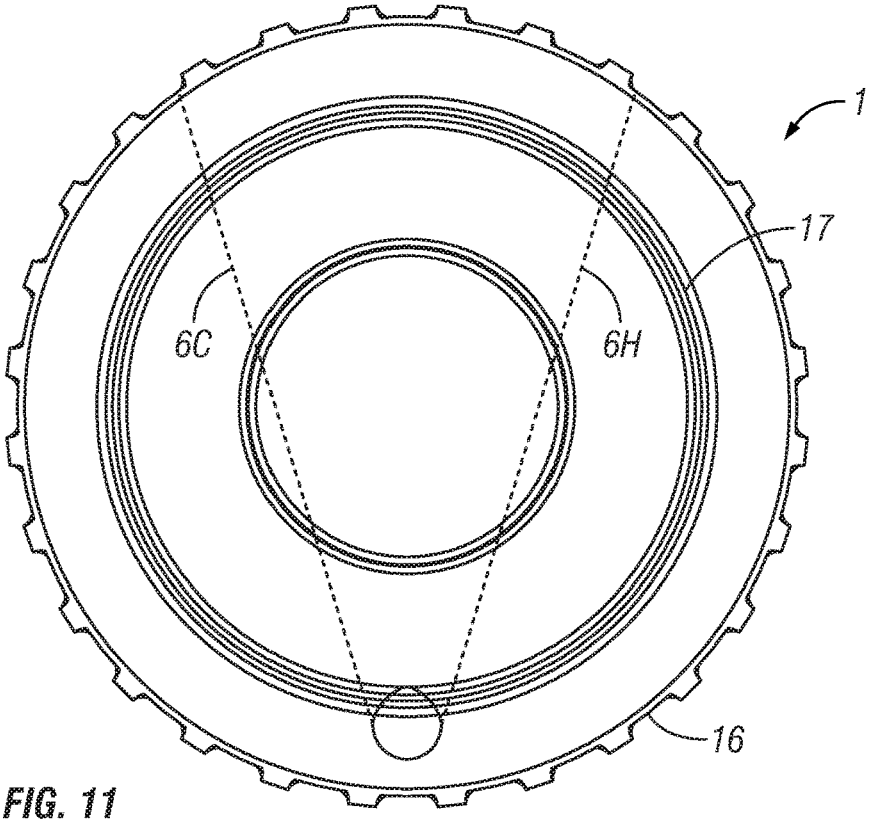
FIG. 11 shows a top view of an alternative embodiment of a crown of the present disclosure illustrating an off-center location for the attachment portion for the pull tab of an opener assembly.

FIG. 11 illustrates a top view schematic representation of an alternative embodiment of a crown 1 of the present disclosure illustrating an off-center location for the attachment portion for the pull tab of the opener assembly. Embodiments of the present crown 1 having an off-center location of the attachment portion for the rivet 4 and the rest of the opener assembly are advantageous, for example, for non-beverage containers such as containers for canned goods like soup or beans, which familiarly have opener assemblies close to the edge to the container. Tear lines 6G and 6H traverse across top 17 of the crown 1 in a substantially rectilinear fashion to edge 16. Accordingly, the location of rivet hole or rivet 4 or of the crown 1 opener assembly on the top of crown 1 is largely a matter of engineering design choice. A crown of the off-center rivet embodiments is opened as described herein above of the other embodiments.

Figure 12:
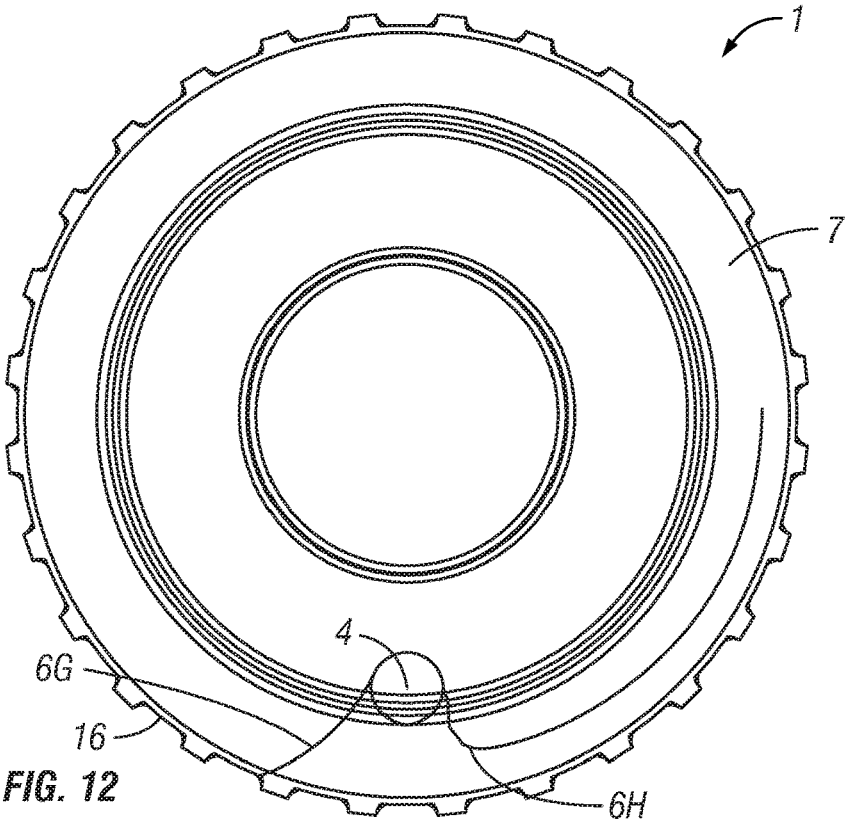
FIG. 12 illustrates a top view of an alternative embodiment of a crown of the present disclosure having an off-center location for the attachment portion for the pull tab of an opener assembly with an alternative score line.

FIG. 12 illustrates a top view schematic representation of an alternative embodiment of the crown 1 of FIG. 11 with an alternative score line arrangement. Score lines 6G and 6H in the embodiment of FIG. 22 descend to skirt 7 directly from rivet 4, in contrast to FIG. 11, but similar to lines 6 in the previously described embodiments. Score line 6G descends to edge 16, whereas line 6H trails in the opposite direction maintaining for its length a substantially equal distance from edge 16 and top 7. Score line 6H consist of a scoring line having an upper radial segment extending from the opener assembly to skirt 7 along a radial axis and a lower annular segment extending circumferentially along skirt 7 in an annular direction and extending from a terminus of the upper radial segment to an end point substantially spaced from the bottom annular edge 16 of the skirt 7. Preferably the lower annular segment defines a longer horizontal plane than that defined in the S-curve of scoring line 6*f*, described above, extending, for example approximately one quarter of the circumference of skirt 7. In accordance with the disclosed principles, the crown and/or opener assembly shown in FIGS. 11 and 12 may each be manufactured using metals, non-metals, or composites as previously described.

Figure 13:
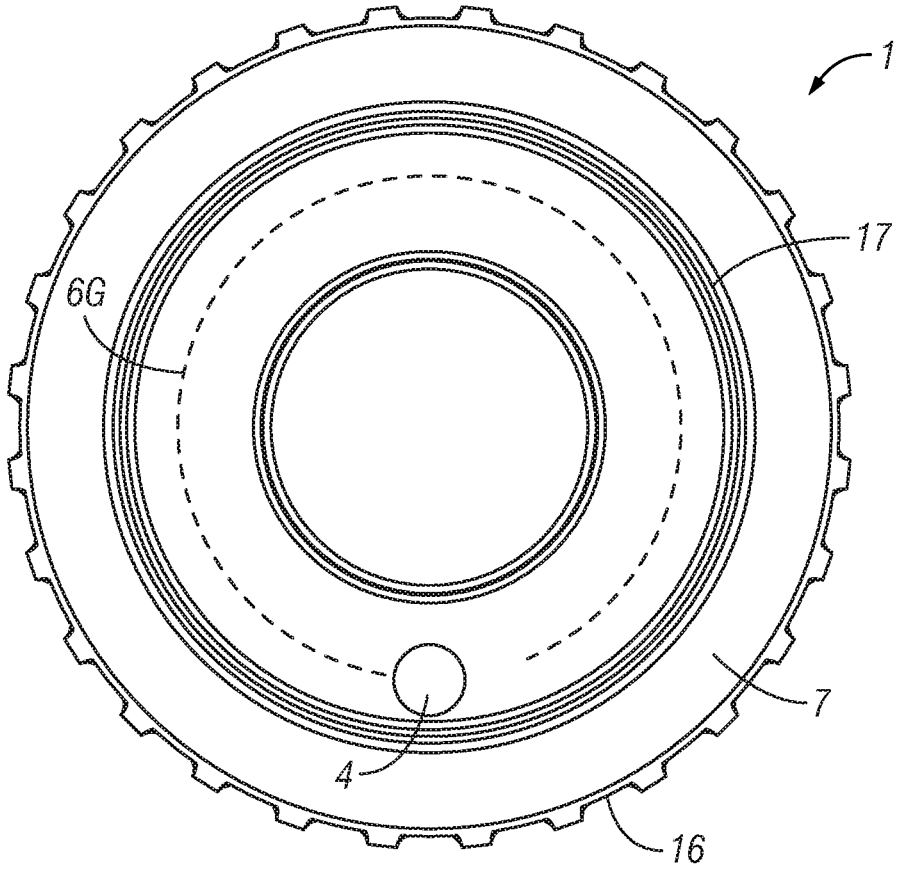
FIG. 13 illustrates a top view of yet another alternative embodiment of a crown of the present disclosure having an off-center location for the attachment portion for the pull tab of an opener assembly with another alternative score line.
Figure 21:
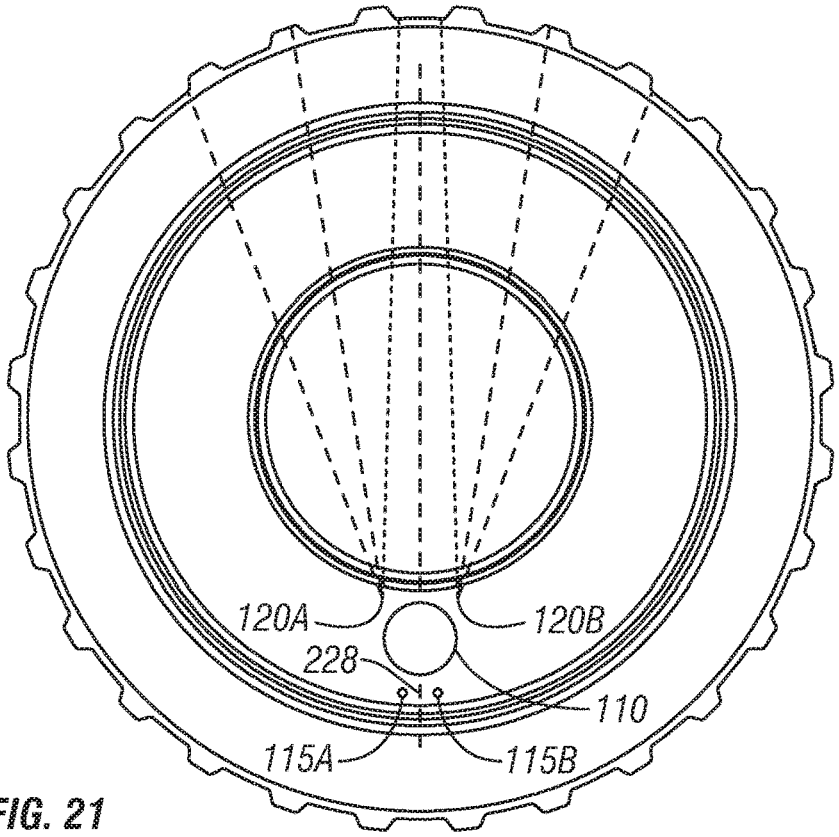
FIG. 21 illustrates a top view of another alternative exemplary embodiment of a crown of the present disclosure having the attachment portion for the opener assembly placed off-center on the crown, and illustrating various optional angles for score lines originating from the front of the off-center attachment portion.

FIG. 13 illustrates a top view schematic representation of an alternative embodiment of the crown 1 of FIG. 21 with an alternative score line 6G. The score line 6G for tearing crown 1 open circumscribes an almost complete circle around top 17 only to descend into skirt 7 at the end and all the way to crown edge 16. The embodiment of FIG. 13 is advantageous, for example, when employed with containers for products other than a beverage, such as soup or stew, where a large mouth opening provides easy access to the contents. The crown and rivet shown in FIG. 13 may each be manufactured using metals, non-metals, or composites as previously described.

Figure 14:
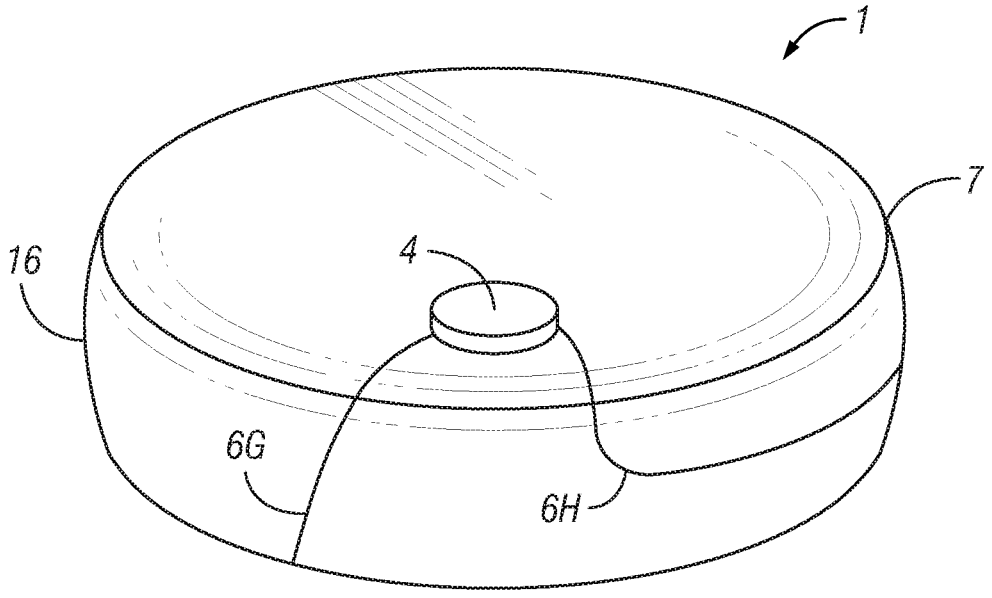
FIG. 14 illustrates an isometric view of another alternative embodiment of a crown of the present disclosure having an off-center location for the attachment portion for the pull tab of an opener assembly similar to the embodiment of FIG. 12 but having no crimping angles on the skirt of the crown.

FIG. 14 illustrates an isometric view schematic representation of an alternative embodiment of a crown 1 of the present disclosure having no crimping angles on the skirt. A crown 1 of the embodiment of FIG. 14 is comparable to pressure-sealed crowns for fruit juices and the like which curl over the top of a container without crimping. The embodiment is also advantageous for use with medical containers and vials. The opener assembly with rivet 4 is off-center, but otherwise crown 1 opens as previously described. The crown 1 and rivet 4 shown in FIG. 14 may each be manufactured using metals, non-metals, or composites as previously described.

Figure 15A:
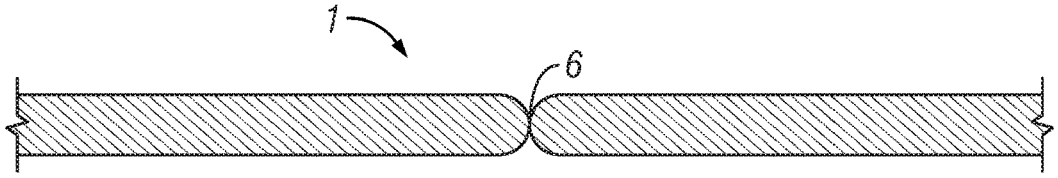
FIG. 15A illustrates a side cross-section view of an unbroken score line of a crown of the present disclosure.
Figure 15B:
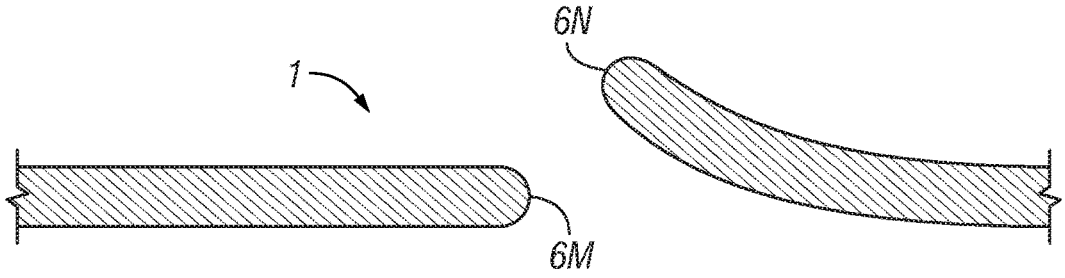
FIG. 15B illustrates a side cross-section view of the score line of FIG. 15A having been broken when the crown is cracked open.

FIG. 15A illustrates a cross-section schematic illustration of an unbroken score line 6 of a crown 1 of the present disclosure. FIG. 15B illustrates a cross-section schematic illustration of a broken score line 6 of the embodiment of FIG. 15A. An advantageous safety feature of a crown 1 of the present disclosure is achieved in the manufacture of score lines 6. Describing FIGS. 15A and 15B together, line 6 is scored on crown 1 in such a way that the moieties on either side of line 6 have curved edges 6M and 6N in cross-section profile. The seal formed by line 6 may be analogized to the seal formed by pressing the fingers of opposing hands together. The tip of each finger is curved and when two fingers are brought together, a seal can be formed. When score line 6 in FIG. 15A is torn as one opens crown 1 using the present opener assembly, crown 1 forms two edges 6M and 6N, which are curved or rounded, analogous to pulling the fingers apart. Non-sharp edges 6M and 6N, respectively, are formed upon breaking the frangible scoring line 6.

The reason score line 6 of FIGS. 15A and 15B is advantageous is that it reduces the sharps produced by tearing open crown 1 with the opener assembly. Round tear edges 6M and 6N render the opened crown 1 dramatically less dangerous from sharps than would otherwise be the case. Further regarding score line 6, one consideration of a crown 1 of the present disclosure is the ease with which the material of crown 1 can be torn once opened by the opener assembly. The ease of tearing relates to the amount of pull force that needs to be applied to tear the crown material. Pulling force may be reduced, that is, ease of tearing may be increased, with the use of crown coatings or lacquers known in the art that contain additives which increase the ease of tearing, by reducing the required pull force, of the crown 1 material along line 6. Specific embodiments may also include degradable plastic additives for the liner attached to the underside of the crown to facilitate biodegradation of the liner after a used crown has been disposed of as waste. A variety of commercially available bio-degradable plastic additives are known in the art and the selection of one or more such additives is a matter of design choice.

In addition to the various structures described herein, certain advantages over the prior art are bestowed on the present crown by the recommended specifications shown in Table 1. However, these specifications are exemplary in nature, and variations based on each application may be employed.

TABLE 1

| Items | Acceptable Range/Target |
|---|---|
| 1. Appearance | Disc properly adhering<br>White, clear or color pigmented liner<br>Complete liner<br>Clean liner<br>Clean crown and ring<br>No rust and scratch for crown and ring<br>Two score lines on the downward surface of crown<br>Rivet<br>Crown |
| 2. Dimensions | Crown:<br>Thickness (mm): 0.12-0.28<br>Outside diameter (mm): 32.08-32.12 (for 26 mm applications; larger O.D. for 29 mm and larger crowns)<br>Inside diameter (mm): 26.60-26.90 (29 mm and larger sizes also possible)<br>Radius of flutes (mm): 1.5-1.9<br>Number of flutes: 18-42<br>Ring:<br>Diameter (mm): 21.1-21.5 (for 26 mm applications; larger ring diameters for 29 mm and larger crowns)<br>Thickness (mm): 0.28-0.32<br>Liner:<br>Diameter (mm): 20.00-20.50 (for 26 mm applications; larger liner diameters for 29 mm and larger crowns)<br>Weight (mg): 320-430 |
| 3. Rockwell Hardness | T4 on the Rockwell 30T scale (metal components) |
| 4. Secure Seal | Greater than/equal to 150 PSI for 1 minute |
| 5. Finish Hardness | Should not scratch with "H" pencil |
| 6. Sensory | No significant differences with an identified control after 12 weeks at 20 degrees C. |
| 7. Lubricant Migration | No particles or lubricant should be present |
| 8. Simulated Palletizing | CO2 loss should not differ against control caps when stored for 1 week with max weight of 45 Kgs over each bottle |
| 9. Corrosion | Maximum corrosion: slight to moderate (metal components) |
| 10. Odor | No off odors detected |
| 11. Pulling Force of Ring (kg) | less than or equal to 2.5 kg |
| 12. Composition of Material | Tinplate or TFS crown and ring (all-metal embodiments)<br>Resin crown and ring (all plastic embodiments)<br>Tinplate or TFS crown, resin ring (hybrid embodiments)<br>Food class non-PVC, PVC-free, or Oxygen scavenger for liner |
| 13. Package | 5,000 crowns per box |
| 14. Pressure (Bars) | Seal is maintained at 10 Bars on the D-Bar Test |
| 15. Container 40' Loading | 1,247 Master Cartons |
| 16. Printing | Logo/other design may be printed on the crown |
| 17. Crown Anti-Oxidation | Material used is "food grade" PET; clear, with no odor, 1.2 um (micrometers) |

A pulling force for a ring pull of the present disclosure of approximately 2.5 kg (kilograms) or less is preferred (see item 11 of Table 1) for such embodiments having metal crown bodies. A relatively small pull force such as this is recommended so that virtually everyone will have sufficient strength to open a bottle using a crown of the present disclosure. In contrast, a relatively large pull force has the disadvantage of requiring a great amount of initial force to tear the tinplate material, and once the crown body material is torn open the sudden release of pulling force causes the bottle to jerk away from the user, spilling the contents often in dramatic fashion.

In addition to the low hardness of the tinplate, the thinness or gauge of the crown may also contribute to achieving a small pull force. For example, a crown of the present invention is recommended to have a thickness of less than 0.28 mm (see item 2 in Table 1). Typical bottle crowns have a thickness of 0.28 mm or greater. Embodiments in which the crown material is strengthened by corrugation, such as in seated embodiments, may be thinner than standard crowns, having, for example, a gauge as thin as approximately 0.16 mm or even 0.12 mm.

In addition to all of the embodiments described herein above, an additional feature is suitable for use with of each of the embodiments as a matter of engineering, design or marketing choice, which is the employment of temperature-sensitive color-changing ink, so-called thermochromic ink, such as described, for example, in U.S. Pat. No. 6,634,516 to Carballido, which is incorporated herein by reference in its entirety. Such thermochromic inks have the property of changing color so as to be one color at room temperature (approximately 21° C.) and a different color when refrigerated to, for example standard retail refrigeration temperature of 4° C. In an exemplary application, the ink is transparent, for example, at room temperature but becomes relatively opaque and visible at chilled temperature, such that a customer has visual confirmation of the approximate temperature without touching the container.

Returning now to the figures, the present disclosure contemplates a variety of alternative exemplary embodiments with respect to the arrangement of score lines in relation to the placement of the opener assembly. FIGS. 16-19 are top view schematic diagrammatic illustrations of exemplary embodiments of a crown of the present disclosure having the opener assembly placed substantially in the center of the top of the crown. FIGS. 20-23 are top view schematic diagrammatic illustrations of exemplary embodiments of a crown of the present disclosure having the opener assembly placed off-center from the top of the crown. The crowns shown in FIGS. 16-23 may be manufactured using metals, non-metals, or composites as previously described.

Figure 16:
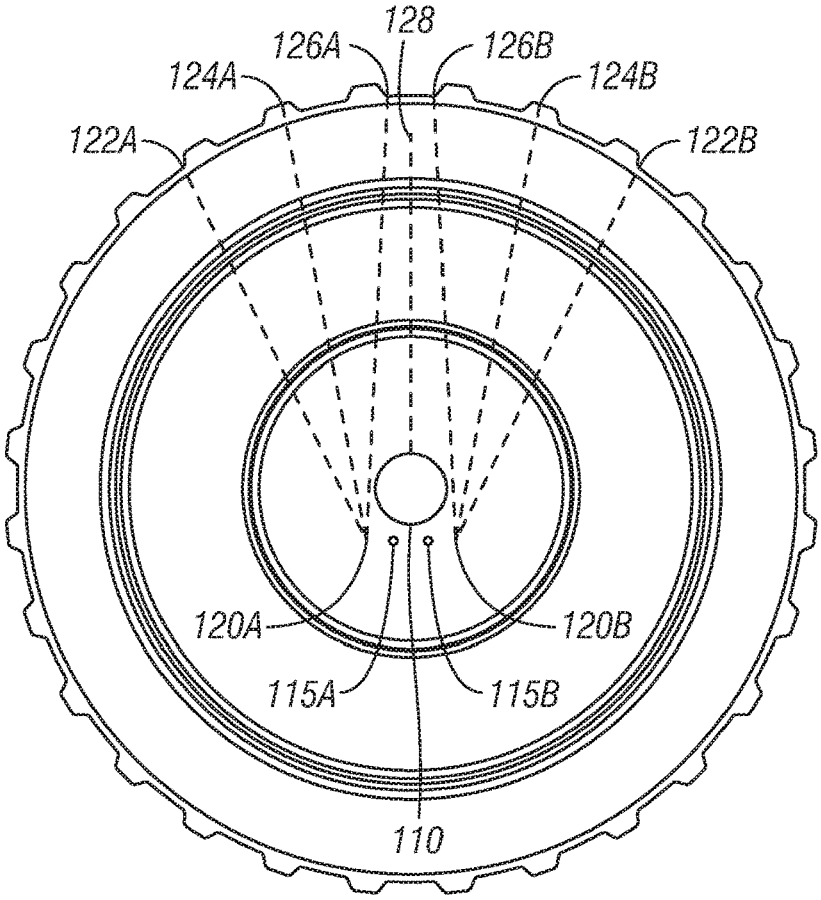
FIG. 16 shows a top view of an exemplary embodiment of a crown of the present disclosure having an attachment portion for the opener assembly in the center of the crown, and illustrating various optional angles for score lines originating from the rear of the attachment portion.

Turning to FIG. 16, the opener assembly placement portion is depicted by the circle 110. Dimples 115A and 115B are located, in relation to circle 110, at a position defined as below circle 110. Frangible score lines 120A, 122A, 124A and 120B, 122B, 124B radiate from apexes 120A/B, respectively, proximate to the opener assembly placement portion 110 and provide a frangible scoring line arrangement. Apexes 120A/B are substantially co-linear with embossed dimples 115A/B. Depending on a particular engineering design choice, dimples 115A/B described herein are concave or convex in specific embodiments.

Figure 17:
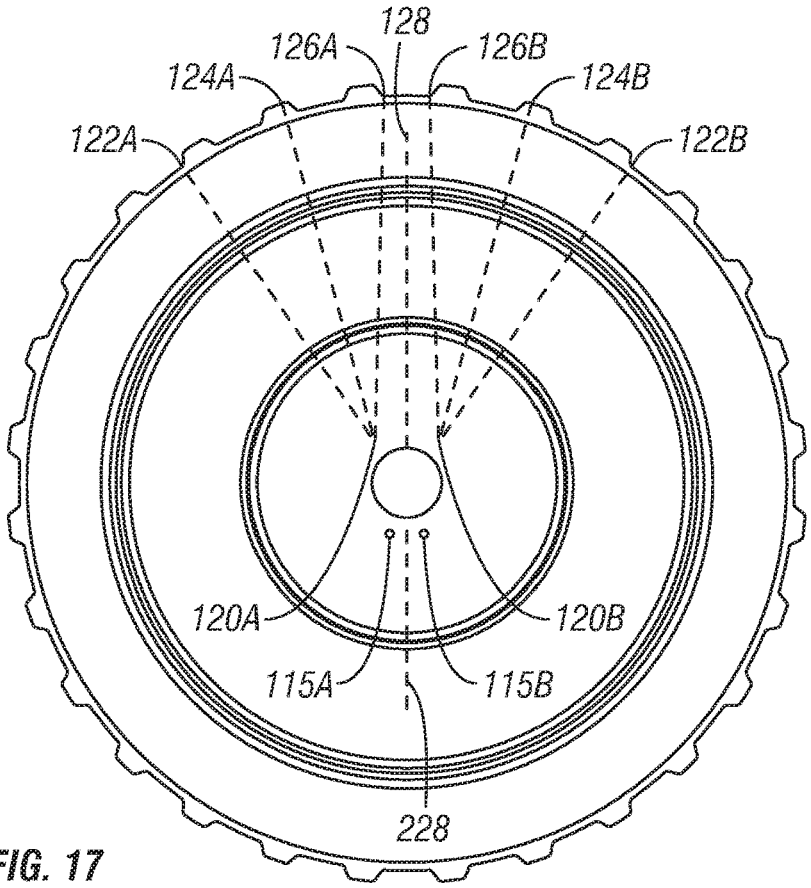
FIG. 17 illustrates a top view of an alternative exemplary embodiment of a crown of the present disclosure having the attachment portion for the opener assembly placed in the center of the crown, and illustrating various optional angles for score lines originating from the front of the attachment portion.

FIG. 17 is an alternative embodiment in which score line apexes 220A/B are at a position defined as being above dimples 115A/B, and substantially parallel to the imaginary line formed by dimples 115A/B. Bottom score line 228 extends from approximately between dimples 115A/B to a terminus that does not extend to the annular skirt of the crown.

Figure 18:
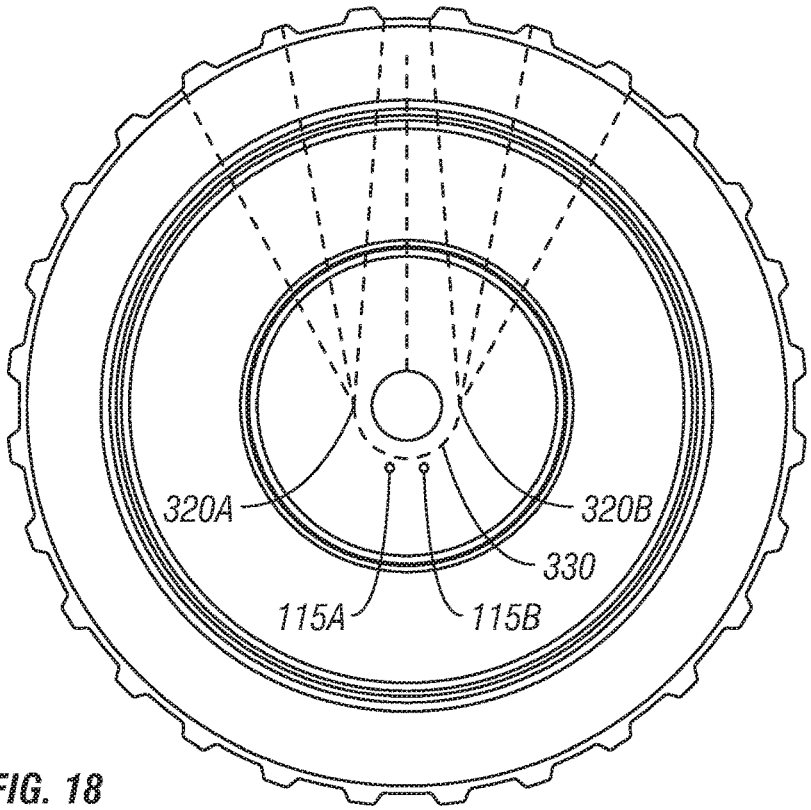
FIG. 18 illustrates a top view of another exemplary embodiment of a crown of the present disclosure having the attachment portion for the opener assembly placed in the center of the crown, and illustrating various optional angles for score lines originating from an arcuate third score line surrounding the attachment portion.
Figure 19:
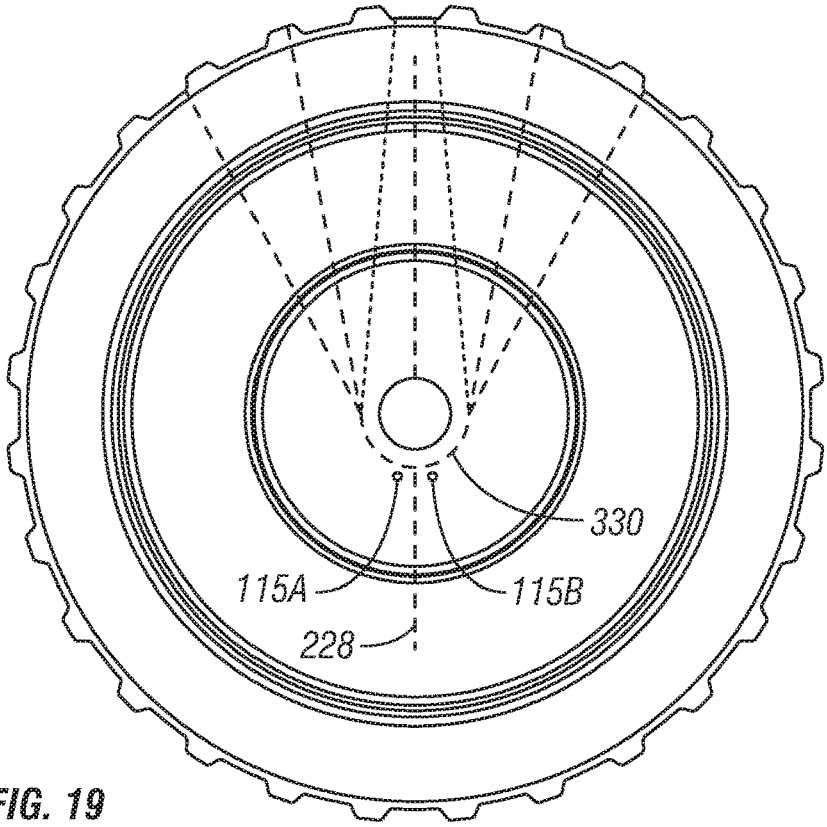
FIG. 19 illustrates a top view of an alternative exemplary embodiment of the crown of FIG. 18 having an optional fourth score line originating from the arcuate third score line surrounding the attachment portion.

FIG. 18 illustrates another alternative embodiment in which score line apex 320A is at a position defined as being to a first side of opener assembly 110 and score line apex 320B is at a position defined as being a second side of opener assembly 110, substantially opposite apex 320A. Score line 330 extends in an arc from apex 320A to 320B and between opener assembly 110 and dimples 115A/B. FIG. 19 illustrates an alternative embodiment of FIG. 18, which further provides rear score line 228.

The features illustrated in FIGS. 18 and 19 find particular utility in embodiments of the present invention in which the opener assembly is fixed to crown 1 without a rivet as well as with a rivet. At the center of the inner side of the top portion of the crown 1, a boss, represented in the drawings by the center circle, is formed by pressing upwards on the material from which the crown is made. Arc-shaped score 330 surrounding the boss is formed at the inner side of the top portion of the crown 1, and each of both ends of the arc-shape score extends to one side of the crown body so as to transit to a straight invisible score, which allows removing the crown from the bottle. The ring pull 2 is formed integrally with a lever tab 3 towards its central portion, wherein the lever tab is provided with a rivet hole at the free end thereof, which is nested on body; and the crown body and the ring pull are riveted together by the boss, which is part of the crown body. Thus, this arrangement prevents the bottled content within the bottle from contamination which would be otherwise the boss, and the ring pull is riveted to the crown body by the boss. Two concave arc-shaped dimples corresponding to each other are respectively formed on both sides of the connection portion between the lever tab and caused by any loosening and hence an impaired sealing condition. In this way the content is ensured to be safe and hygienic.

We now turn to the embodiments having an off-center pull tab assembly location with the various score lines corresponding to those described above for FIGS. 16-19. Embodiments of the present crown 1 having an off-center location for rivet 4 and the rest of the opener assembly are advantageous, for example, for non-beverage containers such as containers for canned goods like soup or beans, which familiarly have opener assemblies close to the edge to the container. Diverging tear lines traverse across the top of the crown 1 in a substantially rectilinear fashion to edge 16. Accordingly, the location of rivet hole or rivet 4 or of the crown 1 opener assembly on the top of crown 1 is largely a matter of engineering design choice. A crown of the off-center rivet embodiments is opened as described herein above of the other embodiments.

Figure 20:
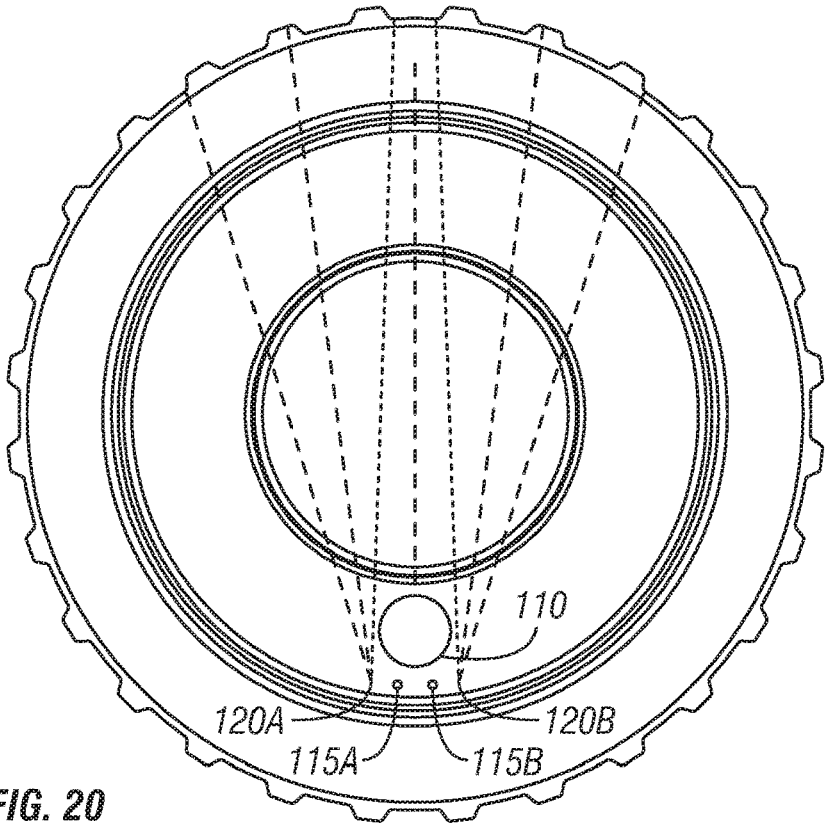
FIG. 20 illustrates a top view of another exemplary embodiment of a crown of the present disclosure having the attachment portion for the opener assembly placed off-center on the top of the crown, and illustrating various optional angles for score lines originating from the rear of the off-center attachment portion.
Figure 22:
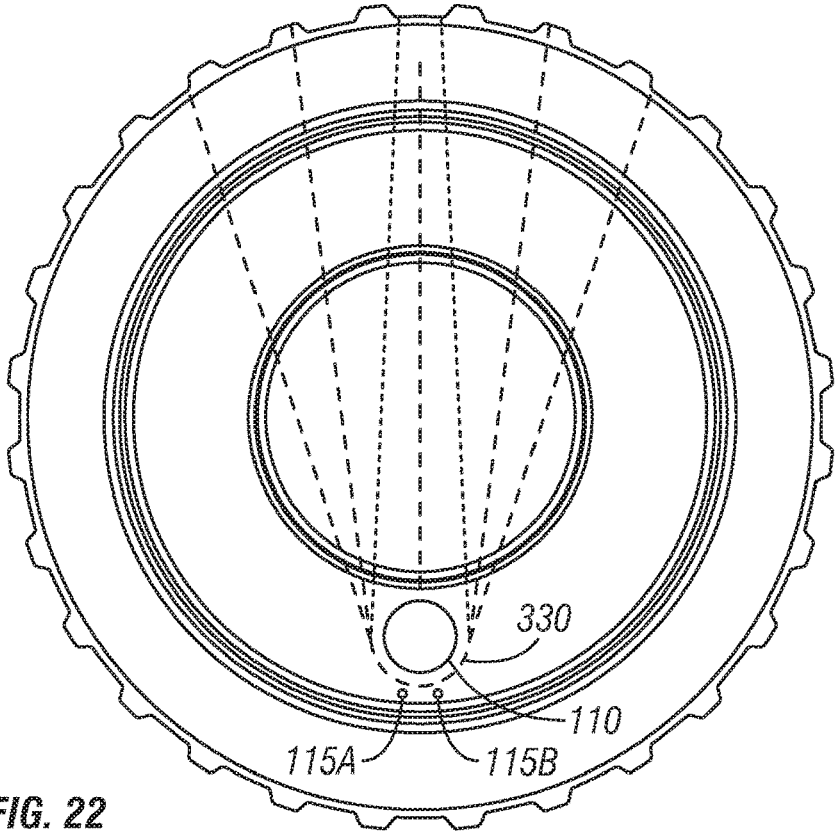
FIG. 22 illustrates a top view of another exemplary embodiment of a crown of the present disclosure having the attachment portion for the opener assembly placed off-center on the crown, and illustrating various optional angles for score lines originating from an arcuate third score line surrounding the attachment portion.
Figure 23:
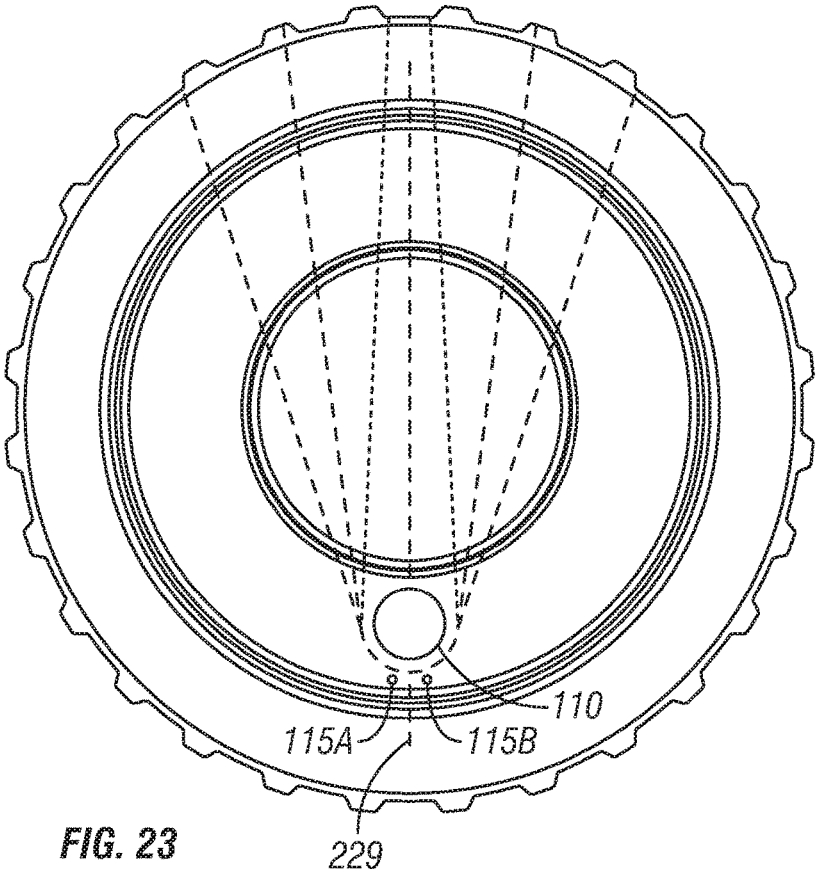
FIG. 23 illustrates a top view of yet another exemplary embodiment of the crown of FIG. 22 having an optional fourth score line originating from the arcuate third score line surrounding the attachment portion.

FIG. 20 is an alternative embodiment of the crown 1 of FIG. 16 having an off-center opener assembly location. FIG. 21 is an alternative embodiment of the crown 1 of FIG. 17 having an off-center opener assembly location. FIG. 22 is an alternative embodiment of the crown 1 of FIG. 18 having an off-center opener assembly location. FIG. 23 is an alternative embodiment of the crown 1 of FIG. 19 having an off-center opener assembly location. In FIGS. 21 and 23, rear score line 229 (corresponding to 228) extends into the annular skirt, but terminates before the edge of the crown. Scoring line termini are predetermined prior to manufacture, depending on the nature of the intended container contents or other factors.

Figure 24:
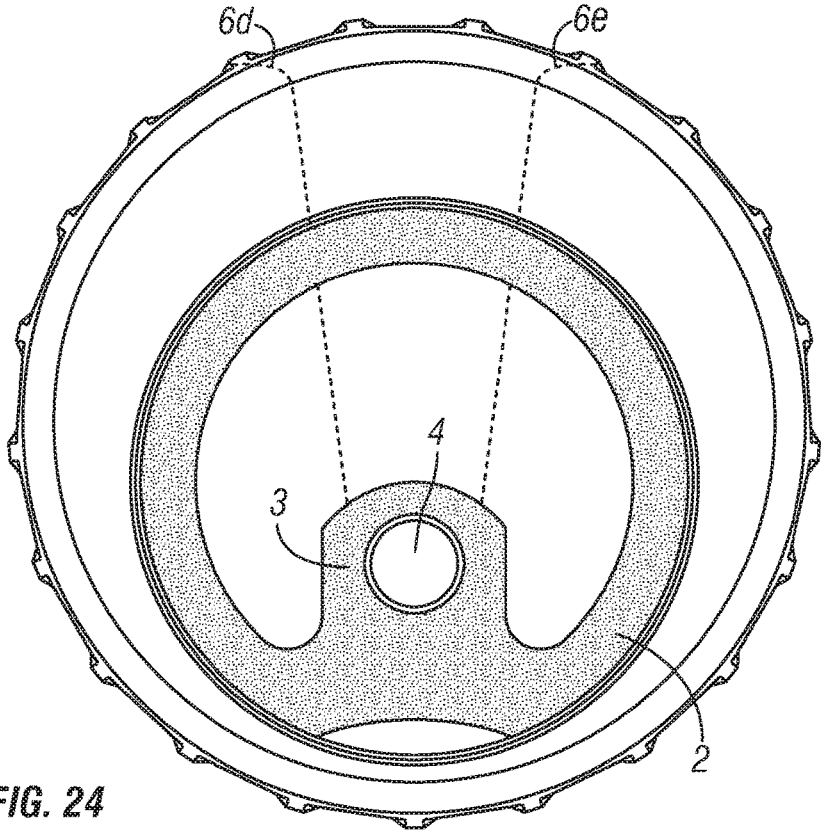
FIG. 24 illustrates a top view of a crown of the present disclosure with a non-metal opener assembly mounted off-center and located within a recess in the top of the crown.

FIG. 24 depicts in a top view of a crown 1 of the present disclosure having an opener assembly, consisting of rivet 4, ring pull 2 and pull tab 3, mounted to the top of a crown 1 in an off-center location. The crown 1, ring pull 2, pull tab 3, and rivet 4 shown in FIG. 24 may each be manufactured using metals, non-metals, or composites as previously described. In this illustrated embodiment, the opener assembly comprising of the ring pull 2 and pull tab 3 are non-metal, while the rivet 4 and the crown body 1 are metal.

Figure 25A:
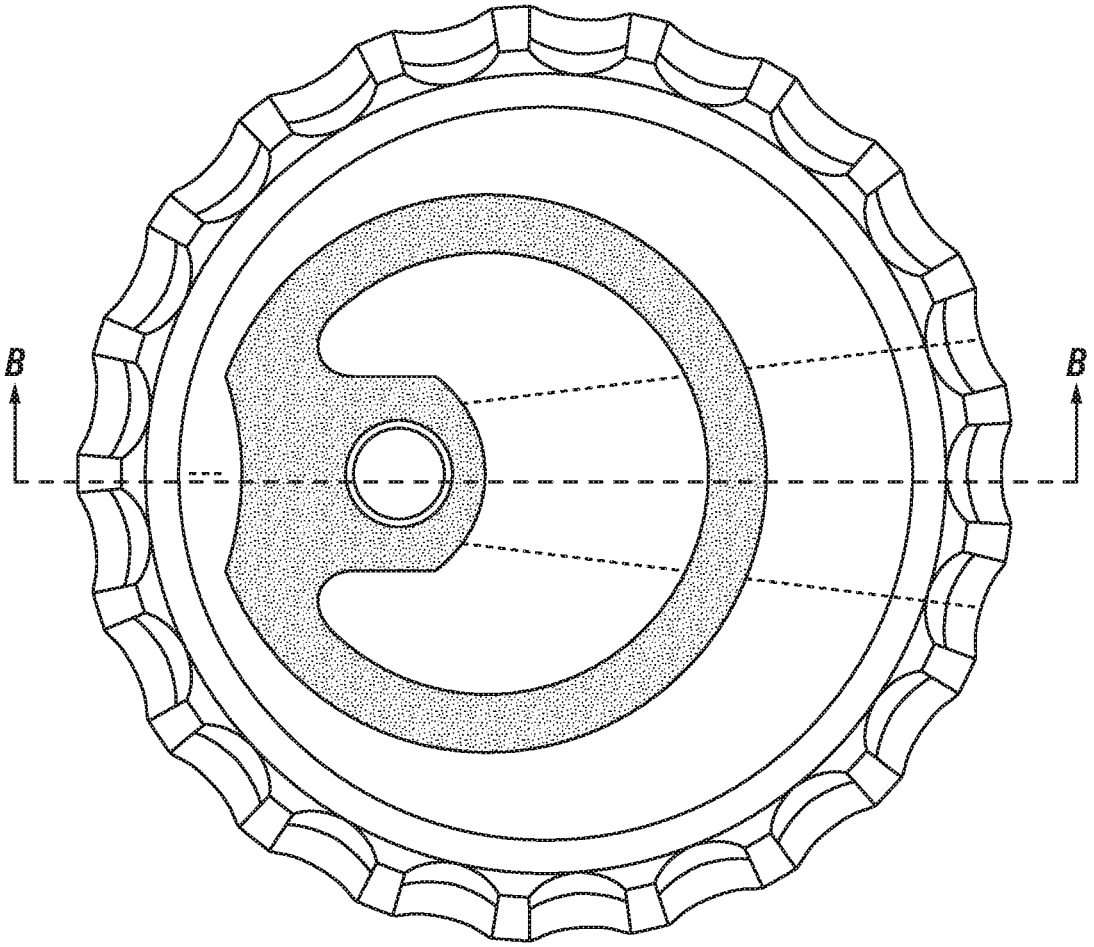
FIG. 25A shows a top view of a crown of the present disclosure with a non-metal opener assembly mounted off-center, without the opener assembly recessed within the top of the crown.
Figure 25B:
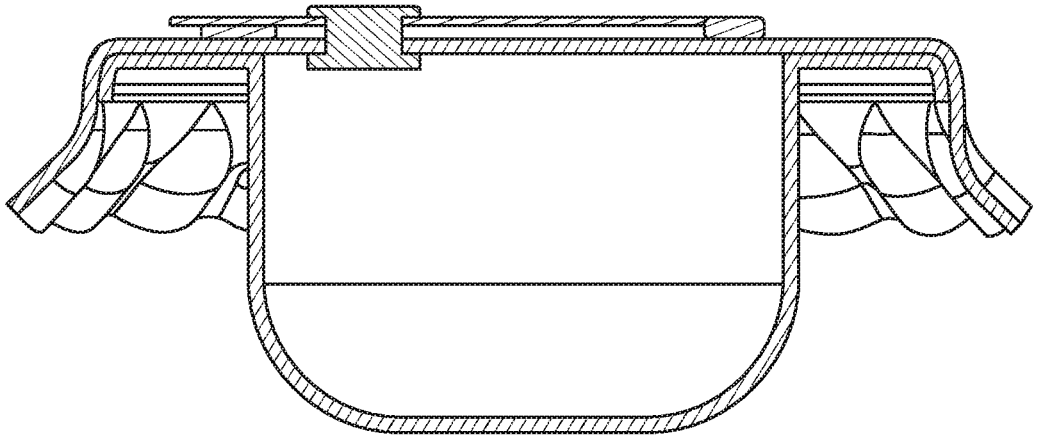
FIG. 25B-25D illustrate side cross-section views illustrating liner configurations for the crown of FIG. 25A.
Figure 25C:
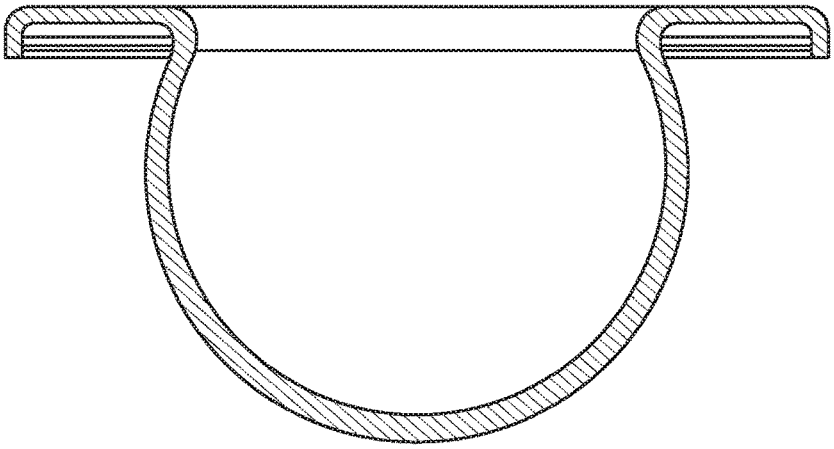
Figure 25D:
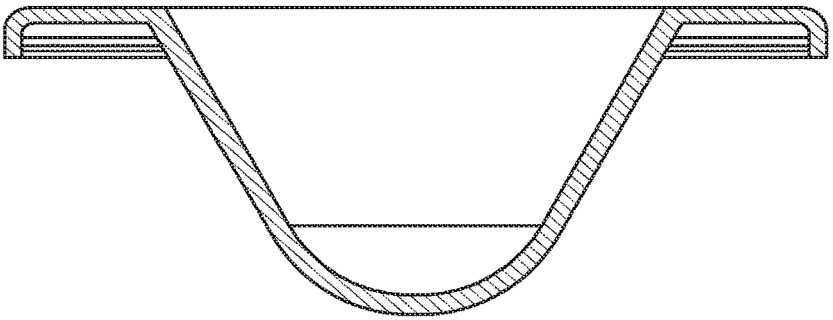

FIG. 25A illustrates a top view of an exemplary embodiment of a crown of the present disclosure, while FIGS. 25B-25D are side view cross-sectional profiles taken along line B-B of FIG. 25A of alternative exemplary embodiments of a crown liner or gasket seal affixed to the underside of the crown of FIG. 25A. FIG. 25B illustrates a liner having a substantially squared-off profile. The liner may be fabricated from a synthetic cork material, such as Nepro, for example. FIG. 25C illustrates a liner having a substantially arcuate profile. FIG. 25D illustrates a liner having a substantially V-shaped profile, with the apex of the V-shape slightly rounded off. A crown liner enhances the gas-tight seal of a crown. The gas tight seal may be further enhanced with the selection of a liner having a desired profile. For example, the liner profiles shown in FIGS. 25B-D may be particularly effective for sealing wine and champagne bottles, which tend to have larger diameter openings than do beer of soda bottles, and which contents require a longer shelf life than beer or soda. The crown, ring pull, pull tab, and rivet shown in FIGS. 25A-25D may each be manufactured using metals, non-metals, or composites as previously described.

Figure 26:
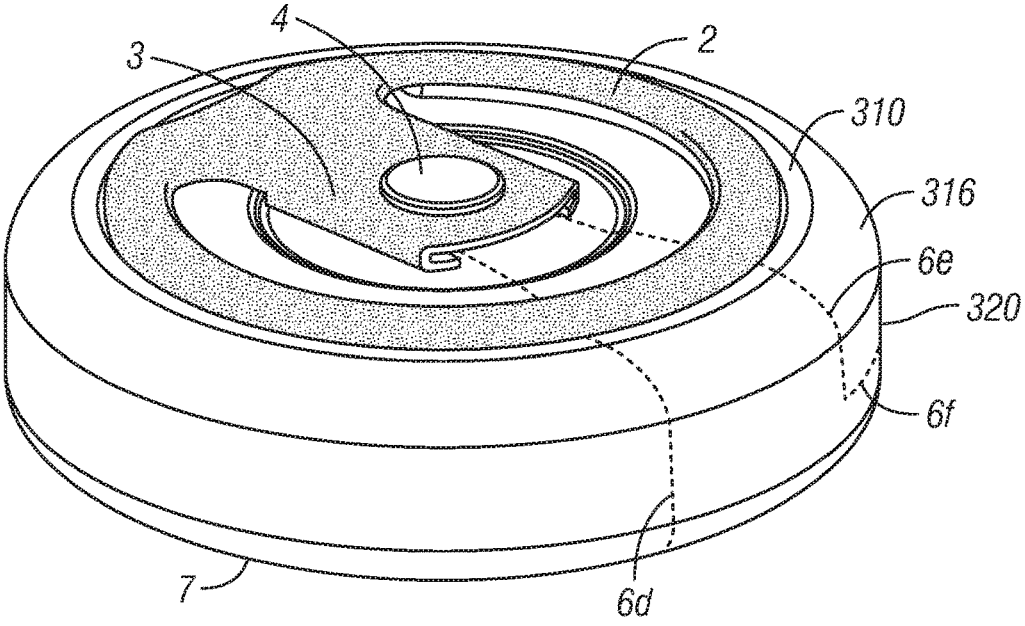
FIG. 26 illustrates an isometric top view of a crown of the present disclosure having a non-metal opener assembly attached to the center of the crown, and having no crimpled angles on the skirt of the crown.

FIG. 26 is an isometric top view of an alternative embodiment of the cap of FIG. 1 having a non-metal opener assembly. The opener assembly has ring pull 2, pull tab 3 and an attachment means to attach the assembly to crown 1, such as a rivet. In yet another alternative embodiment of the score lines, score line 6*e* descends below the top 310 of cap 1 and curves along the shoulder 316 to form score line 6*e*, which traverse along the side 320 substantially equidistant from top 310 and edge 7.

Figure 27:
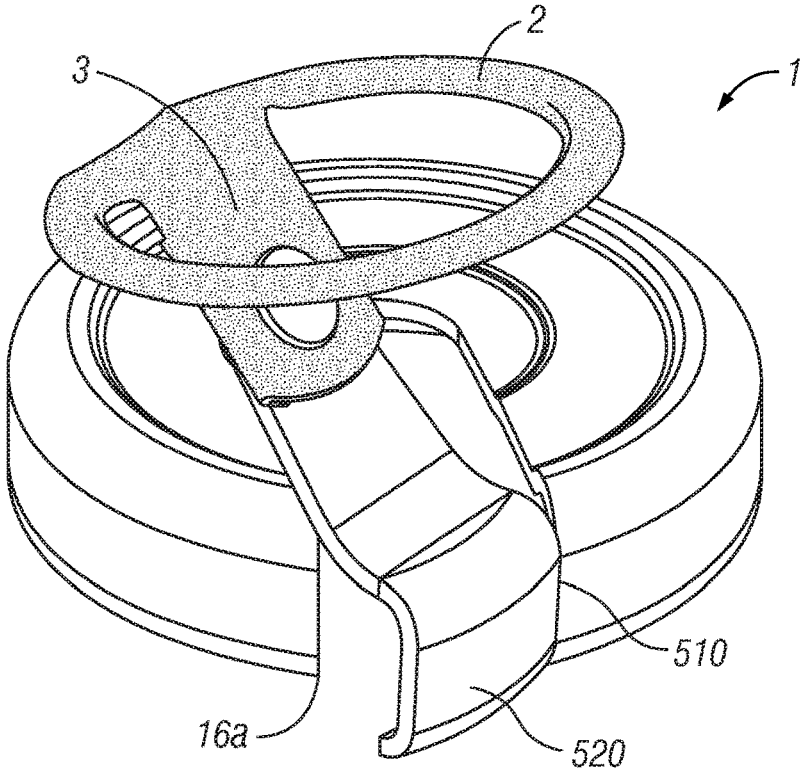
FIG. 27 shows an isometric top view of the crown of FIG. 26 with the crown cracked open.

FIG. 27 is an isometric top view of the alternative embodiment of the cap of FIG. 26, partially opened. Pull tab ring 2 illustrates a least partially deformable so that it can be lifted for a finger to fit into the ring. Pulling ring pull 2 causes frangible cap 1 to tear open along score lines 6*d*, 6*e* and creating opening 15*a* beneath pull tab 3. Specific exemplary embodiments provide recessed depression 18 in crown 1 to house the opener assembly so that, in the unopened position, ring pull 2 is substantially flush with the top of cap 1. Score line 6*d* terminates in a straight line at terminus 16*a*. Frangible cap 1 is cracked open at score line 6*d* but portion 520 remains pivotally attached to crown 1 at joint 510. In the embodiment of FIG. 27, terminus 16*a* forms a substantially right angle point.

Figure 28:
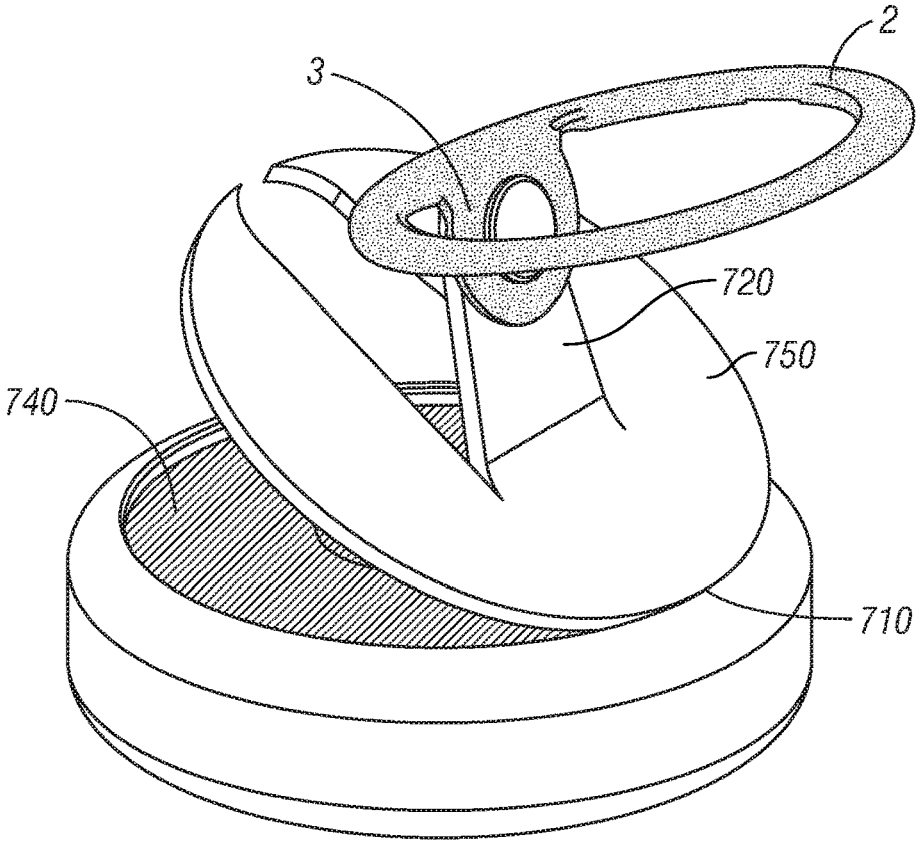
FIG. 28 illustrates an isometric top view of an alternative embodiment of the crown of FIG. 26, where the non-metal opener assembly is used to open and remove the top portion of the crown to reveal an underlying membrane of the container on which the crown is mounted.

FIG. 28 illustrates an isometric top view of another alternative embodiment of the crown of FIGS. 26 and 27. This embodiment again includes a non-metal opener assembly and is attached to cap 1 with rivet 4 at an off-center attachment point. Score lines 706*a*, 706*b* do not extend from the attachment position to the side of the crown 1, but instead terminate a the shoulder of the crown 1 before reaching the sidewall of the crown 1. Seam 710 circumscribes the circumference of cap 1 around the opener assembly to form cover 750. As illustrated, the non-metal opener assembly lifts the cover 750 away from the remainder of cap 1 by means of tab portion 720 creating an opening. Cover 750 protects membrane 740, which is exposed upon opening of the opener assembly. The exposed membrane 740 may be used for access by a syringe, for example, if the container is a medical vial.

Figure 29:
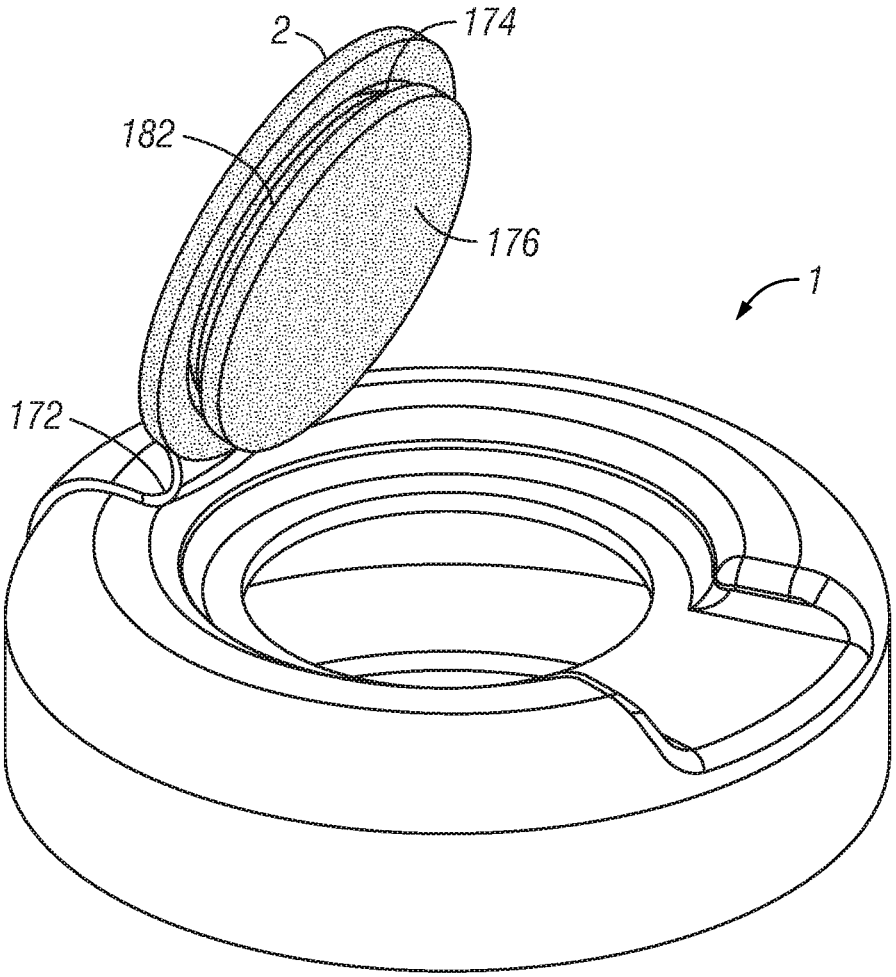
FIG. 29 illustrates an isometric top view of an alternative embodiment of a crown having a non-metal opener assembly comprising non-metal plug.

FIG. 29 illustrates an isometric top view of an alternative embodiment of a crown having a non-metal opener assembly comprising a non-metal plug. In this embodiment of the crown 1, ring pull 2 is non-metal as described above for other embodiments. However, in the embodiment of FIG. 29, non-metal ring pull 2 is attached to flap hinge 172, which functions as the pull tab 3 described above in other embodiments. As with other embodiments discussed herein, the non-metal ring pull 2 may be attached to the metal flap hinge using a variety of techniques. Those techniques are discussed in detail below. Alternatively, the flap hinge may also be non-metal, and those may be integral with the ring pull 2 or may be attached to non-metal ring pull 2 using a means sufficient for connecting two non-metal materials. In such embodiments, the non-metal flap hinge 172 may be attached to the shoulder 316 of crown 1 using an adhesive or other means.

In addition, ring pull 2 is attached to plug 174, which has a top portion and a bottom portion 176. The top portion of plug 174 and bottom portion 176 form an annular receiving groove 182. Ring pull 2 fits snugly into groove 182 so that when ring pull 2 is pulled upward, plug 174 is released from the top of crown 1, pivoting on flap hinge 172, to open the container on which the crown 1 is mounted. Ring pull 2, plug 174 and flap hinge 172 form the opener assembly for this embodiment of the crown 1.

To facilitate operation of ring pull 2, a portion at the front of the top portion of crown 1 is recessed or depressed to accommodate a human finger nail. This depressed portion makes it easier to access ring pull 2 with a fingernail to operate the opener assembly. Alternative embodiments of the opener assembly of FIGS. 17 and 18 provide a plug 174 that is integral with ring pull 2. Although not designed exclusively for such applications, this embodiment of a crown having a non-metal opener assembly is particularly useful for single use medical vials. Scored glass vials are in common usage for single uses but they have an inherent risk of shattering and causing lacerations. The present cap reduces such risks substantially.

Figure 30:
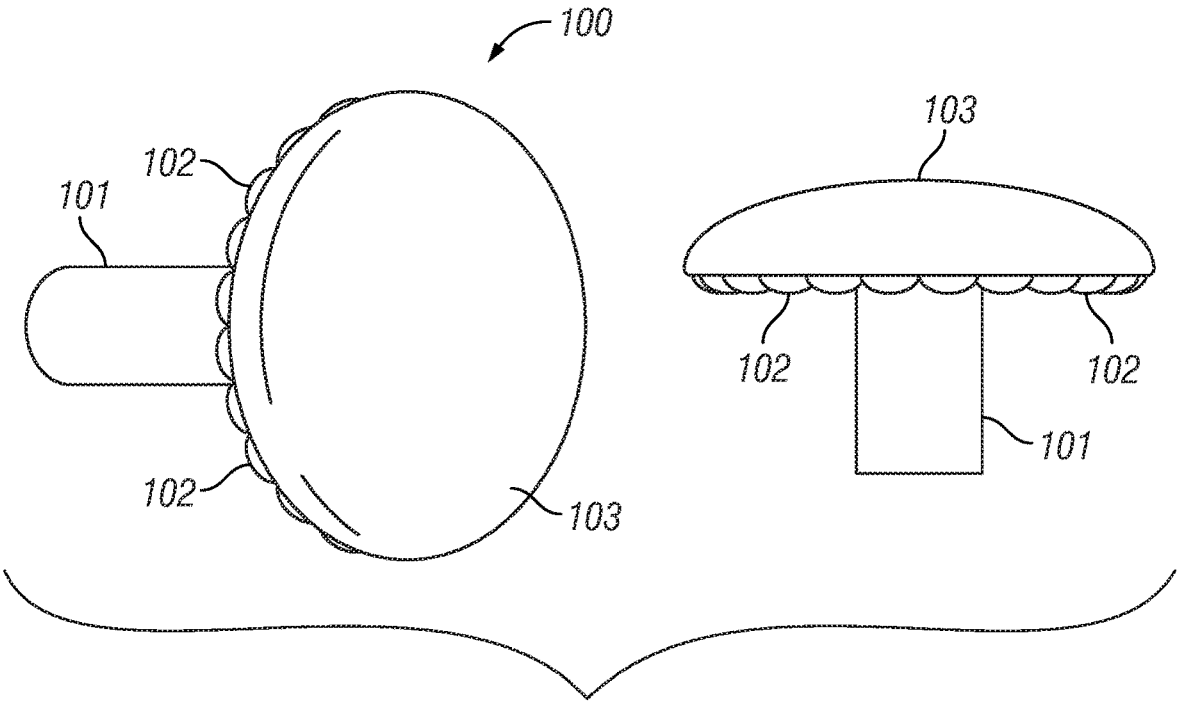
FIG. 30 illustrates perspective top and side views of one embodiment of a rivet of the present disclosure having engaging features.

FIG. 30 presents perspective and side views of one embodiment of a rivet 100 of the present disclosure. Rivet 100 is comprised of a circular head 103 joined at its center by a cylindrical post 101. The bottom side of head 103 provides an engaging surface of the rivet 100 that is surrounded at its perimeter by one or more engaging features 102, which are used to increase the engagement of the rivet 100 with a pull tab of an opener assembly of type disclosed herein when the opener assembly is attached via the pull tab to the attachment portion of a crown body. When the rivet 100 is compressed over a receiving item, such as a pull tab of an opener assembly, the engaging features 102, which in this embodiment are teeth 102, dig into the material of the receiving item to increase the effective coefficient of friction with respect to the bottom side of head 103 and a parallel surface of the receiving item. Rivet 100 may be formed using metal materials, non-metal materials, composite materials, or one or more of such materials. In certain preferred embodiments, a metal rivet may be used to secure a plastic pull tab to the surface of a metal crown body. The additional engaging force provided by the engaging features onto a non-metal (e.g., plastic) pull tab assists in preventing the hole in the pull tab through which the rivet 100 passes from undesirably stretching when the opener assembly is employed by a user pulling on the ring pull, which in turn transmits a pulling force to the pull tab. Accordingly, without the engaging features 102, the non-metal pull tab may be stretched by the opening force applying to the opener assembly, which could cause the assembly to slip off of the crown body before the crown is cracked open and removed from the container. Also, it should be noted that the number and shape of the engaging features 102 shown in FIG. 30 are provided as examples only. The precise number or shape of the engaging features may vary while still increasing the friction force compared to currently available rivets.

Figure 31:
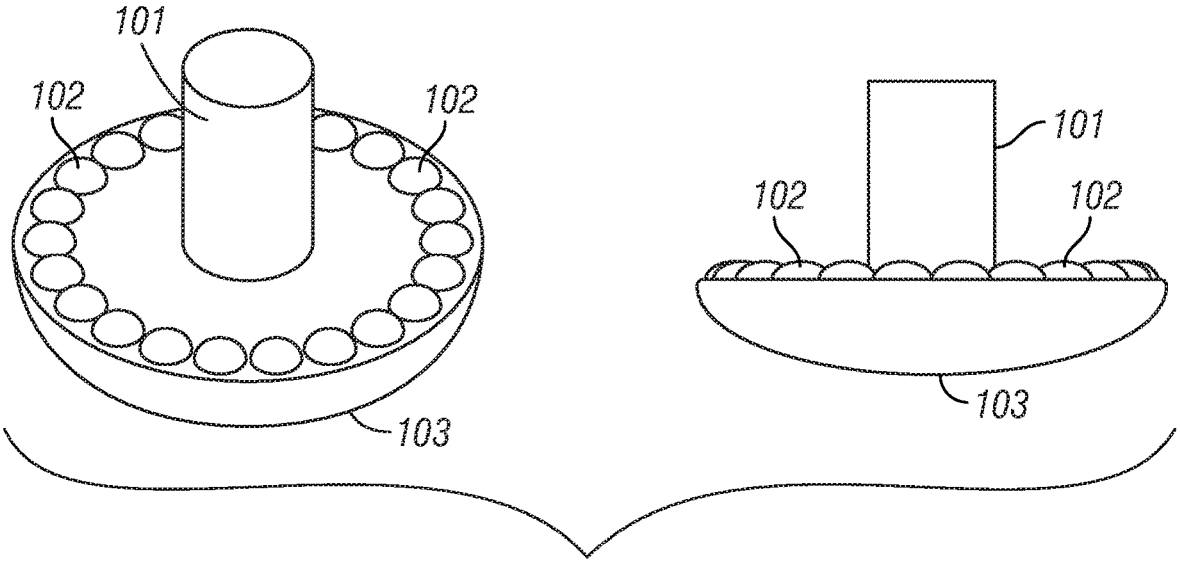
FIG. 31 shows perspective bottom and side views of the embodiment of a rivet of FIG. 30.

FIG. 31 presents perspective and side views showing the bottom, engaging surface of head 103 of the embodiment of a rivet 100 of the present disclosure shown in FIG. 30. As before, rivet 100 is comprised of a circular head 103 joined at its center by a cylindrical post 101. As shown in FIG. 31, the bottom engaging surface of head 103 is surrounded at its perimeter by one or more hemisphere-shaped teeth 102 as the engaging features.

Figure 32:
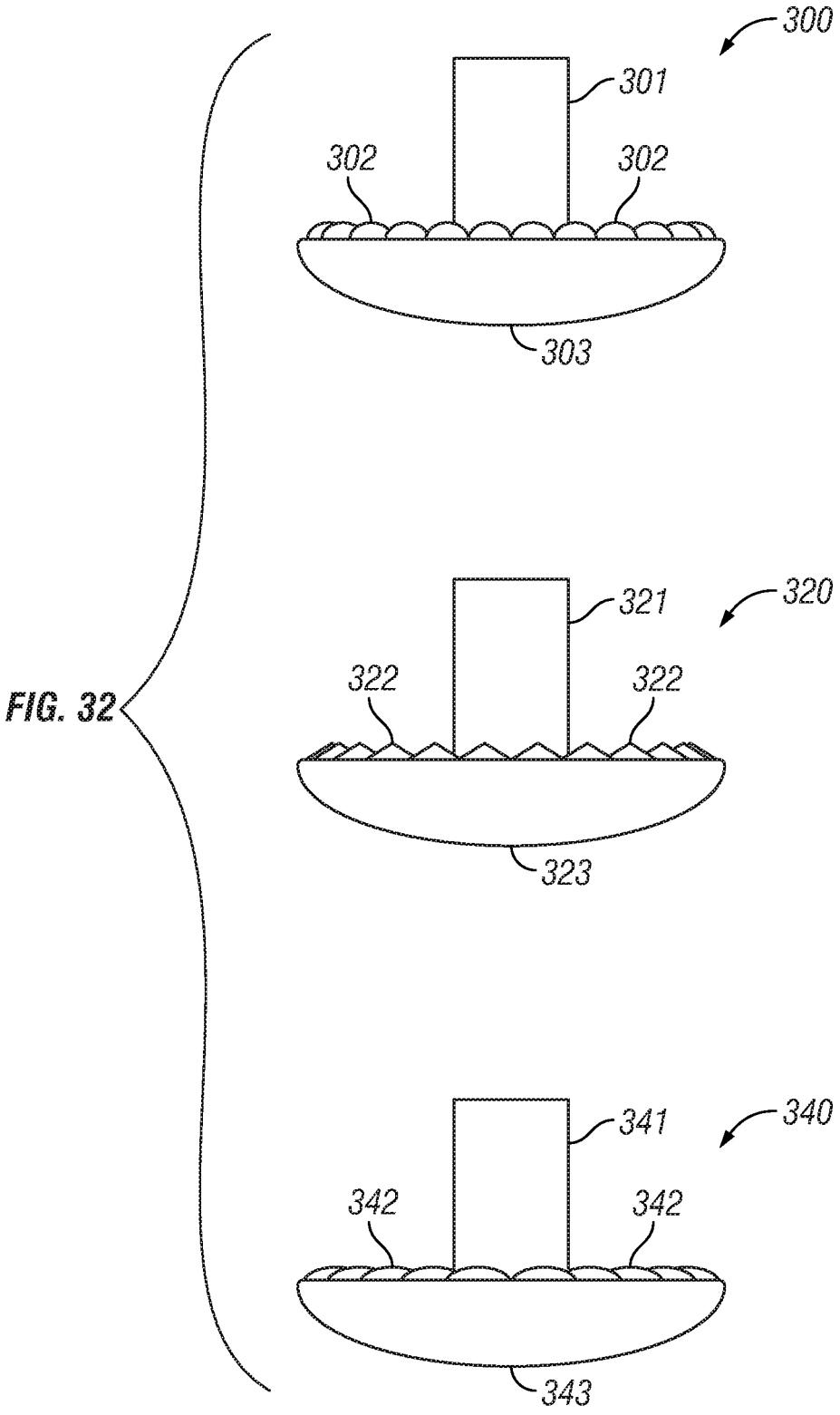
FIG. 32 illustrates side views of three exemplary embodiments of a rivet of the present disclosure having engaging features.

FIG. 32 illustrates side views of three alternative embodiments of a rivet 300, 320, 340 designed and constructed in accordance with the disclosed principles. Each of these rivets 300, 320, 340 is comprised of a circular head 303, 323, 343 joined at its center by a cylindrical post 301, 321, 341. The bottom side of head 303 again provides an engaging surface that is surrounded at its perimeter by one or more non-metal (e.g., rubber) engaging features or teeth 302, which may be used to increase the engagement with a pull tab when an opener assembly is attached to a crown body. Similar to rivet 100 in FIG. 31, the teeth 302 may be hemisphere-like in shape. Alternatively, the teeth (322, 342) in the other two illustrated embodiments of rivets 320, 340 may take other forms or shapes, such as conical teeth 322 or ellipsoidal teeth 342. In any of these exemplary embodiments, the teeth 302, 322, 342 extend from the engaging surface of their respective rivet 300, 320, 340, opposite the rivet heads 303, 323, 343.

Also, it should be noted that in any such exemplary embodiment of a rivet in accordance with the disclosed principles, the engaging surface may comprise a different number of teeth along the bottom, engaging surface of the rivet head than those illustrated. In general, the teeth may be formed at regular intervals along the edge of the rivet head; however, not such arrangement is required. By placing the teeth in a circular pattern, a rivet as disclosed herein may be oriented in any direction along the plane of the rivet head when it is fastened to a pull tab and crown body without substantially impacting frictional performance. Also as before, the teeth of any such embodiments may be metal or non-metal, as desired.

Figure 33:
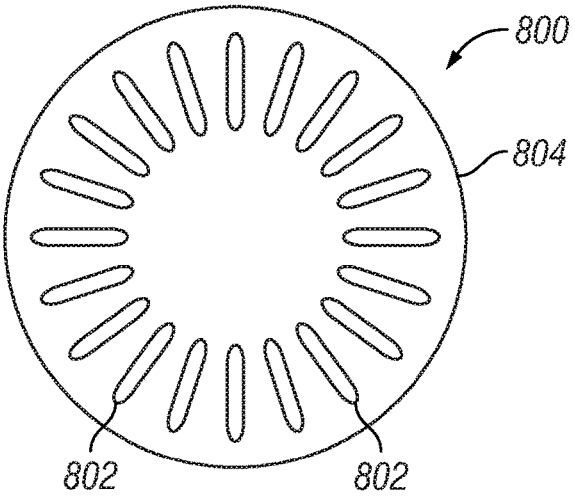
FIG. 33 illustrates a bottom view of an alternative embodiment of a rivet having engaging features in accordance with the disclosed principles.

FIG. 33 shows a bottom view of an alternative embodiment of a rivet 800 in accordance with the disclosed principles, which is shown without a center post simply for clarity of illustration. Rivet head 804 has a plurality of ridge-like teeth 802 as the engaging features and which are formed on the bottom engaging surface of the head 804. As depicted, each ridge-like tooth 802 is elongated and is aligned along a radius segment of the rivet head 804, where each radius segment is separated by an 18 degree angle. The teeth 802 may be equally sized and shorter than the radius of the circular rivet head 804 such that the distal ends of teeth 802 form concentric circles about the center of rivet head 804. In cross-section, the teeth 802 may be circular, triangular, rectangular, elliptical, or another suitable polygonal for increasing the coefficient of friction of the rivet head 800. In alternative embodiments, the rivet teeth 802 may be staggered or aligned to form other patterns, such as a circular chevron, and also may be of metal or non-metal material.

Figure 34:
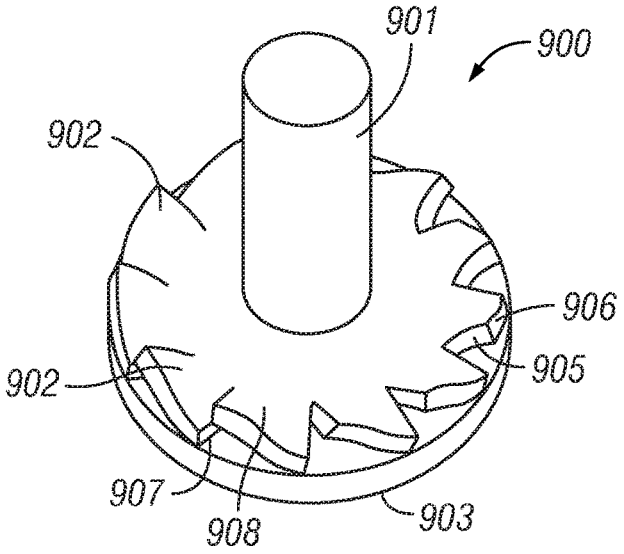
FIG. 34 illustrates a bottom perspective view of an alternative embodiment of a rivet having engaging features in accordance with the disclosed principles.

FIG. 34 illustrates a bottom perspective view of an alternative embodiment of a rivet 900 in accordance with the disclosed principles. Rivet 900 is comprised of a circular head 903 joined at its center by a cylindrical post 901. The bottom engaging surface of head 903 is surrounded at its perimeter by one or more inclined teeth 902 as the engaging features, which may be used to increase the engagement with a pull tab when the pull tab is attached to a crown body as disclosed herein. As shown in FIG. 34, teeth 902 may be comprised of an overlapping saw tooth pattern, in which each tooth has a rising edge 908 and a falling edge 907 that form the peaks and valleys of a saw tooth pattern when viewed in cross-section. Moreover, each such tooth may have an end that extends coextensive with the radius of the head 903 of rivet 900, as illustrated, or the teeth may be shorter in length. Also, each tooth may be provided at a desired thickness 905 sufficient to provide the amount of increased friction when the rivet attaches the pull tab to the crown body, for example, by being of a sufficient thickness to resist fully compressing onto the engaging surface of rivet 900 when the rivet is compressed during such attachment.

Figure 35:
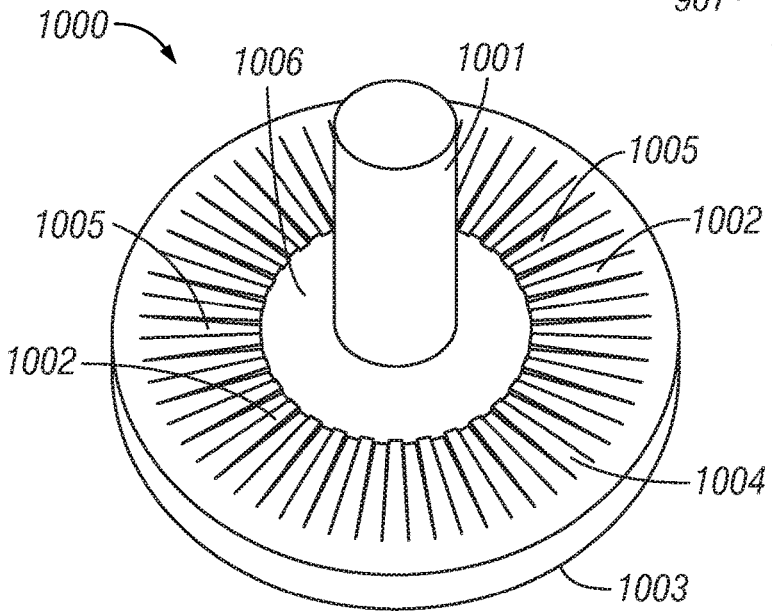
FIG. 35 illustrates a bottom perspective view of yet another alternative embodiment of a rivet having engaging features in accordance with the disclosed principles.

FIG. 35 illustrates a bottom perspective view of yet another alternative embodiment of rivet 1000 in accordance with the disclosed principles. Rivet 1000 is comprised of a circular head 1003 joined at its center by a cylindrical post 1001, as before. The bottom side of head 1003 is surrounded at its perimeter by one or more engaging features 1002, which may be used to increase the engagement with a pull tab when the pull tab is attached to a crown body, as discussed above. As shown in FIG. 35, engaging features 1002 may be comprised of narrow, wedge-like portions that are staggered to form alternating ridges 1004 and grooves 1005, which are parallel to a radius of the circular rivet head 1003. The frictional performance of such engaging features 1002 may be increased by interrupting the pattern of ridges 1004 and grooves 1005 with a smooth surface 1006 that intersects the proximal end of grooves 1005 at an angle. In doing so, the proximal end of ridges 1004 protrude from the surface 1006 to create the engaging features.

Figure 36:
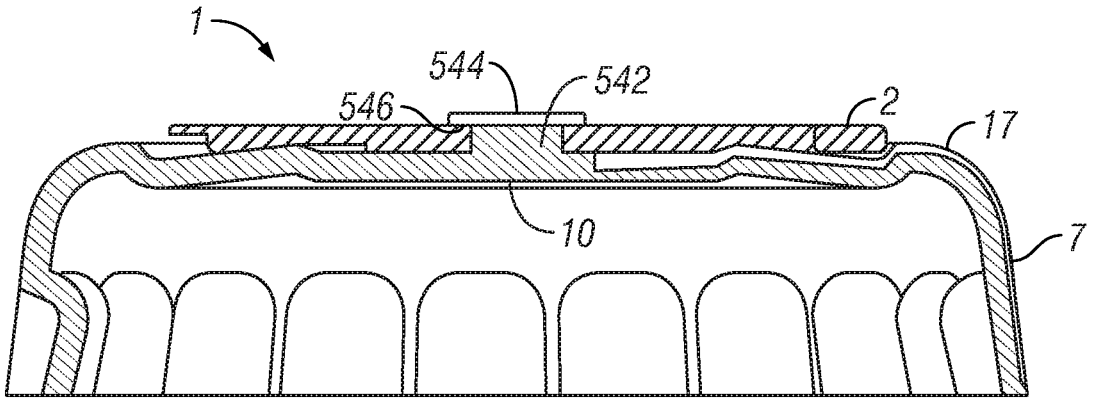
FIG. 36 illustrates a side cross-section view of an alternative embodiment of a crown according to the disclosed principles in which a pull tab of an opener assembly is attached to crown without a rivet.

FIG. 36 illustrates a side cross-section view of an alternative embodiment of a crown according to the disclosed principles in which a pull tab of an opener assembly, which may be metal or non-metal, is attached to crown 1 without a rivet. Instead of a rivet, boss 542 is integrally formed in top 17 of crown 1 by, for example, pressing up on the crown material from the underside to create a concave shape on top surface 17. Ring pull 2 is attached to boss 542 using pull tab 3, as in other embodiments disclosed herein. Then, boss 542 is further shaped to flatten and spread out the top of boss 542 to form a substantially planar top 544 such that the opener assembly is attached to boss 542. Spreading out boss 542 to form integral top 544 results in an overhang or lip 546, which secures the pull tab of the opener assembly on boss 542 without the use of a rivet.

Figure 37:
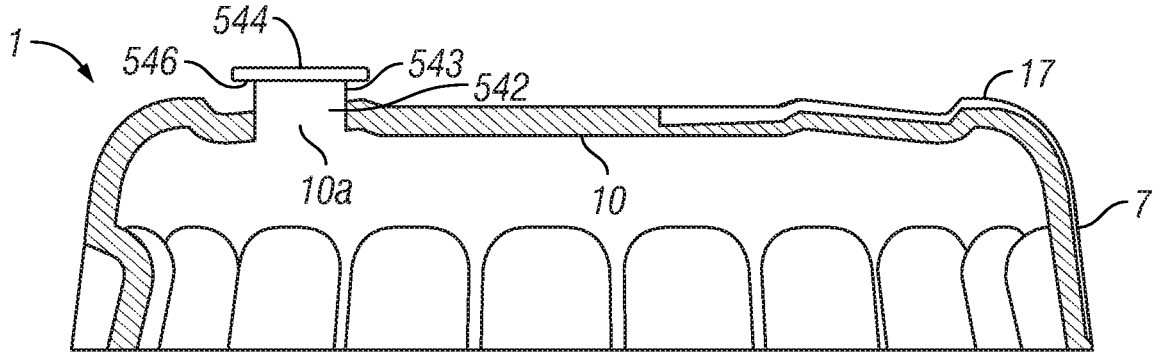
FIG. 37 illustrates a side view cross-section of an alternative embodiment of the crown of FIG. 36.

FIG. 37 illustrates a side view cross-section of an alternative embodiment of the crown of FIG. 36. In FIG. 36, boss 542 is located substantially at the center 10 of top surface 17 of the crown 1. However, in FIG. 37, boss 542 is located off-center (location 10*a*) of top surface 17 of the crown 1. In other respects the description of the rivetless attachment means described above for FIG. 36 is the same. However, note that ring pull 2 is not shown in FIG. 55 for clarity.

In both the embodiments of FIGS. 36 and 37, the top portion of the crown is metal, and thus the boss 542 is also formed of metal. However, the ring pull 2, or both the ring pull 2 and pull tab 3, may be formed of non-metal in accordance with the disclosed principles. In embodiments where the pull tab 3 remains metal, the metal boss 542 may sufficiently hold the pull tab 3 securely once compressed as described above. Accordingly, even a non-metal ring pull 2 may be secured to the crown in this manner, and the non-metal ring pull 2 may be connected to the metal pull tab 3 using any of the techniques discussed in detail below. However, in embodiments where the pull tab 3 is also non-metal, where integrally formed with the non-metal ring pull 2 or attached thereto by an adhesive or mechanical technique described below, the stem of the boss 542 may include engaging features of the type described in detail below with reference to FIGS. 45A-45C. Such technique will be described in detail below. Alternatively, the non-metal pull tab 3 may also include a metal grommet, and thus may be attached with the boss 542 in the manner described below with reference to FIG. 44.

Figure 38A:
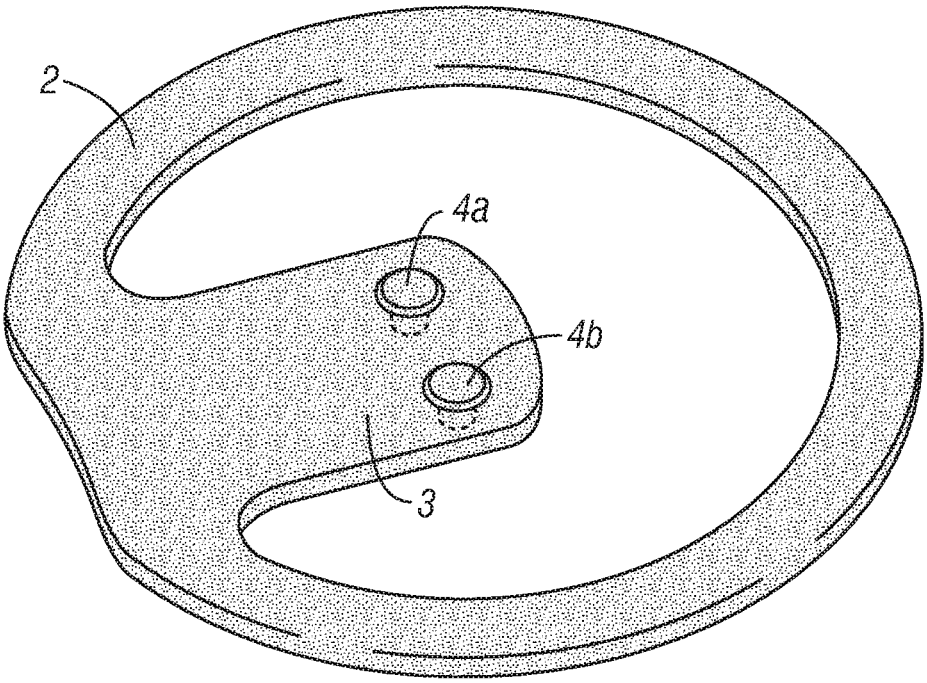
FIG. 38A illustrates a perspective view of an alternative embodiment of an opener assembly constructed in accordance with the disclosed principles having two integral rivets.

FIG. 38A illustrates a perspective view of an alternative embodiment of an opener assembly constructed in accordance with the disclosed principles. The opener assembly may be formed from metal, non-metal, or composite materials. As shown in FIG. 38A, the opener assembly is comprised of a ring pull 2 integrally connected to a pull tab 3. The pull tab 3 may comprise one or more rivets 4 integrally formed on the pull tab 3. FIG. 38A illustrates one embodiment having two such integrally formed rivets (4*a*, 4*b*); however, other embodiments may feature either only a single rivet or more than two. Rivets 4*a* and 4*b* include a post connected to a larger head, with the posts illustrated in hidden line under the pull tab 3 in the figure. The rivet posts will have substantially the same diameter as a corresponding rivet hole, which would be in the attachment portion of the crown body on which the opener assembly will be attached. The head of each such rivet, on the other hand, is generally diametrically wider than the corresponding rivet hole through which it will be threaded. Some heads may be hemispherical, conical, or other suitable shape, on one side but flat or barbed on the other, to facilitate attachment in only a single direction. Once such a head passes through the rivet hole, the received posts in the attachment portion are flattened, thereby riveted, to the crown body such that they resist disengagement of the pull tab from the crown so that the opener assembly may be employed to crack open and remove the crown from the container.

Also, the rivets 4*a*, 4*b* may be integrally formed with the pull tab 3 by being formed of the same material. For example, in such an embodiment the ring pull 2, pull tab 3, and rivets 4*a*, 4*b* are formed of the same non-metal material. In such embodiments, the non-metal rivet posts maybe heated/reflowed once engaged with the crown body so that the rivet posts may be flatten to rivet the pull tab 3 to the crown body. In other embodiments, the rivets 4*a*, 4*b* may be form of a metal material, while the ring pull 2 and pull tab 3 are non-metal. In such embodiments, the non-metal material, such as plastic or other resin material, is formed around the metal rivets 4*a*, 4*b* so that they are held in place and integral with the pull tab 3. The larger head of such rivets 4*a*, 4*b* would help hold the rivets 4*a*, 4*b* in place once the non-metal pull tab 3 is formed around the rivets 4*a*, 4*b*. The posts of such metal rivets 4*a*, 4*b* may then be inserted into the crown body at the attachment portion and thereafter compressed in an conventional manner that metal rivets are compressed so as to attach the opener assembly to the crown body.

Figure 38B:
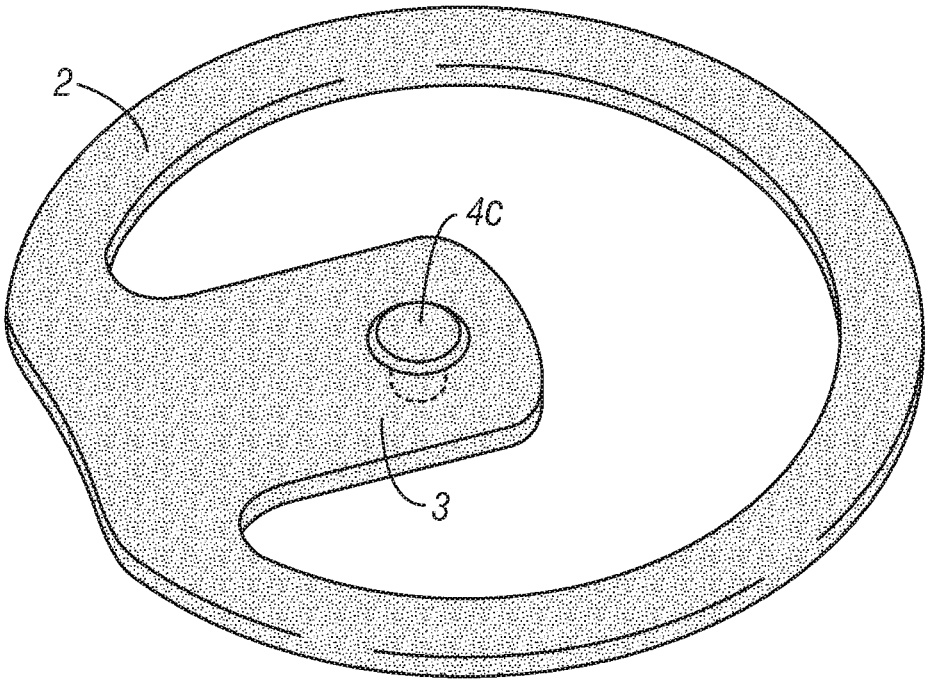
FIG. 38B illustrates a perspective view of an alternative embodiment of an opener assembly constructed in accordance with the disclosed principles having a single integral rivet.

FIG. 38B illustrates a perspective view of alternative embodiment of the opener assembly of FIG. 38A. In the embodiment of FIG. 38B, only a single rivet 4*c* is provided with the pull tab 3. However, as with the two-rivet embodiment of FIG. 38A, the single rivet 4*c* is integrally formed with the pull tab 3. Also as before, the single rivet 4*c* may also be made of metal encased with a non-metal pull tab 3, or it may be formed of the same non-metal material that forms the pull tab 3. Also as before, the single rivet 4*c*, whether metal or non-metal may then engage a crown body at the attachment portion so as to affix the opener assembly to the crown body for use in cracking open the crown when operated to remove the crown from a container.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural, materials, and logical substitutions and changes may be made without departing from the scope of this disclosure. Figures are merely representational and may not be drawn to scale. Certain proportions thereof may be exaggerated, while others may be minimized. Accordingly, the specification and drawings are to be regarded in an illustrative rather than a restrictive sense.

Figure 39:
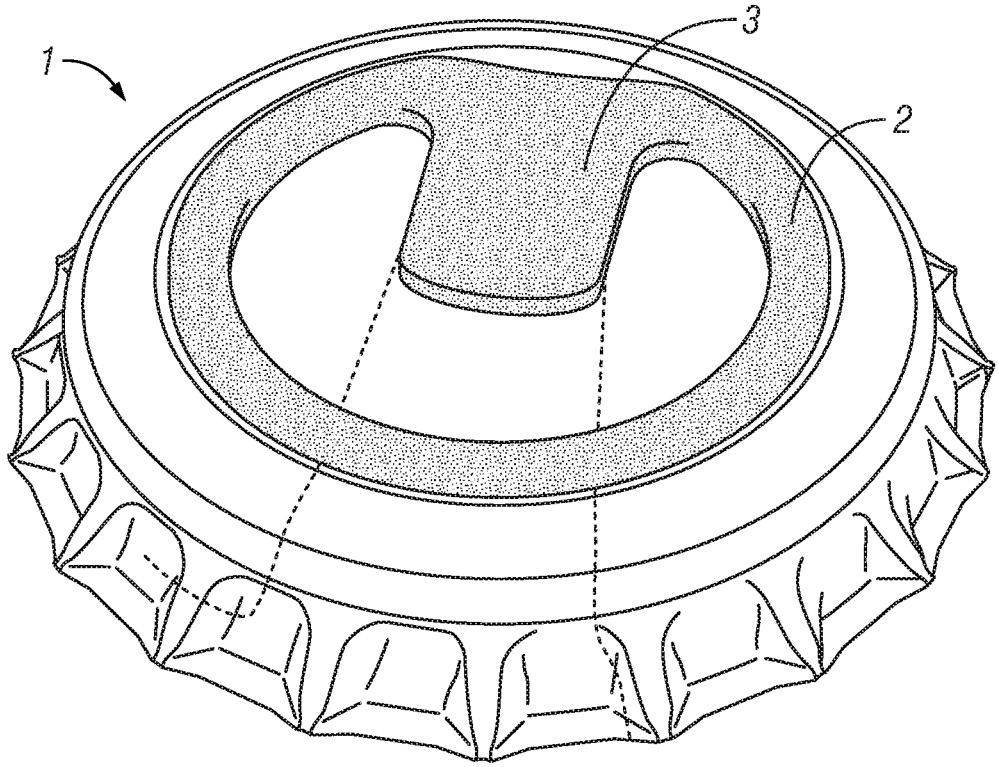
FIG. 39 illustrates a perspective view of another alternative embodiment of an opener assembly constructed in accordance with the disclosed principles having one or more hidden integral rivets.

FIG. 39 illustrates an isometric top view of an alternative embodiment of crown 1 having an opener assembly in accordance with the disclosed principles. The opener assembly, similar to the one shown in FIGS. 38A and 38B, is shown mounted on a crown body. In certain preferred embodiments, the opener assembly may be formed from non-metal materials, such as plastic, and fastened to a metallic crown that is formed from materials such as steel tinplate. Substitution of plastic ring pull 2 and pull tab 3 in place of a metallic ring reduces materials costs, product weight, and provides a more comfortable gripping surface. This illustrated embodiment of the opener assembly may include one or more integrated rivets such as the rivets discussed with reference to FIGS. 38A and 38B. In this illustrated embodiment, the rivet(s) are again integrally formed with the pull tab 3, and may again be metal while the pull tab 3 is non-metal, or may be non-metal integrally formed with a non-metal pull tab 3. However, in the embodiment of FIG. 39, the head of the rivet(s) are not visible from the top of the opener assembly.

Figure 40:
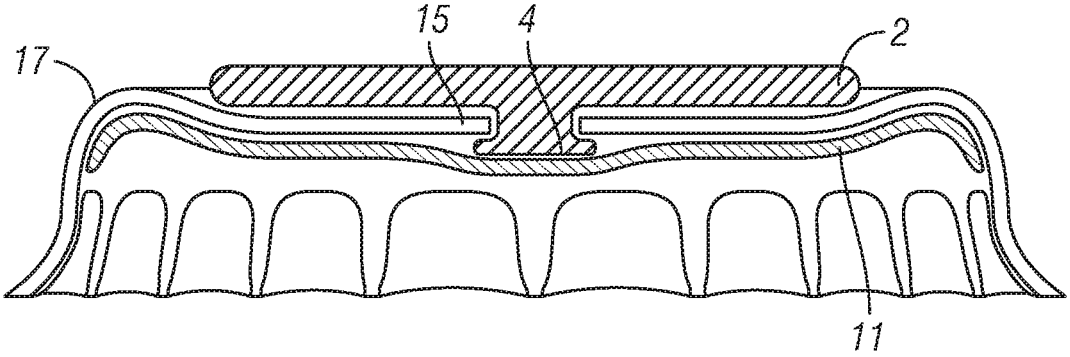
FIG. 40 illustrates a side view of the alternative embodiment of the crown of FIG. 39.

FIG. 40 illustrates a side view of the alternative embodiment of the crown of FIG. 39. The one or more rivets 4 of the opener assembly engage with the rivet hole as the attachment portion 15 of the crown body 1 to secure the opener assembly to the top of the crown body. The rivet head, which prevents the opener assembly from detaching from the crown body, is covered on the underside of the crown 1 by a liner 11 in order to facilitate an airtight seal when the crown 1 is attached to a bottle or other suitable container. Additionally, the opener assembly is recessed in seat 18 below shoulder 17 of the crown body in order to reduce the overall height of the crown such that it may be still installed using conventional bottling equipment. Alternatively, the opener assembly may sit on the surface of the crown body without being recessed below shoulder 17.

Figure 41A:
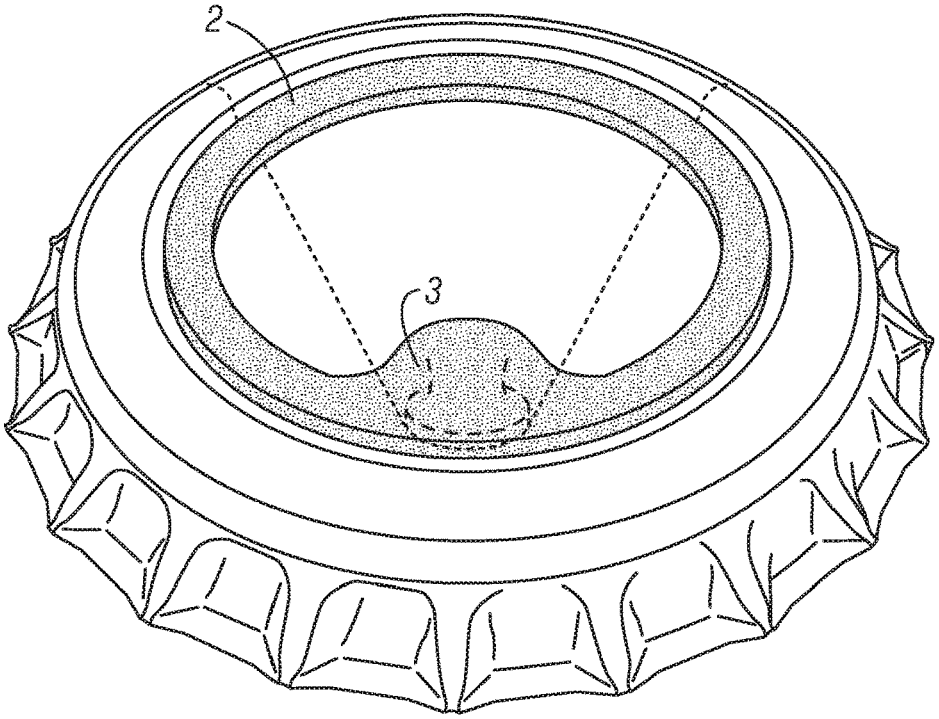
FIG. 41A illustrates an isometric top view of an alternative embodiment of the crown of FIG. 39.
Figure 41B:
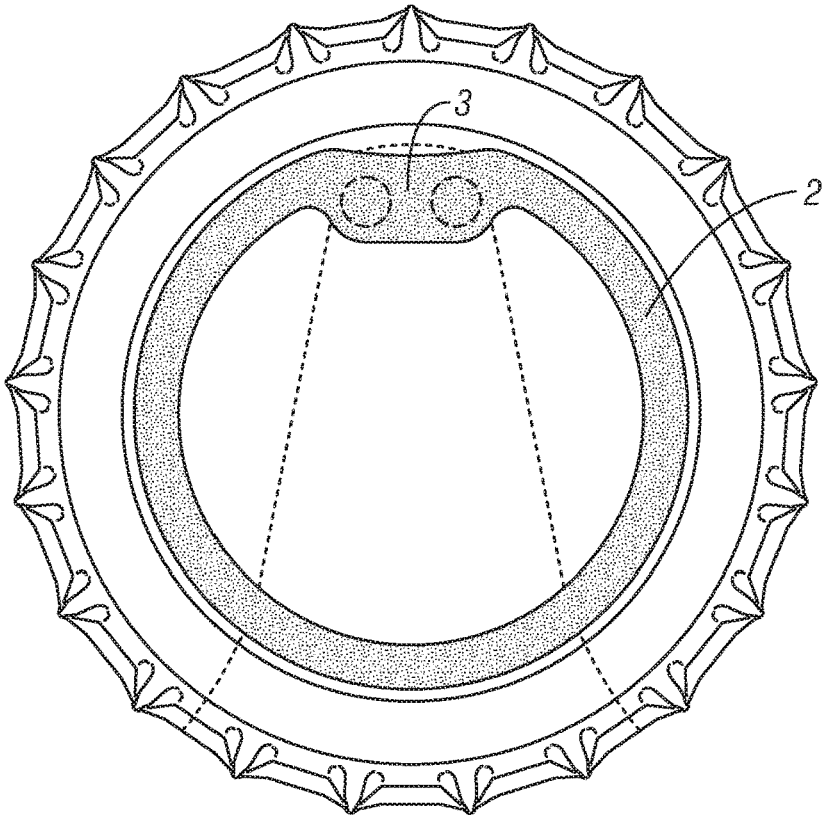
FIG. 41B illustrates as similar embodiment of the opener assembly in FIG. 41A, but having two rivets.

FIG. 41A illustrates an isometric top view of an alternative embodiment of the crown of FIG. 39. The opener assembly in this embodiment has a ring pull 2 and a shortened tab portion 3, which may be riveted to a crown body with an off-center tongue portion at on off-center attachment portion of the crown body. The tab portion 3 of this opener assembly has a single rivet 4 integrally formed on its underside; however, two or more rivets may also be employed as discussed above. The integral rivet 4 in this embodiment may again be non-metal in embodiments where the opener assembly is non-metal, and may even be the same material. In embodiments where the rivet 4 is metal and the opener assembly is non-metal, the metal rivet 4 may be integral with the opener assembly by forming the non-metal pull tab around the metal rivet to hold it in place. Once the rivet in this embodiment is compressed or otherwise attached (e.g., reflowing for non-metal rivets), the opener assembly operates as described above, but with added leverage when tearing the crown along the score lines due to the off-center attachment of the opener assembly. FIG. 41B illustrates as similar embodiment of the opener assembly in FIG. 41A, but having two rivets for providing further points of engagement/attachment with a crown body. Additionally, in further alternative embodiments (not shown), the rivet(s) 4 may be replaced by a rivet hole(s) and attached to the crown body using a no-integral rivet(s) as described above.

Figure 42:
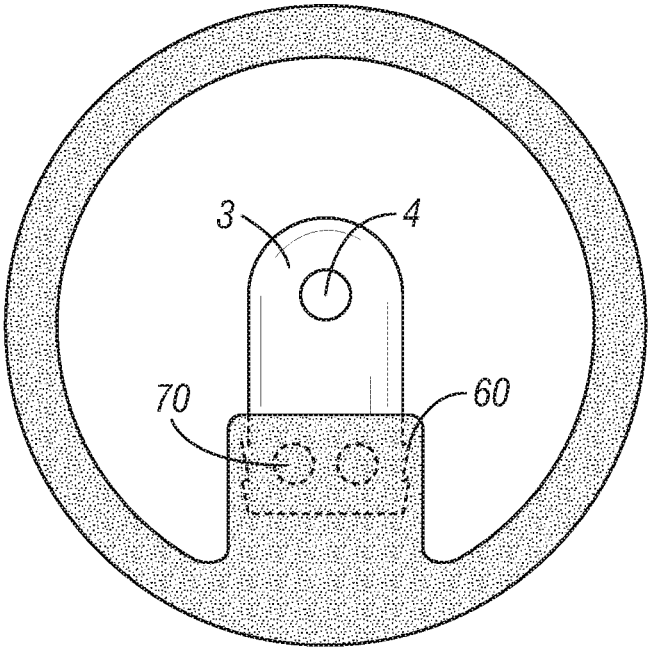
FIG. 42 illustrates a top view of a metal and non-metal opener assembly according to one embodiment of the present disclosure.

FIG. 42 illustrates a top view of a metal and non-metal opener assembly according to one embodiment of the present disclosure. The opener assembly in this embodiment has a non-metal ring pull 2, such as plastic or composite, which is formed around a metal pull tab 3. With some non-metal opener assemblies, a pulling force applied to the ring pull may cause the rivet hole of a non-metal pull tab to stretch such that the opener assembly detaches from the attached crown body without causing the tongue portion of the crown body to open as intended. Therefore, a metal pull tab 3 may be used to such applications to improve engagement of the opener assembly with a metal rivet that secures the opener assembly to the crown body. The metal pull tab 3 is embedded in the non-metal ring pull 2 using one or more reinforcement mechanisms, such as barbs 60 or holes 70 through which material of the ring pull 2 that extends to engage the metal pull tab 3 can be placed, or even a combination of both structural means of engaging the metal pull tab 3 to the non-metal ring pull 2, to hold the metal pull tab 3 securely within the non-metal ring pull 2.

Figure 43A:
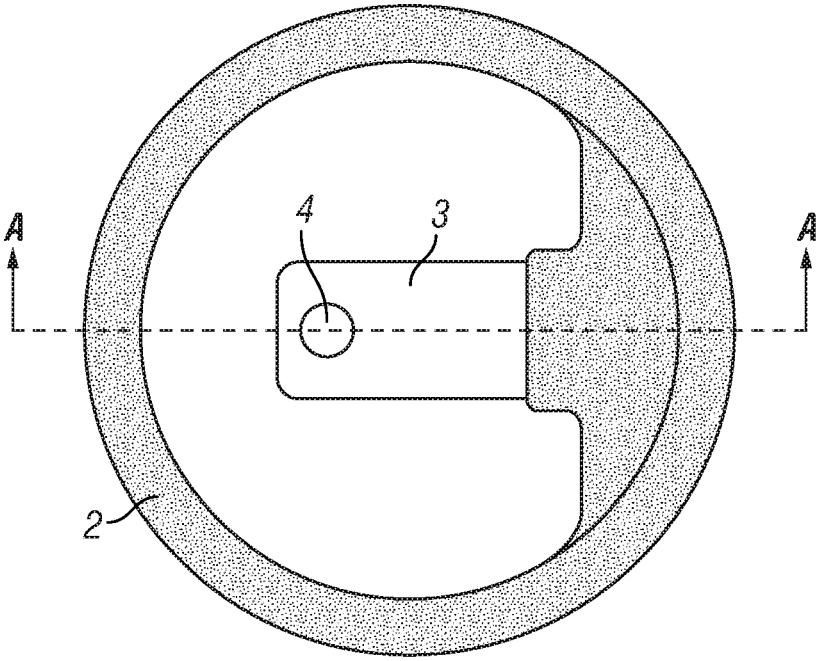
FIG. 43A illustrates a top view of another embodiment of an opener assembly in accordance with the disclosed principles, and which includes a metal pull tab secured within a non-metal ring pull by any of a variety of securing means.
Figure 43B:
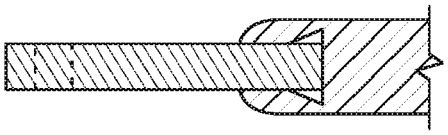
FIGS. 43B-43E illustrate cross-section views of the opener assembly of FIG. 43A taken along line A-A, each presenting an exemplary engaging features on the metal pull tab that are employed to secure the metal pull tab within the non-metal ring pull.
Figure 43E:
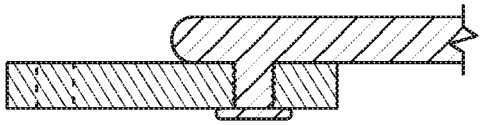
Figure 43C:
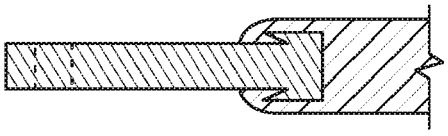
Figure 43D:
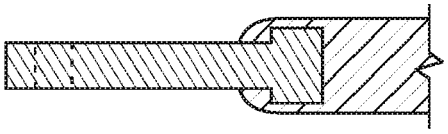

FIG. 43A illustrates a top view of another embodiment of an opener assembly in accordance with the disclosed principles, and which includes a metal pull tab 3 secured within a non-metal ring pull 3 by any of a variety of securing means. FIGS. 43B-43E illustrate cross-section views of the opener assembly of FIG. 43A taken along line A-A, each presenting an exemplary engaging features on the metal pull tab 3 that are employed to secure the metal pull tab 3 within the non-metal ring pull 2. FIG. 43B illustrates engaging features that employ one or more vertically extending barbs on each of the upper and lower surfaces of the metal pull tab 3 to secure the metal pull tab 3 within the non-metal ring pull 2. FIG. 43C illustrates engaging features that employ one or more horizontally extending barbs on each of the upper and lower surfaces of the metal pull tab 3 to secure the metal pull tab 3 within the non-metal ring pull 2. FIG. 43D illustrates engaging features that employ one or more vertically extending horizontal steps on each of the upper and lower surfaces of the metal pull tab 3 to secure the metal pull tab 3 within the non-metal ring pull 2. FIG. 43E illustrates engaging features that employ one or more vertically extending rivets on the lower surface of the non-metal ring pull 2 that are secured within corresponding hole(s) on the back end of the metal pull tab 3. Of course, other structural features may be employed as the engaging features used to secure a metal pull tab 3 to a non-metal ring pull 2 in accordance with the disclosed principles, while still falling within the scope of this disclosure.

Figure 44:
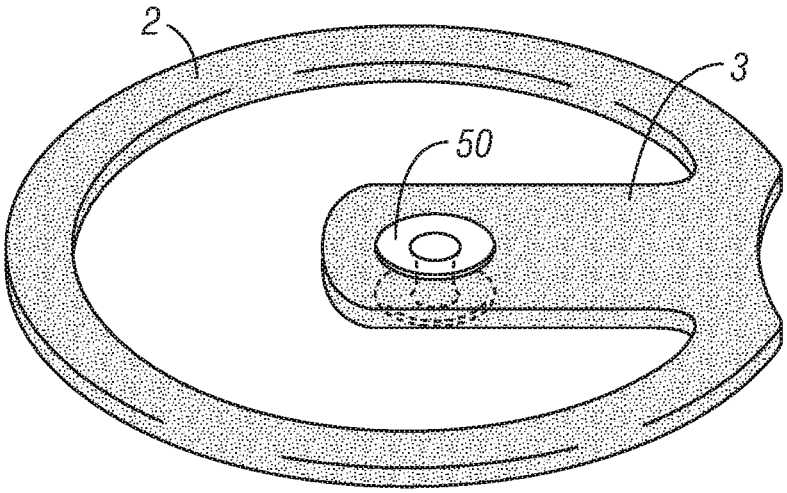
FIG. 44 illustrates an isometric top view of a non-metal ring pull and pull tab reinforced with a metal grommet in the pull tab.
Figure 44A:
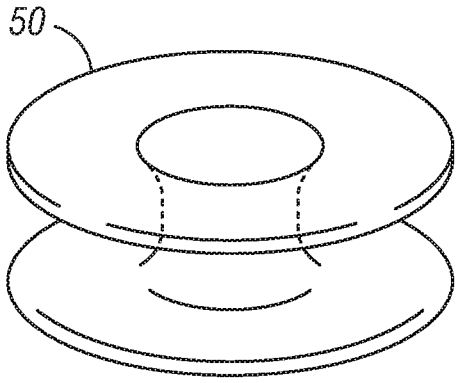
FIGS. 44A-44B illustrate an isometric top view and a side view, respectively, of exemplary metal grommets from the embodiment of FIG. 44.
Figure 44B:
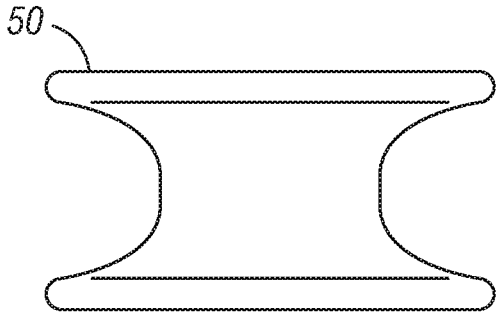

FIG. 44 illustrates an isometric top view of a non-metal ring pull 2 and pull tab 3 reinforced with a metal grommet 50 in the pull tab 3. The metal grommet 50 may approximate the inner surface of a toroidal structure or may merely be comprised of two substantially flat surfaces connected by a cylindrical section. The metal grommet 50 is used in such embodiments of an opener assembly to interface with a metal rivet used to join the opener assembly to a crown body. By forming the opener assembly with a metal grommet 50, the risk of detachment of the opener assembly from the crown body caused by stretching of the pull tab hole may be decreased or eliminated. FIG. 44A and FIG. 44B illustrate an isometric top view and a side view, respectively, of such a metal grommet 50, and which in this embodiment has the shape approximating the inner surface of a toroid; however, as mentioned above, the grommet 50 may also take on alternative shapes without departing from the scope of the disclosed principles.

Figure 45A:
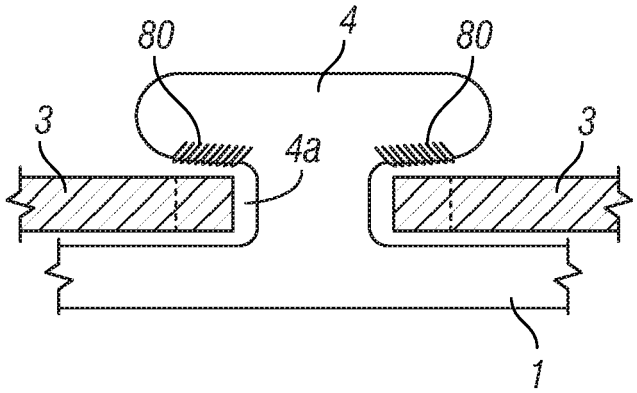
FIGS. 45A-45C show side views of a metal crown body with an integrally formed rivet, where the post extending from the rivet head comprises a sidewall comprising an abrasive surface.
Figure 45B:
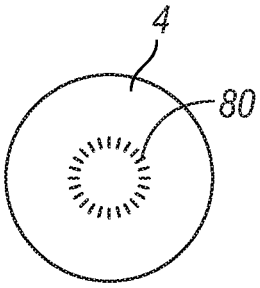
Figure 45C:
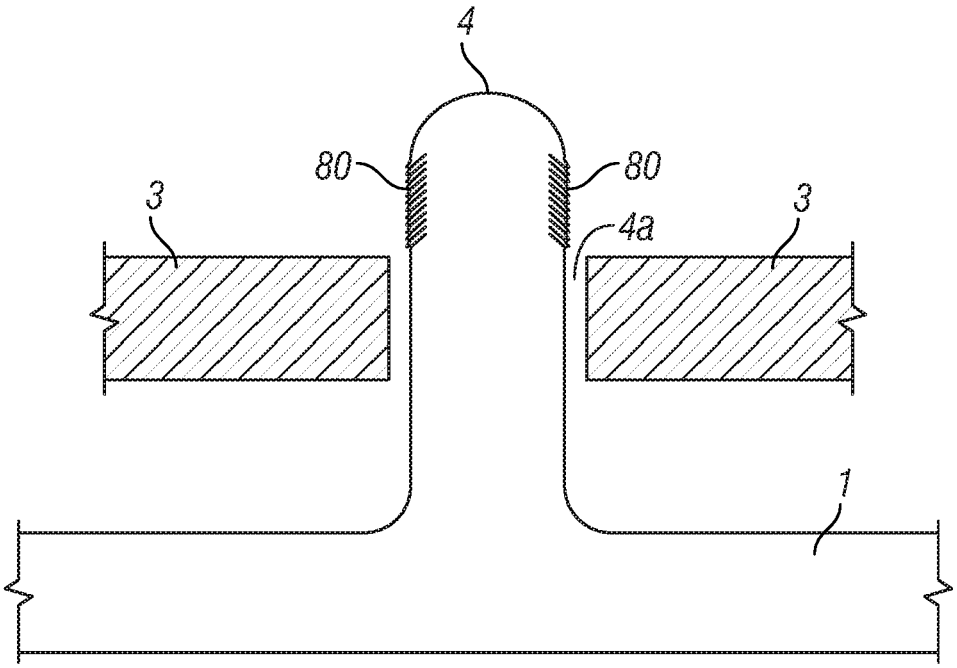

FIGS. 45A-45C show side views of a metal crown body 1 with an integrally formed rivet 4, where the post extending from the rivet head comprises a sidewall comprising an abrasive surface 80. In this illustrated embodiment, the abrasive surface 80 of the rivet post are shown as multiple rows of teeth. Additionally, while such teeth are shown only on portions of the surface of the rivet post in FIGS. 45A and 45C, in other embodiments, such as the embodiment shown in FIG. 45B, the teeth or other abrasive features 80 may be placed all the way around the post surface. In all such embodiments, when the rivet head is compressed over a rivet hole 4*a* as shown in FIG. 45A, the abrasive surface 80 deforms along with the compressed rivet head such that it engages with the upper surface of the pull tab 3 immediately surrounding the rivet hole 4*a*. The abrasive surface 80 increases the surface resistance of the two bodies such that the crown body better retains the opener assembly at the pull tab 3. FIG. 45C illustrates a side view of an exemplary formed rivet 4 having the abrasive surface 80 prior to compression of the rivet head onto the pull tab 3. As shown, the uncompressed rivet post easily passes through the rivet hole 4*a* in the pull tab 3. In embodiments employing a rivet having such abrasive surface 80 or other similar features, the pull tab 3 can advantageously be formed of non-metal material. As such, the increased engaging strength of the compressed rivet provided by the abrasive surface 80 may once again decrease or eliminate the chance that the hole in the non-metal pull tab 3 is unintentionally stretched during pulling of the ring pull such that it fails to stay attached to the crown body until the crown is successfully torn along the score lines. In this respect, the abrasive surface 80 "bites" down onto the non-metal pull tab 3 to keep it from stretching during use of the opener assembly.

Figure 47:
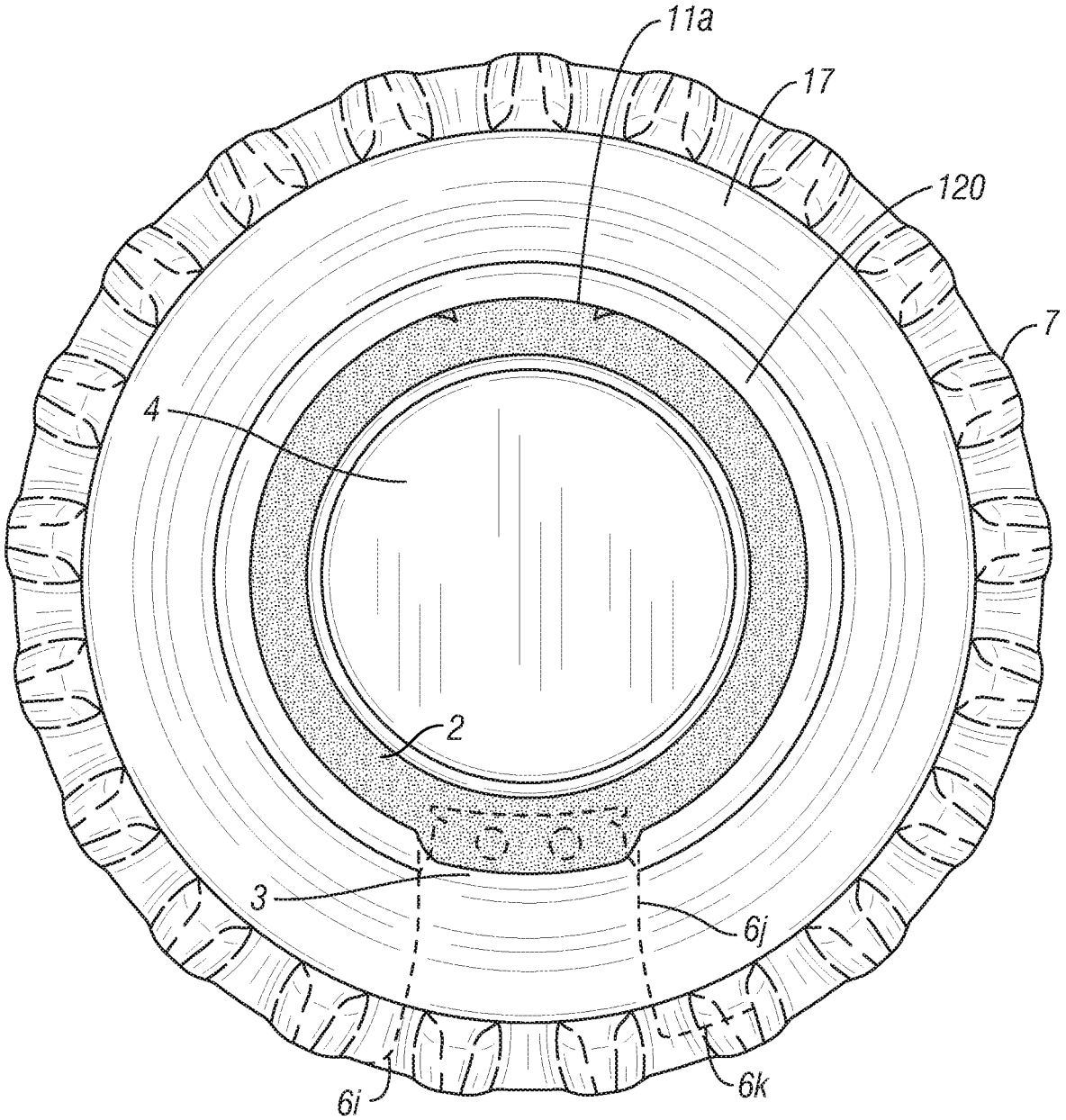
FIG. 47 illustrates an isometric top view of an alternative embodiment of a container crown with an integrated non-metal opener assembly.
Figure 48:
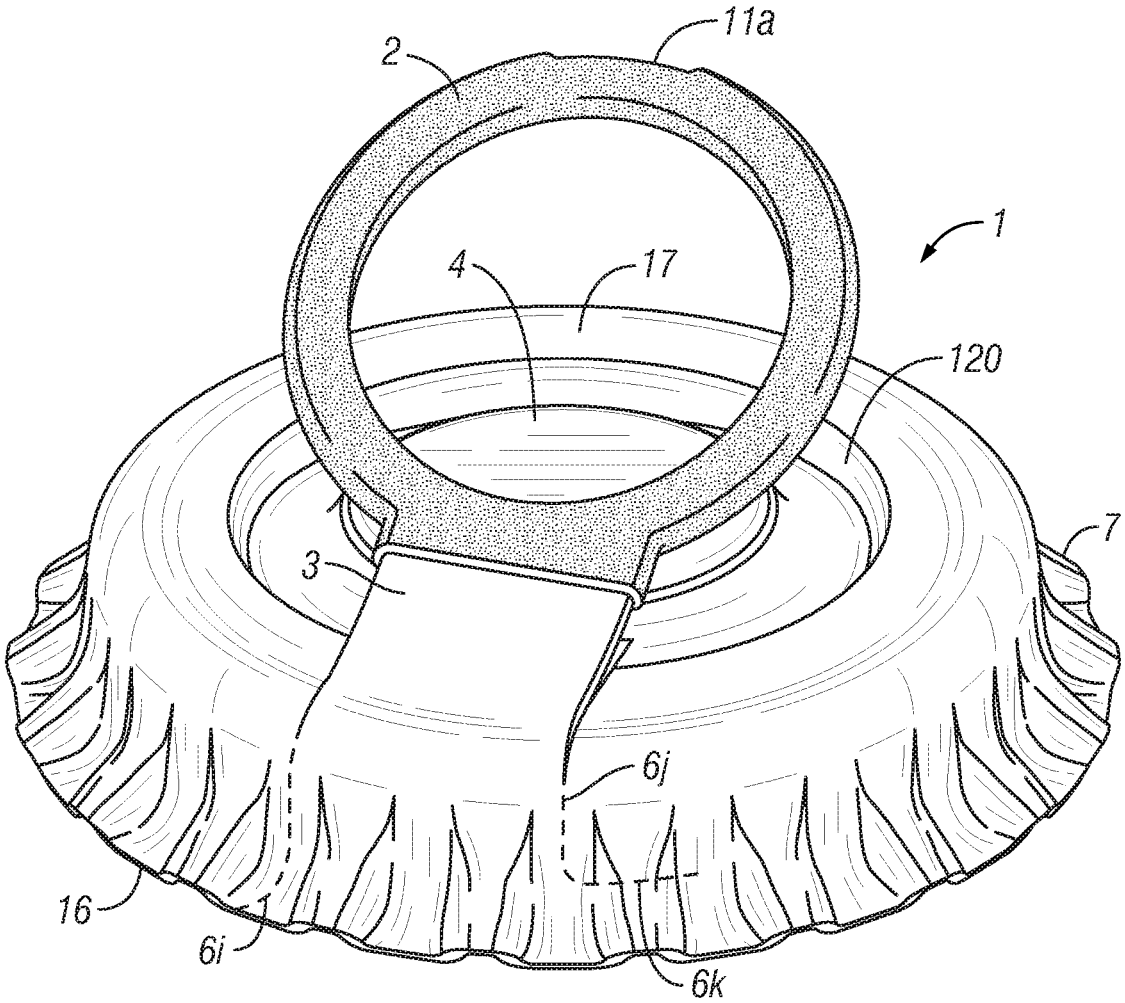
FIG. 48 illustrates an isometric top view of the crown of FIG. 47 with the ring pull in mid-opening position.

FIGS. 46-48 illustrate another alternative exemplary embodiments of a crown in accordance with the disclosed principles having an opener assembly formed integrally with a shoulder area of the top surface 17 of the crown, above the skirt 7. These exemplary embodiments provide an alternative rivetless construction for an opener assembly. FIG. 46 presents an isometric top view of a container crown with such an integrated opener assembly. Annular groove 120 is a recess formed between a central portion 4*b* of the top portion of the crown, and the crown's shoulder area of its top surface 17. Surface 4*b* and top surface 17 are substantially co-planar in this embodiment. Surface 4*b* is not a rivet in this embodiment, but is instead a central plateau formed when groove 120 is shaped by forming a recess in top portion of the crown 1. Ring pull 2 is disposed within groove 120. Pull tab 3 extends from skirt 7 and shoulder area 17 toward central surface 4*b* such that pull tab 3 is integrally formed with the shoulder area 17, while the ring pull 2 is disposed within groove 120 before the opener assembly is used to tear the crown 1.

Score lines 6*i*, 6*j* and 6*k* define the lateral edges of pull tab 3 and promote tearing open of the crown material along said score lines when crown 1 is opened by pulling tab 3 with ring pull 2. Score line 6*i* descends down skirt 7 to edge 16. Score line 6*j* descends into skirt 7 but bends before reaching edge 16 to traverse for a distance along skirt 7. Any or all of these score lines may also be formed from the underside of the crown 1, and thus not visible from the top of the crown 1, if desired. A finger nail divot 11*a* is also illustrated which may assist with use of the opener assembly by allowing the finger nail of a user to more easily engage and lift the ring pull 2.

As with other embodiments of crowns disclosed herein, this rivetless embodiment of a crown according to the disclosed principles may also benefit from a non-metal ring pull 2. Thus, FIG. 46 illustrates such a non-metal ring pull 2 attached to the metal pull tab 3 that is integral with the shoulder area 17 of the crown 1. Also as with previously discussed embodiments, the non-metal ring pull 2 may be attached to the metal pull tab 3 in any one of a variety of ways. For example, in this illustrated embodiment, the metal pull tab 3 includes a hole formed the end that engages the non-metal ring pull 2. This hole may be configured to receive non-metal material of the non-metal ring pull 2 therein, such as by molding the non-metal ring pull 2 around this end of the pull tab 3 or by reflowing the non-metal material of ring pull 2 so that it flows into the hole. Either of these techniques results in the non-metal material of the ring pull 2 within the hole acting as a pin or rivet-like structure to attach the non-metal ring pull 2 to the metal pull tab 3. Moreover, more than one such hole and pin may be employed to attached the non-metal ring pull 2 to the metal pull tab 3. FIG. 47 presents a top view of a rivetless crown similar to the crown shown in FIG. 46, but with the two holes in the pull tab 3 engaged by two corresponding pin structures from the non-metal ring pull 2. Of course, any number of such hole and pin structures may be employed without departing from the scope of the present disclosure.

FIG. 48 illustrates a top view isometric illustration of a crown similar to those of FIGS. 45 and 46 with the ring pull in mid-opening position. As the non-metal ring pull 2 is lifted out of groove 120 during use of the opener assembly to tear open the crown, metal pull tab 3 tears crown 1 open along lines 6*l* and 6*j*. To complete the removal of crown 1 from a container, ring pull 2 is lifted and pulled toward pull tab 3 so as to tear the crown material along line 6*i* and 6*j* until edge 16 is reached by line 6*i*, where upon crown 1 cracks open. Continuing to pull laterally and outward, crown 1 tears along line 6*j* and 6*k* to release crown 1 from the container in a unitary piece. Additionally, in embodiments of a rivetless crown according to the disclosed principles having non-metal ring pulls attached to metal pull tabs, other techniques for securing the non-metal ring pull to the meal pull tab may be employed. For example, the extended end of the metal tab 3 may include barbs in accordance with any of the exemplary embodiments discussed with reference to FIGS. 43B-43E. In each such technique, the extended end of the metal pull tab 3 would include one or more of such barbs to engage the non-material of the ring pull 2. Moreover, in such embodiments, the non-metal ring pull 2 may be molded over the extended end of the metal pull tab 3 during formation of the ring pull 2, or the non-metal ring pull 2 may be formed with a cavity sized to receive the extended end of the metal pull tab 3. In these, embodiments, the barbs or other engaging features or structures on the extended end of the metal pull tab 3 engage the cavity in the ring pull 2 sufficiently to prevent removal of the non-metal ring pull 2 from the pull tab 3 during use of the opener assembly to tear the crown.

In the numerous embodiments of the inventive subject matter disclosed herein, such embodiments may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the claims reflect, inventive subject matter lies in less than all features of a single disclosed embodiment. Thus the following claims are hereby incorporated into the Detailed Description, with each claim standing on its own as a separate embodiment.

The description has made reference to several exemplary embodiments. It is understood, however, that the words that have been used are for description and illustration, rather than words of limitation. Changes may be made within the purview of the appended claims, as presently stated and as amended, without departing from the scope and spirit of the disclosure in all its aspects. Although this description makes reference to particular means, materials and embodiments, the disclosure is not intended to be limited to the particulars disclosed; rather, the disclosure extends to all functionally equivalent technologies, structures, methods and uses such as are within the scope of the appended claims.

What is claimed is:

1. A frangible crown for a container opening, the crown comprising:

a crown body comprising:

a top portion;

an annular skirt having an annular side wall descending from the top portion and terminating at a bottom annular edge;

a frangible scoring arrangement comprising:

a curvilinear first score line extending in a first continuous radial direction from the top portion to the bottom annular edge of the skirt;

a plurality of rear score lines to facilitate cracking the frangible crown; and a curvilinear second score line comprising:

an upper radial segment extending in the first continuous radial direction from the top portion to the annular sidewall of the skirt, and a lower annular segment extending circumferentially along the annular side wall of the skirt from the upper radial segment to an endpoint substantially spaced from the bottom annular edge of the skirt;

an opener assembly attached to an attachment portion of the top portion and configured to break the top portion at one or more of the first and second score lines, the opener assembly comprising:

a non-metal ring pull having a molded connecting portion, and a metal pull tab having a connecting end formed with engaging features, wherein the connecting end of the metal pull tab is secured within the molded connecting portion of the non-metal ring pull using the engaging features extending within the molded connecting portion of the non-metal ring pull; and an attachment device coupling the metal pull tab to the attachment portion.

2. The frangible crown of claim 1, wherein the engaging features on the metal pull tab are selected from the group consisting of:

one or more vertically extending barbs on each of upper and lower surfaces of the connecting end of the metal pull tab to secure the connecting end within the molded connecting portion of the non-metal ring pull;

one or more horizontally extending barbs on each of upper and lower surfaces of the connecting end of the metal pull tab to secure the connecting end within the molded connecting portion of the non-metal ring pull; and one or more vertically extending steps on each of upper and lower surfaces of the connecting end of the metal pull tab to secure the connecting end within the molded connecting portion of the non-metal ring pull.

3. The frangible crown of claim 1, wherein the attachment device is a rivet formed integral with the attachment portion of the crown body, the integral rivet comprising engaging the metal pull tab of the opener assembly when the rivet is compressed to attached the opener assembly to the attachment portion.

4. The frangible crown of claim 1, wherein the frangible scoring arrangement further comprises an arcuate third score line extending around the attachment portion and connecting beginning ends of the first and second score lines, and proximal ends of each of the plurality of rear score lines.

5. A frangible crown for a container opening, the crown comprising:

a top portion;

an annular skirt having an annular side wall descending from the top portion and terminating at a bottom annular edge;

an opener assembly comprising:

a metal pull tab having a connecting end formed with engaging features; and a non-metal ring pull having a connecting portion molded about the engaging features of the metal pull tab, wherein the connecting end of the metal pull tab is secured within the molded connecting portion of the non-metal ring pull using the engaging features extending within the molded connecting portion of the non-metal ring pull, wherein the metal pull tab further having a second end integrally formed with an attachment portion of the annular sidewall such that the second end and the attachment portion of the annular sidewall are formed as a single unitary piece rather than two separate pieces joined together by an attachment means;

a recessed portion inwardly formed in the top portion and configured to receive the nonmetal ring pull therein;

a frangible scoring arrangement comprising:

a curvilinear first score line extending in a first continuous radial direction from the recessed portion along the annular sidewall to the bottom edge of the skirt; and a curvilinear second score line comprising:

an upper radial segment extending in the first continuous radial direction from the annular sidewall to an intermediate portion of the skirt, and a lower annular segment extending circumferentially along the intermediate portion of the skirt from the upper radial segment to an endpoint substantially spaced from the bottom annular edge of the skirt, wherein the first score line and the upper radial segment of the second score line define the lateral edges of the pull tab on the annular sidewall.

6. The frangible crown of claim 5, further comprising a boss upwardly formed from the top portion and configured to be received within the ring pull of the opener assembly.

7. The frangible crown of claim 6, wherein the boss is circular and concentrically formed within the recessed portion.

8. The frangible crown of claim 6, wherein a top of the boss is substantially level with the top portion of the crown.

9. The frangible crown of claim 5, wherein the engaging features on the metal pull tab are selected from a group consisting of:

one or more vertically extending barbs on each of upper and lower surfaces of the first end of the metal pull tab to secure the first end within the molded connecting portion of the non-metal ring pull;

one or more horizontally extending barbs on each of upper and lower surfaces of the first end of the metal pull tab to secure the first end within the molded connecting portion of the nonmetal ring pull; and one or more vertically extending steps on each of upper and lower surfaces of the first end of the metal pull tab to secure the first end within the molded connecting portion of the non-metal ring pull.

10. The frangible crown of claim 5, wherein the crown body further comprises an underside opposite the top portion, and one or more of the score lines of the frangible scoring arrangement is formed on the underside of the crown body.

11. The frangible crown of claim 3, wherein the integral rivet comprises engaging features positioned along at least a portion of an elongated sidewall of the rivet such that the engaging features protrude downward towards the pull tab and frictionally engage the pull tab of the opener assembly when the rivet is compressed to attached the opener assembly to the attachment portion.

12. The frangible crown of claim 1, wherein the attachment device is a rivet that is non-integral with the attachment portion of the crown body, the non-integral rivet comprising engaging the metal pull tab of the opener assembly when the rivet is compressed to attached the opener assembly to the attachment portion.

13. The frangible crown of claim 12, wherein the non-integral rivet comprises:

a smooth engaging surface, and a plurality of engaging features protruding from the smooth engaging surface downward towards the pull tab, wherein the protruding engaging features frictionally engage the pull tab to attach the opener assembly to the attachment portion.

14. The frangible crown of claim 1, further comprising a recessed portion downwardly formed in the top portion and configured to receive at least a portion of the opener assembly therein.

15. The frangible crown of claim 1, wherein the crown body further comprises an underside opposite the top portion, and one or more of the score lines of the frangible scoring arrangement is formed on the underside of the crown body.

* * * * *